US010395662B2

(12) United States Patent
Atti et al.

(10) Patent No.: US 10,395,662 B2
(45) Date of Patent: Aug. 27, 2019

(54) INTER-CHANNEL ENCODING AND DECODING OF MULTIPLE HIGH-BAND AUDIO SIGNALS

(71) Applicant: QUALCOMM Incorporated, San Diego, CA (US)

(72) Inventors: Venkatraman Atti, San Diego, CA (US); Venkata Subrahmanyam Chandra Sekhar Chebiyyam, Santa Clara, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/128,296

(22) Filed: Sep. 11, 2018

(65) Prior Publication Data

US 2019/0013030 A1 Jan. 10, 2019

Related U.S. Application Data

(63) Continuation of application No. 15/430,258, filed on Feb. 10, 2017, now Pat. No. 10,109,284.
(Continued)

(51) Int. Cl.
*G10L 19/008* (2013.01)
*G10L 21/0388* (2013.01)
(Continued)

(52) U.S. Cl.
CPC ..... *G10L 19/008* (2013.01); *G10L 19/0204* (2013.01); *G10L 19/04* (2013.01); *G10L 21/0388* (2013.01); *H04S 2420/03* (2013.01)

(58) Field of Classification Search
CPC ... G10L 19/008; G10L 19/0204; G10L 19/04; G10L 21/0388; H04S 2420/03
See application file for complete search history.

(56) References Cited

U.S. PATENT DOCUMENTS 10,109,284 B2 * 10/2018 Atti ..... G10L 19/008
2017/0236522 A1 8/2017 Atti et al.
(Continued)

FOREIGN PATENT DOCUMENTS

CN 104299615 A 1/2015
EP 1768107 A1 3/2007
WO 2014174344 A1 10/2014

OTHER PUBLICATIONS

Anonymous: "ISO/IEC JTC 1/SC 29 N ISO/IEC 23008-3:2015/PDAM 3 Information Technology—High Efficiency Coding and Media Delivery in Heterogeneous Environments—Part 3: Part 3: 3D Audio, Amendment 3: MPEG-H 3D Audio Phase 2", Jul. 25, 2015 (Jul. 25, 2015), XP055329830, pp. 1-202. Retrieved from the Internet: URL: http://mpeg.chiariglione.orgjstandards/mpeg-hj3d-audiojtext-isoiec-23008-3201xpdam-3-mpeg-h-3d-audio-phase-2.
(Continued)

*Primary Examiner* — Andrew L Sniezek
(74) *Attorney, Agent, or Firm* — Toler Law Group, P.C.

(57) ABSTRACT

A device includes an encoder and a transmitter. The encoder is configured to generate a first high-band portion of a mid signal based on a left signal and a right signal, to generate a first synthesized signal based on a first gain and linear predictive coefficient (LPC) parameters, and to generate a second synthesized signal based at least in part on a second gain and the LPC parameters. The encoder is also configured to generate a set of first gain parameters based on a comparison of the first synthesized signal and the mid signal, and to generate a set of adjustment gain parameters based on the second synthesized signal and a high-band non-reference signal. The transmitter is configured to transmit information corresponding to the first high-band portion of the mid signal. The transmitter is also configured to transmit the set
(Continued)

of adjustment gain parameters corresponding to the high-band non-reference signal.

30 Claims, 47 Drawing Sheets

Related U.S. Application Data

(60) Provisional application No. 62/294,953, filed on Feb. 12, 2016.

(51) Int. Cl.
*G10L 19/04* (2013.01)
*G10L 19/02* (2013.01)

(56) References Cited

U.S. PATENT DOCUMENTS

2017/0270935 A1 9/2017 Atti et al.
2017/0365260 A1 12/2017 Chebiyyam et al.
2018/0261232 A1* 9/2018 Chebiyyam ..... G10L 21/038

OTHER PUBLICATIONS

International Search Report and Written Opinion—PCT/US2017/017572—ISA/EPO—dated Apr. 7, 2017.
Itu-T, "7kHz Audio-Coding within 64 kbit/s: New Annex D with stereo embedded extension", ITU-T Draft; Study Period 2009-2012, International Telecommunication Union, Geneva; CH, vol. 10/16, May 8, 2012 (May 8, 2012), XP044050906, pp. 1-52.
Taiwan Search Report—TW106104661—TIPO—dated Jan. 17, 2019.

* cited by examiner

INTER-CHANNEL ENCODING AND DECODING OF MULTIPLE HIGH-BAND AUDIO SIGNALS

I. CROSS-REFERENCE TO RELATED APPLICATIONS

The present application claims priority from and is a continuation application of U.S. patent application Ser. No. 15/430,258, filed Feb. 10, 2017 and entitled "INTER-CHANNEL ENCODING AND DECODING OF MULTIPLE HIGH-BAND AUDIO SIGNALS," which claims priority from U.S. Provisional Patent Application No. 62/294,953, filed Feb. 12, 2016, entitled "INTER-CHANNEL ENCODING AND DECODING OF MULTIPLE HIGH-BAND AUDIO SIGNALS," which is incorporated by reference in its entirety.

II. FIELD

The present disclosure is generally related to encoding and decoding of multiple high-band audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio signals. A first audio signal may be received from a first microphone and a second audio signal may be received from a second microphone. In stereo-encoding, audio signals from the microphones may be encoded to generate a mid channel signal and one or more side channel signals. The mid channel signal may correspond to a sum of the first audio signal and the second audio signal. A side channel signal may correspond to a difference between the first audio signal and the second audio signal. At least one of a low-band portion of the mid signal, a low-band portion of the side signal, or a high-band portion of the mid signal may be encoded and transmitted from a first device. To reduce a number of bits transmitted, data corresponding to a high-band portion of the side signal may not be transmitted. A second device may receive the encoded signal and generate a high-band portion of the mid signal from the received encoded signal. The second device may generate a first output audio signal and a second output audio signal based on the high-band portion. The first output audio signal and the second output audio signal may differ from the first audio signal and the second audio signal, respectively, because of the lack of data corresponding to the high-band portion of the side signal. A user experience may be adversely impacted because of a difference between an audio signal received by the first device and an output signal generated by the second device.

IV. SUMMARY

In a particular aspect, a device includes an encoder and a transmitter. The encoder is configured to generate a first high-band portion of a first signal based on a left signal and a right signal. The encoder is also configured to generate a set of adjustment gain parameters based on a high-band non-reference signal. The high-band non-reference signal corresponds to one of a left high-band portion of the left signal or a right high-band portion of the right signal. The transmitter is configured to transmit information corresponding to the first high-band portion of the first signal. The transmitter is also configured to transmit the set of adjustment gain parameters.

In another particular aspect, a device includes a receiver and a decoder. The receiver is configured to receive information, a set of adjustment gain parameters, and a reference channel indicator. The decoder is configured to generate a first high-band portion of a first signal based on the information. The decoder is also configured to generate a non-reference high-band portion of a non-reference signal based on the set of adjustment gain parameters.

In another particular aspect, a method of communication includes generating, at a device, a first high-band portion of a first signal based on a left signal and a right signal. The method also includes generating, at the device, a set of adjustment gain parameters based on a high-band non-reference signal, the high-band non-reference signal corresponding to one of a left high-band portion of a left signal or a right high-band portion of a right signal as a high-band non-reference signal. The method further includes transmitting, from the device, information corresponding to the first high-band portion of the first signal, and the set of adjustment gain parameters.

In another particular aspect, a method of communication includes receiving, at a device, information, a set of adjustment gain parameters, and a reference channel indicator. The method also includes generating, at the device, a first high-band portion of a first signal based on the information. The method further includes generating, at the device, a non-reference high-band portion of a non-reference signal based on the set of adjustment gain parameters.

In another particular aspect, a computer-readable storage device stores instructions that, when executed by a processor, cause the processor to perform operations including generating a first high-band portion of a first signal based on a left signal and a right signal. The operations also include generating a set of adjustment gain parameters based on a high-band non-reference signal. The high-band non-reference signal corresponds to one of a left high-band portion of the left signal or a right high-band portion of the right signal. The operations further include causing transmission of information corresponding to the first high-band portion of the first signal, and the set of adjustment gain parameters corresponding to the high-band non-reference signal.

In another particular aspect, a computer-readable storage device stores instructions that, when executed by a processor, cause the processor to perform operations including receiving information, a set of adjustment gain parameters, and a reference channel indicator. The operations also include generating a first high-band portion of a first signal based on the information. The operations further include generating a non-reference high-band portion of a non-reference signal based on the set of adjustment gain parameters.

In another particular aspect, a device includes an encoder and a transmitter. The encoder is configured to generate linear predictive coefficient (LPC) parameters of a first high-band portion of a first audio signal. The encoder is also configured to generate a set of first gain parameters of the first high-band portion. The encoder is further configured to generate a set of adjustment gain parameters of a second high-band portion of a second audio signal. The transmitter is configured to transmit the LPC parameters, the set of first gain parameters, and the set of adjustment gain parameters.

In another particular aspect, a device includes a receiver and a decoder. The receiver is configured to receive linear predictive coefficient (LPC) parameters, a set of first gain parameters, and a set of adjustment gain parameters. The decoder is configured to generate a first high-band portion based on the LPC parameters and the set of first gain parameters. The decoder is also configured to generate a second high-band portion based on the set of adjustment gain parameters.

In another particular aspect, a device includes an encoder and a transmitter. The encoder is configured to generate linear predictive coefficient (LPC) parameters of a first high-band portion of a first audio signal. The encoder is also configured to generate an adjustment spectral shape parameter of a second high-band portion of a second audio signal. The transmitter is configured to transmit the LPC parameters and the adjustment spectral shape parameter.

In another particular aspect, a device includes a receiver and a decoder. The receiver is configured to receive linear predictive coefficient (LPC) parameters and an adjustment spectral shape parameter. The decoder is configured to generate a first high-band portion of a first audio signal based on the LPC parameters. The decoder is also configured to generate a second high-band portion of a second audio signal based on the adjustment spectral shape parameter.

In another particular aspect, a device includes a receiver and a decoder. The receiver is configured to receive linear predictive coefficient (LPC) parameters and inter-channel level difference (ILD) parameters. The decoder is configured to generate a first high-band portion of a first audio signal based on the LPC parameters. The decoder is also configured to generate a second high-band portion of a second audio signal based on the ILD parameters.

In another particular aspect, a method of communication includes generating, at a device, linear predictive coefficient (LPC) parameters of a first high-band portion of a first audio signal. The method also includes generating, at the device, a set of first gain parameters of the first high-band portion. The method further includes generating, at the device, a set of adjustment gain parameters of a second high-band portion of a second audio signal. The method also includes transmitting, from the device, the LPC parameters, the set of first gain parameters, and the set of adjustment gain parameters.

In another particular aspect, a method of communication includes receiving, at a device, linear predictive coefficient (LPC) parameters, a set of first gain parameters, and a set of adjustment gain parameters. The method also includes generating, at the device, a first high-band portion of a first audio signal based on the LPC parameters and the set of first gain parameters. The method further includes generating, at the device, a second high-band portion of a second audio signal based on the set of adjustment gain parameters.

In another particular aspect, a method of communication includes generating, at a device, linear predictive coefficient (LPC) parameters of a first high-band portion of a first audio signal. The method also includes generating, at the device, an adjustment spectral shape parameter of a second high-band portion of a second audio signal. The method further includes transmitting, from the device, the LPC parameters and the adjustment spectral shape parameter.

In another particular aspect, a method of communication includes receiving, at a device, linear predictive coefficient (LPC) parameters and an adjustment spectral shape parameter. The method also includes generating, at the device, a first high-band portion of a first audio signal based on the LPC parameters. The method further includes generating, at the device, a second high-band portion of a second audio signal based on the adjustment spectral shape parameter.

In another particular aspect, a method of communication includes receiving, at a device, linear predictive coefficient (LPC) parameters and inter-channel level difference (ILD) parameters. The method also includes generating, at the device, a first high-band portion of a first audio signal based on the LPC parameters. The method further includes generating, at the device, a second high-band portion of a second audio signal based on the ILD parameters.

In another particular aspect, a computer-readable storage device stores instructions that, when executed by a processor, cause the processor to perform operations including generating linear predictive coefficient (LPC) parameters of a first high-band portion of a first audio signal. The operations also include generating a set of first gain parameters of the first high-band portion. The operations further include generating a set of adjustment gain parameters of a second high-band portion of a second audio signal. The operations also include transmitting the LPC parameters, the set of first gain parameters, and the set of adjustment gain parameters.

In another particular aspect, a computer-readable storage device stores instructions that, when executed by a processor, cause the processor to perform operations including receiving linear predictive coefficient (LPC) parameters, a set of first gain parameters, and a set of adjustment gain parameters. The operations also include generating a first high-band portion of a first audio signal based on the LPC parameters and the set of first gain parameters. The operations further include generating a second high-band portion of a second audio signal based on the set of adjustment gain parameters.

In another particular aspect, a computer-readable storage device stores instructions that, when executed by a processor, cause the processor to perform operations including generating linear predictive coefficient (LPC) parameters of a first high-band portion of a first audio signal. The operations also include generating an adjustment spectral shape parameter of a second high-band portion of a second audio signal. The operations further include transmitting the LPC parameters and the adjustment spectral shape parameter.

In another particular aspect, a computer-readable storage device stores instructions that, when executed by a processor, cause the processor to perform operations including receiving linear predictive coefficient (LPC) parameters and an adjustment spectral shape parameter. The operations also include generating a first high-band portion of a first audio signal based on the LPC parameters. The operations further include generating a second high-band portion of a second audio signal based on the adjustment spectral shape parameter.

In another particular aspect, a computer-readable storage device stores instructions that, when executed by a processor, cause the processor to perform operations including receiving linear predictive coefficient (LPC) parameters and inter-channel level difference (ILD) parameters. The operations also include generating a first high-band portion of a first audio signal based on the LPC parameters. The operations further include generating a second high-band portion of a second audio signal based on the ILD parameters.

Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
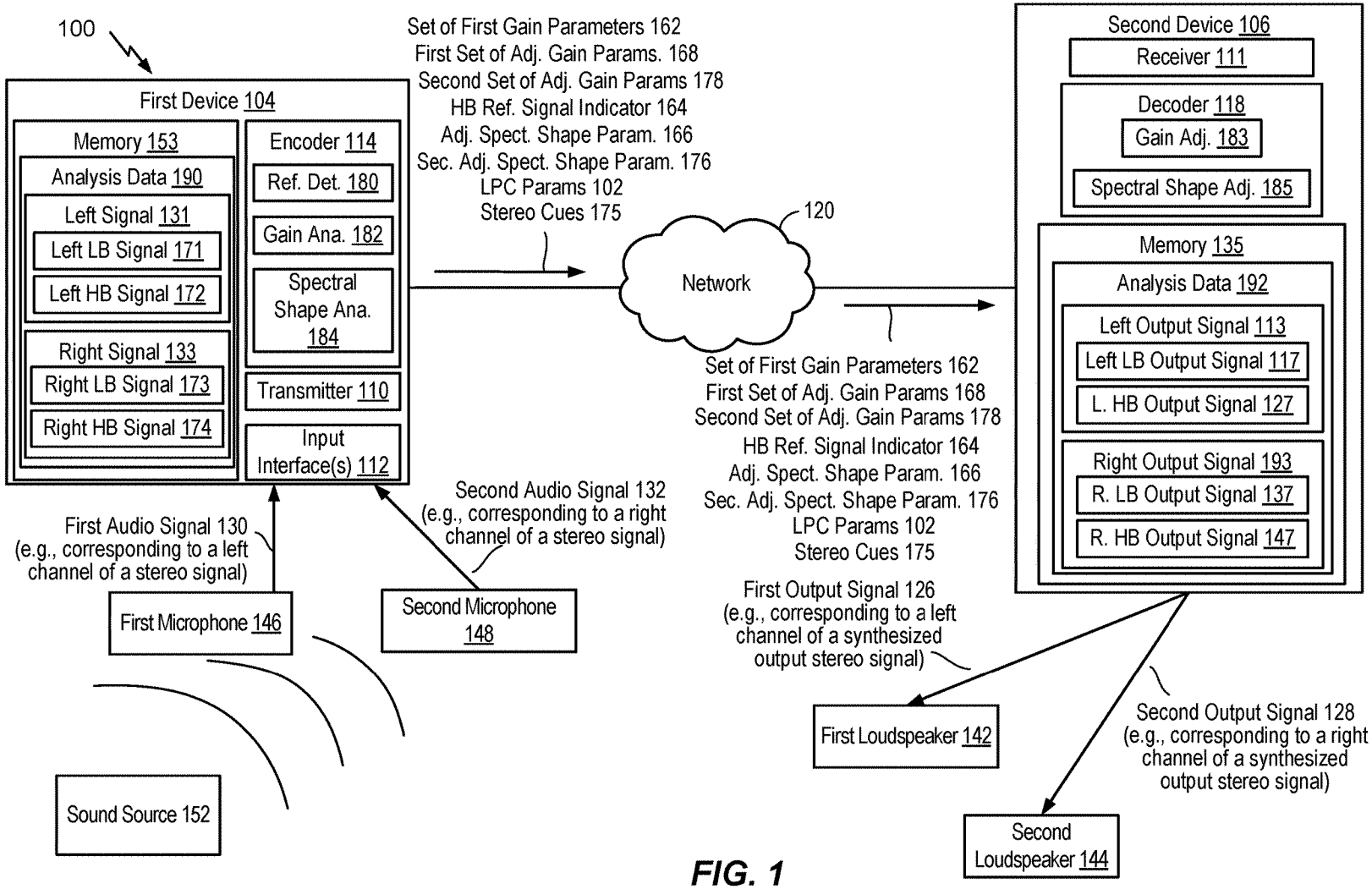
FIG. 1 is a block diagram of a particular illustrative example of a system that includes devices operable to encode or decode multiple high-band audio signals.

Systems and devices operable to encode and decode multiple high-band audio signals are disclosed. A first device may include an encoder configured to encode multiple audio signals. The multiple audio signals may be captured using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones. The first device may receive a first audio signal via a first microphone and may receive a second audio signal via a second microphone. The first audio signal may correspond to a Left channel of a stereo signal and the second audio signal may correspond to a Right channel of the stereo signal.

In stereo coding, a Mid channel (e.g., a sum channel) and a Side channel (e.g., a difference channel) may be generated based on the following Equation:

$$M=(L+R)/2, S=(L-R)/2, \quad \text{Equation 1}$$

where M corresponds to the Mid channel, S corresponds to the Side channel, L corresponds to the Left channel, and R corresponds to the Right channel.

In some cases, the Mid channel and the Side channel may be generated based on the following Equation:

$$M=c(L+R), S=c(L-R), \quad \text{Equation 2}$$

where c corresponds to a complex value which is frequency dependent. In a particular aspect, c may correspond to a scaling factor. In an alternate aspect, c may correspond to a function.

In other cases, the Mid channel and the Side channel may be generated based on the following Equation:

$$M=(L+g_D R)/2, S=(L-g_D R)/2, \quad \text{Equation 3}$$

where $g_D$ corresponds to a relative gain parameter for downmix processing, as further described with reference to FIG. 1.

It should be understood that Equation 1 and Equation 2 are non-limiting illustrative examples. In a particular aspect, the Mid channel and the Side channel may be generated based on another Equation.

In some cases, the Mid channel and the Side channel may be generated based on the following Equation:

$$M=g_1 L+g_2 R, S=g_1 L-g_2 R, \quad \text{Equation 4}$$

where $g_1$ corresponds to a first gain parameter and $g_2$ corresponds to a second gain parameter. In a particular aspect, a sum of $g_1$ and $g_2$ may equal 1 (e.g., $g_1+g_2=1.0$). It should be understood that Equations 1-4 are provided as non-limiting, illustrative examples. In a particular aspect, the Mid channel, the Side channel, or both, may be generated based on another Equation.

Generating the Mid channel and the Side channel (e.g., based on Equations 1-4) may be referred to as performing a "downmixing" algorithm. A reverse process of generating the Left channel and the Right channel from the Mid channel and the Side channel (e.g., based on Equations 1-4) may be referred to as performing an "upmixing" algorithm.

The encoder may generate spectral parameters (e.g., linear predictive coefficient (LPC) parameters) based on a high-band signal, such as a high-band portion of the Mid channel (e.g., a mid signal). In particular, the encoder may pre-process and resample the Mid channel to generate a mid high-band signal that corresponds to the high-band portion of the Mid channel. The encoder may encode the mid high-band signal using a high-band coding algorithm based on a time-domain bandwidth extension (TBE) model. The TBE coding of the mid high-band signal may produce a set of LPC parameters, a high-band overall gain parameter, and high-band temporal gain shape parameters. The encoder may generate a set of mid high-band gain parameters corresponding to the mid high-band signal. For example, the encoder may generate a synthesized mid high-band signal based on the LPC parameters and may generate the mid high-band gain parameter based on a comparison of the mid high-band signal and the synthesized mid high-band signal. The encoder may also generate at least one adjustment gain parameter, at least one adjustment spectral shape parameter, or a combination thereof, as described herein. The encoder may transmit the LPC parameters (e.g., mid high-band LPC parameters), the set of mid high-band gain parameters, the at least one adjustment gain parameter, the at least one spectral shape parameter, or a combination thereof. The LPC parameters, the mid high-band gain parameter, or both, may correspond to an encoded version of the mid high-band signal.

A decoder may receive the LPC parameters (e.g., the mid high-band LPC parameters), the set of mid high-band gain parameters, the at least one adjustment gain parameter, the at least one spectral shape (e.g., spectral tilt, spectral variation, spectral differences between Mid and Side channels or between Left and Right channels) parameter, or a combination thereof. The decoder may generate a synthesized mid high-band signal based on the LPC parameters (e.g., the mid high-band LPC parameters) and the set of mid high-band gain parameters. The decoder may also generate at least one high-band audio signal by adjusting the synthesized mid high-band signal based on the at least one adjustment gain parameter, the at least one spectral shape parameter, or a combination thereof. The at least one high-band audio signal may correspond to a first high-band portion of a first output signal, a second high-band portion of a second output signal, or both. The first high-band portion of the first output signal may approximate a high-band portion of the first audio signal. The second high-band portion of the second output signal may approximate a high-band portion of the second audio signal.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The encoder 114 may include a reference detector 180, a gain analyzer 182, a spectral shape analyzer 184, or a combination thereof. The encoder 114 may be configured to downmix and encode multiple audio signals, as described herein. The first device 104 may also include a memory 153 configured to store analysis data 190.

The second device 106 may include a decoder 118, a receiver 111, or both. The decoder 118 may include a gain adjuster 183, a spectral shape adjuster 185, or both. The decoder 118 may be configured to upmix and render the multiple channels. The second device 106 may be coupled to a first loudspeaker 142, a second loudspeaker 144, or both. The second device 106 may also include a memory 135 configured to store analysis data 192.

During operation, the first device 104 may receive a first audio signal 130 via the first input interface from the first microphone 146 and may receive a second audio signal 132 via the second input interface from the second microphone 148. The first audio signal 130 may correspond to a left channel of a stereo signal. The second audio signal 132 may correspond to a right channel of the stereo signal. In a particular aspect, the first audio signal 130, the second audio signal 132, or both, may not be received via microphones. For example, the first audio signal 130, the second audio signal 132, or both, may be received from another device or network or may be retrieved from storage at the first device 104.

The encoder 114 may store a left signal 131 corresponding to the first audio signal 130, a right signal 133 corresponding to the second audio signal 132, or both, in the memory 153. In a particular aspect, the left signal 131 may be a temporally shifted version of the first audio signal 130 or the right signal 133 may be a temporally shifted version of the second audio signal 132, as described herein. A sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132. The encoder 114 may determine a shift value (e.g., a temporal mismatch value) indicative of an amount of the shift (e.g., a non-causal shift or a temporal mismatch) of the first audio signal 130 (e.g., "target") relative to the second audio signal 132 (e.g., "reference"). The encoder 114 may generate a gain parameter (e.g., a codec gain parameter) based on samples of the "target" signal and based on samples of the "reference" signal. As an example, the gain parameter may be based on one of the following Equations:

$$g_D = \frac{\sum_{n=0}^{N-N1} Ref(n)\ Targ(n+N_1)}{\sum_{n=0}^{N-N1} Targ^2(n+N_1)}, \quad \text{Equation 5a}$$

$$g_D = \frac{\sum_{n=0}^{N-N1} |Ref(n)|}{\sum_{n=0}^{N-N1} |Targ(n+N_1)|}, \quad \text{Equation 5b}$$

$$g_D = \frac{\sum_{n=0}^{N} Ref(n)\ Targ(n)}{\sum_{n=0}^{N} Targ^2(n)}, \quad \text{Equation 5c}$$

$$g_D = \frac{\sum_{n=0}^{N} |Ref(n)|}{\sum_{n=0}^{N} |Targ(n)|}, \quad \text{Equation 5d}$$

$$g_D = \frac{\sum_{n=0}^{N-N1} Ref(n)\ Targ(n)}{\sum_{n=0}^{N} Ref^2(n)}, \quad \text{Equation 5e}$$

$$g_D = \frac{\sum_{n=0}^{N-N1} |Targ(n)|}{\sum_{n=0}^{N} |Ref(n)|}, \quad \text{Equation 5f}$$

where $g_D$ corresponds to the relative gain parameter for downmix processing, Ref(n) corresponds to samples of the "reference" signal, $N_1$ corresponds to the non-causal shift value of the first frame, and Targ(n+$N_1$) corresponds to samples of the "target" signal. The gain parameter ($g_D$) may be modified, e.g., based on one of the Equations 5a-5f, to incorporate long term smoothing/hysteresis logic to avoid large jumps in gain between frames. When the target signal includes the first audio signal 130, the first samples may include samples of the target signal and the selected samples may include samples of the reference signal. When the target signal includes the second audio signal 132, the first samples may include samples of the reference signal, and the selected samples may include samples of the target signal.

The encoder 114 may generate a mid signal, a side signal, or both, based on the first samples, the selected samples, and the relative gain parameter for downmix processing. For example, the encoder 114 may generate the mid signal based on one of the following Equations:

$$M = \mathrm{Ref}(n) + g_D \mathrm{Targ}(n+N_1), \quad \text{Equation 6a}$$

$$M = \mathrm{Ref}(n) + \mathrm{Targ}(n+N_1), \quad \text{Equation 6b}$$

where M corresponds to the mid signal, $g_D$ corresponds to the relative gain parameter for downmix processing, Ref (n) corresponds to samples of the "reference" signal, $N_1$ corresponds to the non-causal shift value of the first frame, and Targ(n+$N_1$) corresponds to samples of the "target" signal.

The encoder 114 may generate the side channel signal based on one of the following Equations:

$$S = \mathrm{Ref}(n) - g_D \mathrm{Targ}(n+N_1), \quad \text{Equation 7a}$$

$$S = g_D \mathrm{Ref}(n) - \mathrm{Targ}(n+N_1), \quad \text{Equation 7b}$$

where S corresponds to the side channel signal, $g_D$ corresponds to the relative gain parameter for downmix processing, Ref (n) corresponds to samples of the "reference" signal, $N_1$ corresponds to the non-causal shift value of the first frame, and Targ(n+$N_1$) corresponds to samples of the "target" signal.

In a particular aspect, the encoder 114 may estimate the gain parameter ($g_D$) (e.g, a low-band gain parameter) based on low-band samples (e.g., 0-8 kHz) of the reference signal and the target signal. For example, Ref(n) may correspond to low-band samples (e.g., 0-8 kHz) of the reference signal, and Targ (n+$N_1$) may correspond to low-band samples (e.g., 0-8 kHz) of the target signal. In this aspect, the encoder 114 may generate a low-band portion of the mid signal, a low-band portion of the side signal, or both, based on the low-band gain parameter. The encoder 114 may generate a high-band portion of the mid signal, a high-band portion of the side signal, or both, based on a high-band gain parameter. The "low-band portion of the mid signal" may be referred to herein as a "mid low-band signal." The "low-band portion of the side signal" may be referred to herein as a "side low-band signal." The "high-band portion of the mid signal" may be referred to herein as a "mid high-band signal." The high-band portion of the side signal" may be referred to herein as a "side high-band signal."

When the target signal includes the first audio signal 130, the left signal 131 may correspond to Targ (n+$N_1$) and the right signal 133 may correspond to Ref(n). In an alternate aspect, the left signal 131 and the right signal 133 may correspond to non-shifted signals. For example, the left signal 131 may correspond to the first audio signal 130 (e.g., Targ (n)), the right signal 133 may correspond to the second audio signal 132 (e.g., Ref(n)), or both.

When the target signal includes the second audio signal 132, the right signal 133 may correspond to Targ (n+$N_1$) and the left signal 131 may correspond to Ref(n). In an alternate aspect, the left signal 131 and the right signal 133 may correspond to non-shifted signals. For example, the right signal 133 may correspond to the first audio signal 130 (e.g., Targ (n)), the left signal 131 may correspond to the second audio signal 132 (e.g., Ref(n)), or both.

A low-band portion (e.g., 0-8 kilohertz (kHz)) of the left signal 131 may correspond to a left low-band (LB) signal 171. A high-band portion (e.g., 8-16 kHz) of the left signal 131 may correspond to a left high-band (HB) signal 172. A low-band portion (e.g., 0-8 kHz) of the right signal 133 may correspond to a right LB signal 173. A high-band portion (e.g., 8-16 kHz) of the right signal 133 may correspond to a right HB signal 174.

The encoder 114 may generate linear predictive coefficient (LPC) parameters 102, a set of first gain parameters 162, or both, corresponding to the mid high-band signal, as further described with reference to FIGS. 2-5. The LPC parameters 102 may include a line spectral frequency (LSF) index. The set of first gain parameters 162 may include a gain shapes index, a gain frame index, or both. The set of first gain parameters 162 may indicate an overall frame gain, subframe temporal gain shapes, or a combination thereof, corresponding to the mid high-band signal.

In an alternate implementation, the encoder 114 may generate the LPC parameters 102, the set of first gain parameters 162, or both, corresponding to the left HB signal 172 or the right HB signal 174. For example, the encoder 114 may generate the LPC parameters 102 based on the left HB signal 172. The encoder 114 may generate a synthesized left HB signal based on the LPC parameters 102 and may generate the set of first gain parameters 162 based on a comparison of the left HB signal 172 and the synthesized left HB signal. As another example, the encoder 114 may generate the LPC parameters 102 based on the right HB signal 174. The encoder 114 may generate a synthesized right HB signal based on the LPC parameters 102 and may generate the set of first gain parameters 162 based on a comparison of the right HB signal 174 and the synthesized right HB signal. The LPC parameters 102 may include a LSF index. The set of first gain parameters 162 may include a gain shapes index, a gain frame index, or both.

In a particular aspect, the encoder 114 may select one of the left HB signal 172 or the right HB signal 174 as a reference signal, as described herein. The encoder 114 may generate the LPC parameters 102, the set of first gain parameters 162, or both, based on the reference signal (e.g., the left HB signal 172 or the right HB signal 174).

The reference detector 180 may detect whether the left signal 131 or the right signal 133 corresponds to a reference signal (e.g., a coding reference signal), as described with reference to FIGS. 6-8. The reference detector 180 may designate one of the left signal 131 (e.g., the left HB signal 172) or the right signal 133 (e.g., the right HB signal 174) as the reference signal and the other of the left signal 131 (e.g., the left HB signal 172) or the right signal 133 (e.g., the right HB signal 174) as a non-reference signal. The reference signal detected by the reference detector 180 may be the same as or distinct from the reference signal (e.g., Ref(n)) corresponding to the shift value. The reference detector 180 may detect the reference signal based on a comparison of the left HB signal 172 and the right HB signal 174, as described with reference to FIG. 7A, based on a comparison of the first audio signal 130 and the second audio signal 132, as described with reference to FIG. 7B, or based on a gain parameter (e.g., the relative gain parameter for downmix processing), as described with reference to FIG. 8. The reference detector 180 may generate a high-band (HB) reference signal indicator 164 that indicates the left HB signal 172 or the right HB signal 174 corresponds to the reference signal, as described with reference to FIGS. 6-8. For example, a first value (e.g., 0) of the HB reference signal indicator 164 may indicate that the left HB signal 172 corresponds to the non-reference signal and the right HB signal 174 corresponds to the reference signal. A second value (e.g., 1) of the HB reference signal indicator 164 may indicate that the left HB signal 172 corresponds to the reference signal and the right HB signal 174 corresponds to the non-reference signal. As used herein, a "reference signal indicator" may also be referred to as a "reference channel indicator."

The gain analyzer 182 may generate a first set of adjustment gain parameters 168, a second set of adjustment gain parameters 178, or both, as described with reference to FIGS. 6 and 9-14. The spectral shape analyzer 184 may generate an adjustment spectral shape parameter 166 (e.g., an adjustment tilt parameter), a second adjustment spectral shape parameter 176 (e.g., an adjustment tilt parameter), or both, as described with reference to FIGS. 6 and 18-21.

The encoder 114 may generate one or more stereo cues 175 corresponding to the left HB signal 172 or the right HB signal 174. For example, the stereo cues 175 may include inter-channel level difference (ILD) parameter values. Each of the ILD parameter values may indicate a ratio of energy of the left HB signal 172 relative to energy of the right HB signal 174 for a particular frequency range. For example, a first ILD parameter value of the stereo cues 175 may indicate a ratio of energy of a first frequency range of the left HB signal 172 relative to energy of the first frequency range of the right HB signal 174. A second ILD parameter value of the stereo cues 175 may indicate a ratio of energy of a second frequency range of the left HB signal 172 relative to energy of the second frequency range of the right HB signal 174. In a particular aspect, the first frequency range may overlap the second frequency range. In an alternate aspect, the first frequency range may be non-overlapping with respect to the second frequency range.

The transmitter 110 may transmit the LPC parameters (params) 102, the set of first gain parameters 162, the HB reference signal indicator 164, the first set of adjustment (adj.) gain parameters 168, the second set of adjustment gain parameters 178, the adjustment spectral shape parameter 166, the second adjustment spectral shape parameter 176, the stereo cues 175, or a combination thereof, via the network 120, to the second device 106. In some implementations, the transmitter 110 may store the LPC parameters 102, the set of first gain parameters 162, the HB reference signal indicator 164, the first set of adjustment gain parameters 168, the second set of adjustment gain parameters 178, the adjustment spectral shape parameter 166, the second adjustment spectral shape parameter 176, or a combination thereof, at a device of the network 120 or a local device for further processing or decoding later.

The decoder 118 may receive the LPC parameters 102, the set of first gain parameters 162, the HB reference signal indicator 164, the first set of adjustment gain parameters 168, the second set of adjustment gain parameters 178, the adjustment spectral shape parameter 166, the second adjustment spectral shape parameter 176, or a combination thereof. The decoder 118 may perform upmixing to generate a left output signal 113, a right output signal 193, or both, as described herein. A left LB output signal 117 may correspond to a low-band portion of the left output signal 113. A left HB output signal 127 may correspond to a high-band portion of the left output signal 113. A right LB output signal 137 may correspond to a low-band portion of the right output signal 193. A right HB output signal 147 may correspond to a high-band portion of the right output signal 193. The left output signal 113 may correspond to a left channel of a synthesized output stereo signal. The right output signal 193 may correspond to a right channel of the synthesized output stereo signal.

The decoder 118 may generate a synthesized mid signal based on the LPC parameters 102, the set of first gain parameters 162, or both. The decoder 118 may generate the left output signal 113, the right output signal 193, or both, based at least in part on the synthesized mid signal, the HB reference signal indicator 164, the first set of adjustment gain parameters 168, the second set of adjustment gain parameters 178, the adjustment spectral shape parameter 166, the second adjustment spectral shape parameter 176, or a combination thereof, as further described with reference to FIGS. 24-39. For example, the gain adjuster 183 may adjust a gain of the synthesized mid signal based on the first set of adjustment gain parameters 168 to generate a gain adjusted signal and the spectral shape adjuster 185 may adjust a shape (e.g., a spectral envelope) of the gain adjusted signal based on the adjustment spectral shape parameter 166 to generate the right HB output signal 147. Alternatively, the spectral shape adjuster 185 may adjust a shape (e.g., a spectral envelope) of the synthesized mid signal based on the adjustment spectral shape parameter 166 to generate a spectral shape adjusted signal and the gain adjuster 183 may adjust a gain of the spectral shape adjusted signal based on the first set of adjustment gain parameters 168 to generate the right HB output signal 147.

In a particular aspect, the decoder 118 may generate the left output signal 113, the right output signal 193, or both, based on a shift value. For example, the decoder 118 may generate a left signal and a right signal based on the synthesized mid signal. The decoder 118 may temporally shift the left signal based on a shift value to generate a temporally shifted left signal and may generate the left output signal 113 based on the temporally shifted left signal. Alternatively, the decoder 118 may temporally shift the right signal based on the shift value to generate a temporally shifted right signal and may generate the right output signal 193 based on the temporally shifted right signal.

The decoder 118 may generate a first output signal 126 corresponding to the left output signal 113, a second output signal 128 corresponding to the right output signal 193, or both. In a particular aspect, the decoder 118 may generate the first output signal 126 by temporally shifting the left output signal 113 or generate the second output signal 128 by temporally shifting the right output signal 193. Alternatively, the first output signal 126 may be the same as the left output signal 113 and the second output signal 128 may be the same as the right output signal 193. The second device 106 may output the first output signal 126 via the first loudspeaker 142. The second device 106 may output the second output signal 128 via the second loudspeaker 144. A synthesized stereo output signal may include the first output signal 126, the second output signal 128, or both.

In a particular aspect, instead of generating a single set of the LPC parameters 102, the set of first gain parameters 162, and the first set of adjustment gain parameters 168 for transmission to the second device 106, the encoder 114 may generate left HB LPC parameters, a left gain parameter, or both, corresponding to the left HB signal 172, right LPC parameters, a right gain parameter, or both, corresponding to the right HB signal 174, as described with reference to FIG. 23. In a particular aspect, the encoder 114 may switch between using a first encoding approach to encode a first frame and using a second encoding approach to encode a second frame. The first encoding approach may include generating the single set of the LPC parameters 102, the set of first gain parameters 162, and the first set of adjustment gain parameters 168. The second encoding approach may include generating left HB LPC parameters, a left gain parameter, or both, corresponding to the left HB signal 172, and right LPC parameters, a right gain parameter, or both, corresponding to the right HB signal 174. The encoder 114 may switch between using the first encoding approach and using the second encoding approach based on a temporal mismatch value, a reference signal indicator based on the temporal mismatch value, the HB reference signal indicator 164, or a combination thereof. The transmitter 110 may transmit the left HB LPC parameters, the left gain parameter, the right LPC parameters, the right gain parameter, or a combination thereof. The decoder 118 may generate the first output signal 126 based on the left HB LPC parameters and the left gain parameter, the second output signal 128 based on the right HB LPC parameters and the right gain parameter, or both.

The system 100 may thus enable the decoder 118 to generate an output signal (e.g., the first output signal 126 or the second output signal 128) having a high-band portion that approximates the left HB signal 172 (or the right HB signal 174). The decoder 118 may generate the high-band portion based at least in part on the first set of adjustment gain parameters 168, the second set of adjustment gain parameters 178, the adjustment spectral shape parameter 166, the second adjustment spectral shape parameter 176, or a combination thereof.

Although FIG. 1 illustrates the encoder 114 including the reference detector 180, the gain analyzer 182, and the spectral shape analyzer 184, in other implementations one or more of the reference detector 180, the gain analyzer 182, or the spectral shape analyzer 184 may be omitted. Although FIG. 1 illustrates the decoder 118 including the gain adjuster 1183 and the spectral shape adjuster 185, in other implementations the gain adjuster 1183, the spectral shape adjuster 185, or both, may be omitted.

Figure 2:
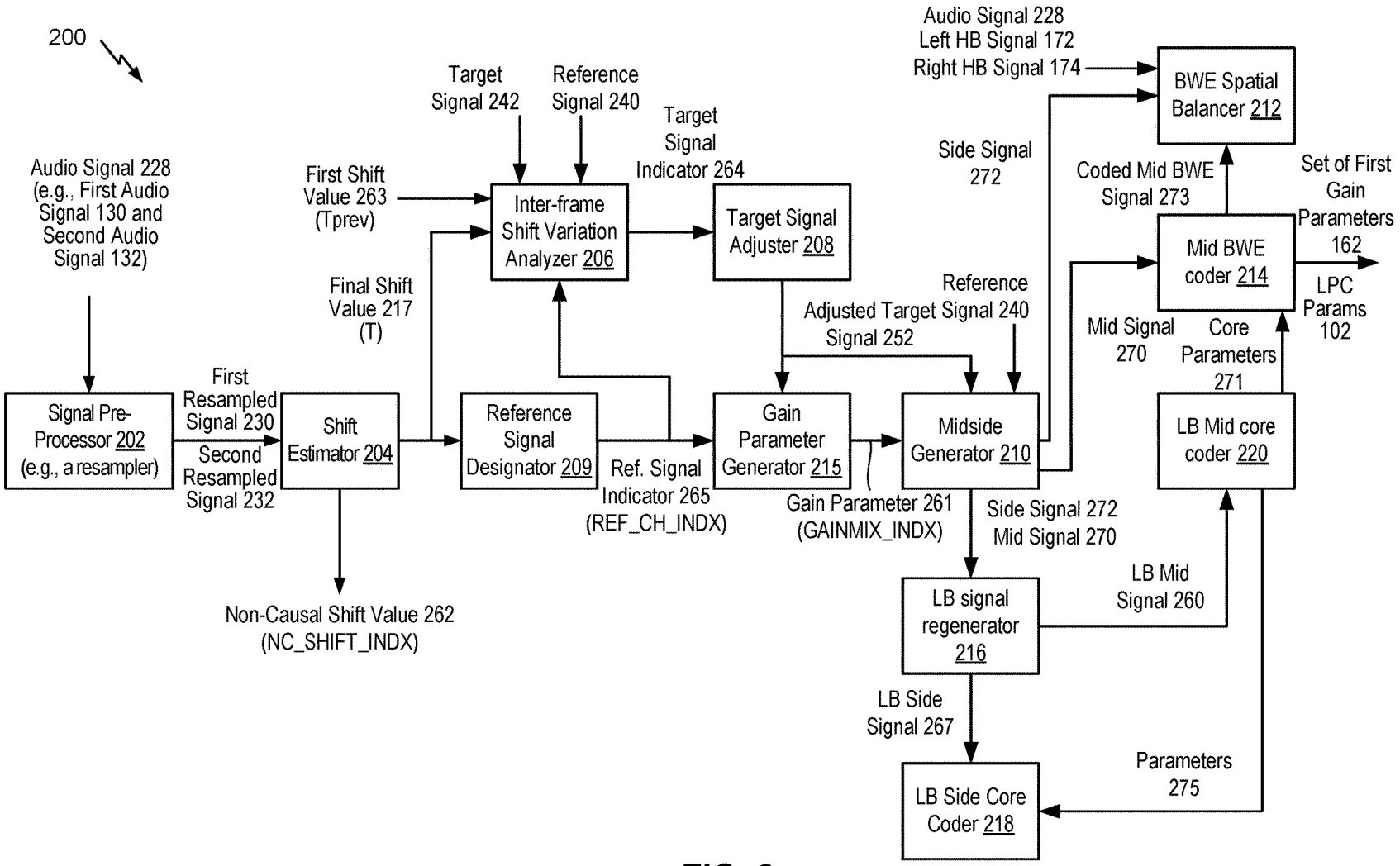
FIG. 2 is a diagram illustrating another example of a device of FIG. 1.

Referring to FIG. 2, an illustrative example of a device is shown and generally designated 200. One or more components of the device 200 may be included in the encoder 114, the first device 104, the system 100, or a combination thereof.

The device 200 includes a signal pre-processor 202 coupled, via a shift estimator 204 (e.g., a temporal mismatch value estimator), to an inter-frame shift variation analyzer 206, to a reference signal designator 209, or both. The inter-frame shift variation analyzer 206 may be coupled, via a target signal adjuster 208, to a gain parameter generator 215. The reference signal designator 209 may be coupled to the inter-frame shift variation analyzer 206, to the gain parameter generator 215, or both. The target signal adjuster 208 may be coupled to a midside generator 210. The gain parameter generator 215 may be coupled to the midside generator 210. The midside generator 210 may be coupled to a bandwidth extension (BWE) spatial balancer 212, a mid BWE coder 214, a low-band signal regenerator 216, or a combination thereof. The LB signal regenerator 216 may be coupled to a LB side core coder 218, a LB mid core coder 220, or both. The LB mid core coder 220 may be coupled to the mid BWE coder 214, the LB side core coder 218, or both. The mid BWE coder 214 may be coupled to the BWE spatial balancer 212. The LB mid core coder 220 may also be coupled to the BWE spatial balancer 212. For example, as described with reference to FIG. 23, the BWE spatial balancer 212 may synthesize a target HB signal based on one or more parameters (e.g., a LB excitation parameter, a voicing parameter, a pitch parameter, an interchannel gain parameter, etc.) from the LB mid core coder 220.

During operation, the signal pre-processor 202 may receive an audio signal 228. For example, the signal pre-processor 202 may receive the audio signal 228 from the input interface(s) 112. The audio signal 228 (e.g., a stereo signal) may include the first audio signal 130, the second audio signal 132, or both. The signal pre-processor 202 may generate a first resampled signal 230, a second resampled signal 232, or both. For example, the signal pre-processor 202 may generate the first resampled signal 230 by resampling the first audio signal 130, the second resampled signal 232 by resampling the second audio signal 132, or both. The signal pre-processor 202 may provide the first resampled signal 230, the second resampled signal 232, or both, to the shift estimator 204.

The shift estimator 204 may generate a temporal mismatch value (e.g., a final shift value 217 (T), a non-causal shift value 262, or both) based on the first resampled signal 230, the second resampled signal 232, or both. For example, the shift estimator 204 may determine the final shift value 217 (T) based on a comparison of the first resampled signal 230 and the second resampled signal 232. The non-causal shift value 262 may correspond to an absolute value of the final shift value 217. The shift estimator 204 may provide the final shift value 217 to the inter-frame shift variation analyzer 206, the reference signal designator 209, or both.

The reference signal designator 209 may designate the first audio signal 130 or the second audio signal 132 as a reference signal based on the final shift value 217 (T). For example, the reference signal designator 209 may, in response to determining that the final shift value 217 (T) satisfies (e.g., is greater than or equal to) a first threshold (e.g., 0), generate a reference signal indicator 265 indicating that the first audio signal 130 is designated as a reference signal. A reference signal 240 may correspond to the first audio signal 130 and a target signal 242 may correspond to the second audio signal 132. Alternatively, the reference signal designator 209 may, in response to determining that the final shift value 217 (T) fails to satisfy (e.g., is less than) the first threshold (e.g., 0), generate the reference signal indicator 265 indicating that the second audio signal 132 is designated as the reference signal. The reference signal 240 may correspond to the second audio signal 132 and the target signal 242 may correspond to the first audio signal 130. The reference signal designator 209 may provide the reference signal indicator 265 to the inter-frame shift variation analyzer 206, to the gain parameter generator 215, or both. The reference signal indicator 265 may be the same as or distinct from the HB reference signal indicator 164.

The inter-frame shift variation analyzer 206 may generate a target signal indicator 264 based on the target signal 242, the reference signal 240, a first shift value 263 (Tprev), the final shift value 217 (T), the reference signal indicator 265, or a combination thereof. For example, the inter-frame shift variation analyzer 206 may generate the target signal indicator 264 to indicate the first audio signal 130 or the second audio signal 132 based on a comparison of the first shift value 263 (Tprev) and the final shift value 217 (T). The first shift value 263 (Tprev) may correspond to a shift value of a previous frame of the first audio signal 130. The inter-frame shift variation analyzer 206 may provide the target signal indicator 264 to the target signal adjuster 208. In some implementations, the inter-frame shift variation analyzer 206 may provide a target signal (e.g., the first audio signal 130 or the second audio signal 132) indicated by the target signal indicator 264 to the target signal adjuster 208 for smoothing and slow-shifting. The target signal 242 may correspond to one of the first audio signal 130 or the second audio signal 132 indicated by the target signal indicator 264. The reference signal 240 may correspond to the other of the first audio signal 130 or the second audio signal 132.

The target signal adjuster 208 may generate an adjusted target signal 252 based on the target signal indicator 264, the target signal 242, or both. The target signal adjuster 208 may adjust the target signal 242 based on a temporal shift evolution from the first shift value 263 (Tprev) to the final shift value 217 (T). For example, the first shift value 263 may include a final shift value corresponding to a first frame of the first audio signal 130. The target signal adjuster 208 may, in response to determining that a final shift value changed from the first shift value 263 having a first value (e.g., Tprev=2) corresponding to the first frame that is lower than the final shift value 217 (e.g., T=4) corresponding to a second frame, interpolate the target signal 242 such that a subset of samples of the target signal 242 that correspond to frame boundaries are dropped through smoothing and slow-shifting to generate the adjusted target signal 252. Alternatively, the target signal adjuster 208 may, in response to determining that a final shift value changed from the first shift value 263 (e.g., Tprev=4) that is greater than the final shift value 217 (e.g., T=2), interpolate the target signal 242 such that a subset of samples of the target signal 242 that correspond to frame boundaries are repeated through smoothing and slow-shifting to generate the adjusted target signal 252. The smoothing and slow-shifting may be performed based on hybrid Sinc- and Lagrange-interpolators. The target signal adjuster 208 may, in response to determining that a final shift value is unchanged from the first shift value 263 to the final shift value 217 (e.g., Tprev=T), temporally offset the target signal 242 to generate the adjusted target signal 252. The target signal adjuster 208 may provide the adjusted target signal 252 to the gain parameter generator 215, the midside generator 210, or both.

The gain parameter generator 215 may generate a gain parameter 261 based on the reference signal indicator 265, the adjusted target signal 252, the reference signal 240, or a combination thereof. The gain parameter 261 (e.g., $g_D$) may correspond to a relative gain parameter for downmix processing, as described with reference to FIG. 1. The gain parameter generator 215 may provide the gain parameter 261 to the midside generator 210.

The midside generator 210 may generate a mid signal 270, a side signal 272, or both, based on the adjusted target signal 252, the reference signal 240, the gain parameter 261, or a combination thereof. For example, the midside generator 210 may generate the mid signal 270 based on Equation 6a or Equation 6b, where M corresponds to the mid signal 270, $g_D$ corresponds to the gain parameter 261, Ref(n) corresponds to samples of the reference signal 240, and Targ(n+$N_1$) corresponds to samples of the adjusted target signal 252. The midside generator 210 may generate the side signal 272 based on Equation 7a or Equation 7b, where S corresponds to the side signal 272, $g_D$ corresponds to the gain parameter 261, Ref(n) corresponds to samples of the reference signal 240, and Targ(n+$N_1$) corresponds to samples of the adjusted target signal 252.

The midside generator 210 may provide the side signal 272 to the BWE spatial balancer 212, the LB signal regenerator 216, or both. The midside generator 210 may provide the mid signal 270 to the mid BWE coder 214, the LB signal regenerator 216, or both. The LB signal regenerator 216 may generate a LB mid signal 260 based on the mid signal 270.

For example, the LB signal regenerator 216 may generate the LB mid signal 260 by filtering the mid signal 270. The LB signal regenerator 216 may provide the LB mid signal 260 to the LB mid core coder 220. The LB mid core coder 220 may generate parameters (e.g., core parameters 271, parameters 275, or both) based on the LB mid signal 260. The core parameters 271, the parameters 275, or both, may include an excitation parameter, a voicing parameter, a pitch parameter, an interchannel gain parameter, etc. The LB mid core coder 220 may provide the core parameters 271 to the mid BWE coder 214, the parameters 275 to the LB side core coder 218, or both. The core parameters 271 may be the same as or distinct from the parameters 275. For example, the core parameters 271 may include one or more of the parameters 275, may exclude one or more of the parameters 275, may include one or more additional parameters, or a combination thereof.

The mid BWE coder 214 may generate a coded mid BWE signal 273, the set of first gain parameters 162, the LPC parameters 102, or a combination thereof, based on the mid signal 270, the core parameters 271, or a combination thereof, as further described with reference to FIG. 3. The mid BWE coder 214 may provide the coded mid BWE signal 273 (e.g., the mid signal 270, a synthesized mid signal, an unscaled synthesized mid BWE signal, a non-linear extended harmonic mid BWE excitation signal, or a combination thereof) to the BWE spatial balancer 212. The mid BWE coder 214 may provide the set of first gain parameters 162, the LPC parameters 102, or both, to the transmitter 110 of FIG. 1.

Figure 6:
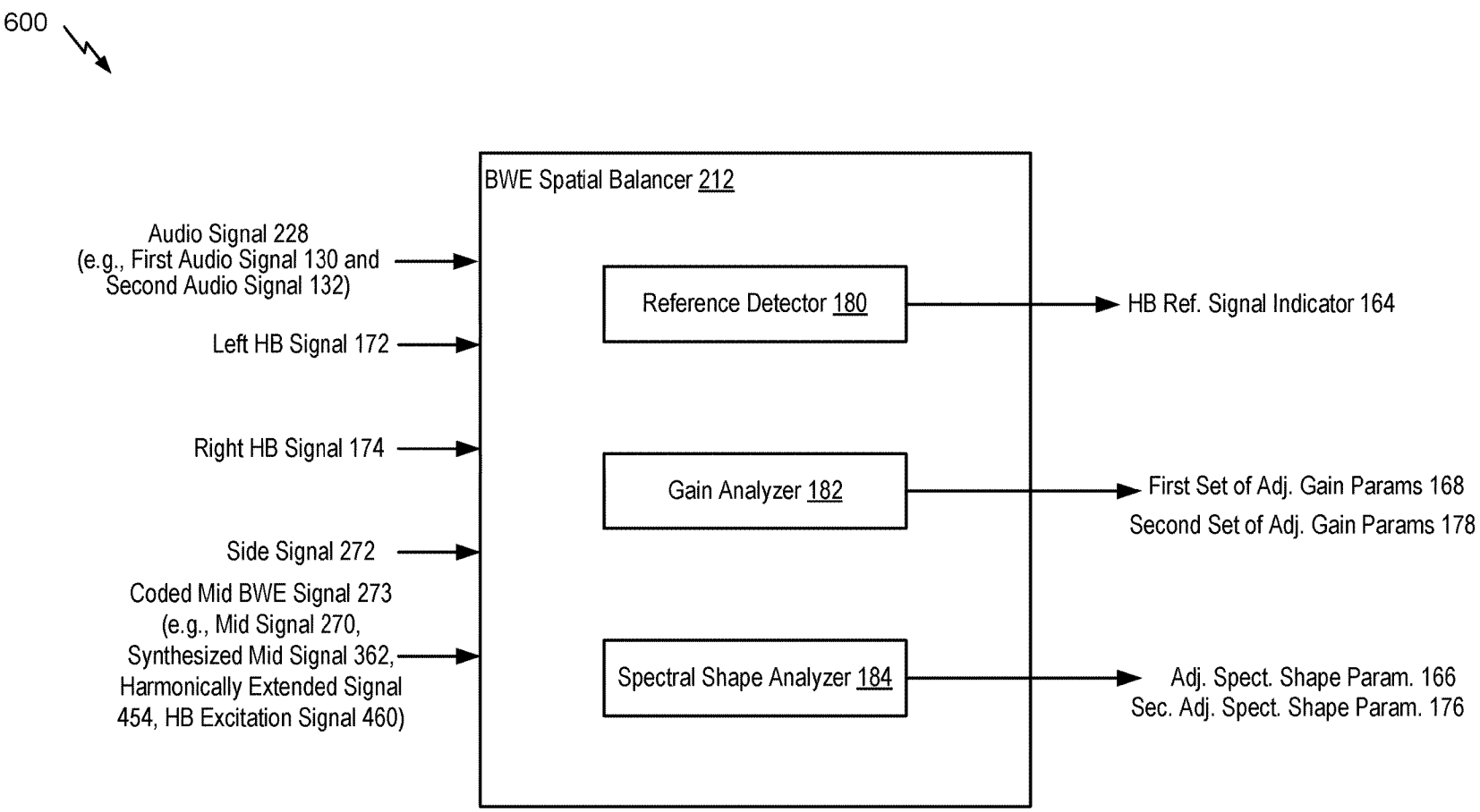
FIG. 6 is a diagram illustrating another example of a device of FIG. 1.

The BWE spatial balancer 212 may generate the HB reference signal indicator 164, the first set of adjustment gain parameters 168, the second set of adjustment gain parameters 178, the adjustment spectral shape parameter 166, the second adjustment spectral shape parameter 176 of FIG. 1, or a combination thereof, based on the left HB signal 172, the right HB signal 174, the coded mid BWE signal 273, the audio signal 228, or a combination thereof, as further described with reference to FIG. 6. The BWE spatial balancer 212 may provide the HB reference signal indicator 164, the first set of adjustment gain parameters 168, the second set of adjustment gain parameters 178, the adjustment spectral shape parameter 166, the second adjustment spectral shape parameter 176, or a combination thereof, to the transmitter 110 of FIG. 1.

The LB signal regenerator 216 may generate a LB side signal 267 based on the side signal 272. For example, the LB signal regenerator 216 may generate the LB side signal 267 by filtering the side signal 272. The LB signal regenerator 216 may provide the LB side signal 267 to the LB side core coder 218.

Figure 3:
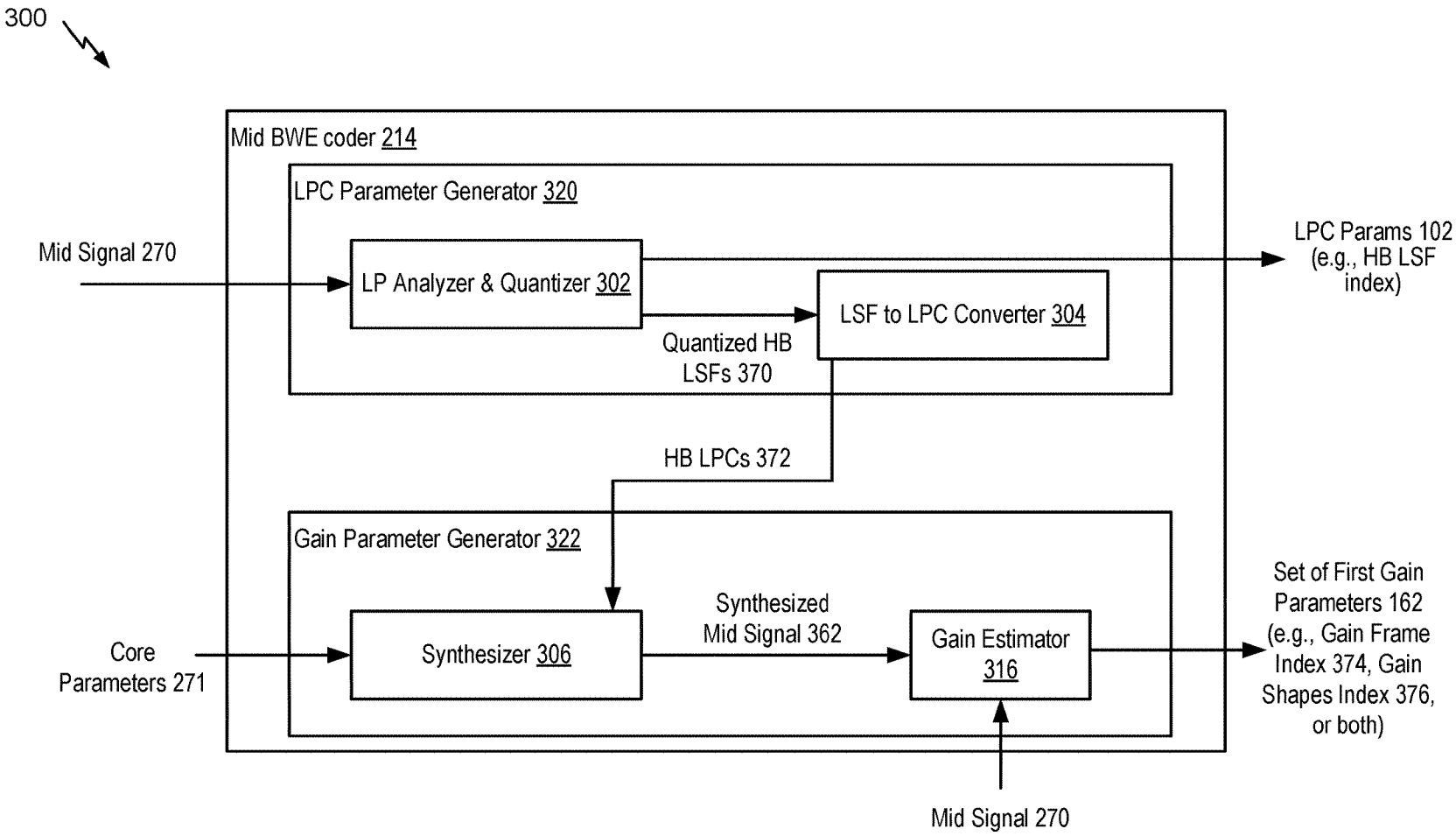
FIG. 3 is a diagram illustrating another example of a device of FIG. 1.

Referring to FIG. 3, an illustrative example of a device is shown and generally designated 300. One or more components of the device 300 may be included in the encoder 114, the first device 104, the system 100, or a combination thereof.

The device 300 includes the mid BWE coder 214. The mid BWE coder 214 may include an LPC parameter generator 320, a gain parameter generator 322, or both. The LPC parameter generator 320 may be configured to generate the LPC parameters 102. The LPC parameter generator 320 may include an LP analyzer and quantizer 302, a LSF to LPC converter 304, or both. The gain parameter generator 322 may be configured to generate the set of first gain parameters 162. The gain parameter generator 322 may include a synthesizer 306, a gain estimator 316, or both.

During operation, the LP analyzer and quantizer 302 may receive the mid signal 270 from the midside generator 210 of FIG. 2. The LP analyzer and quantizer 302 may generate quantized HB LSFs 370 based on the mid signal 270 (e.g., a high-band portion of the mid signal 270). The quantized HB LSFs 370 may represent a spectral envelope of the mid signal 270 (e.g., the high-band portion of the mid signal 270). The LP analyzer and quantizer 302 may generate the LPC parameters 102 (e.g., a HB LSF index) corresponding to the quantized HB LSFs 370 based on a codebook. The LP analyzer and quantizer 302 may provide the LPC parameters 102 to the transmitter 110 of FIG. 1.

The LP analyzer and quantizer 302 may provide the quantized HB LSFs 370 to the LSF to LPC converter 304. The LSF to LPC converter 304 may generate HB LPCs 372 based on the quantized HB LSFs 370. The LSF to LPC converter 304 may provide the HB LPCs 372 to the synthesizer 306. The synthesizer 306 may also receive the core parameters 271 from the LB mid core coder 220. The synthesizer 306 may correspond to a local decoder at the first device 104 of FIG. 1. The synthesizer 306 may simulate a decoder at a receiving device (e.g., the second device 106 of FIG. 1). The synthesizer 306 may generate the synthesized mid signal 362 based on the HB LPCs 372 and the core parameters 271, as further described with reference to FIG. 4.

The synthesizer 306 may provide the synthesized mid signal 362 to the gain estimator 316. The gain estimator 316 may also receive the mid signal 270 (e.g., the high-band portion of the mid signal 270). The gain estimator 316 may generate the set of first gain parameters 162 based on a comparison of the synthesized mid signal 362 and the mid signal 270 (e.g., the high-band portion of the mid signal 270), as further described with reference to FIG. 5. The set of first gain parameters 162 may indicate a gain difference between the high-band portion of the mid signal 270 and the synthesized mid signal 362. The set of first gain parameters 162 may include a gain shapes index 376, a gain frame index 374, or both. The gain estimator 316 may provide the set of first gain parameters 162 to the transmitter 110 of FIG. 1.

Figure 4:
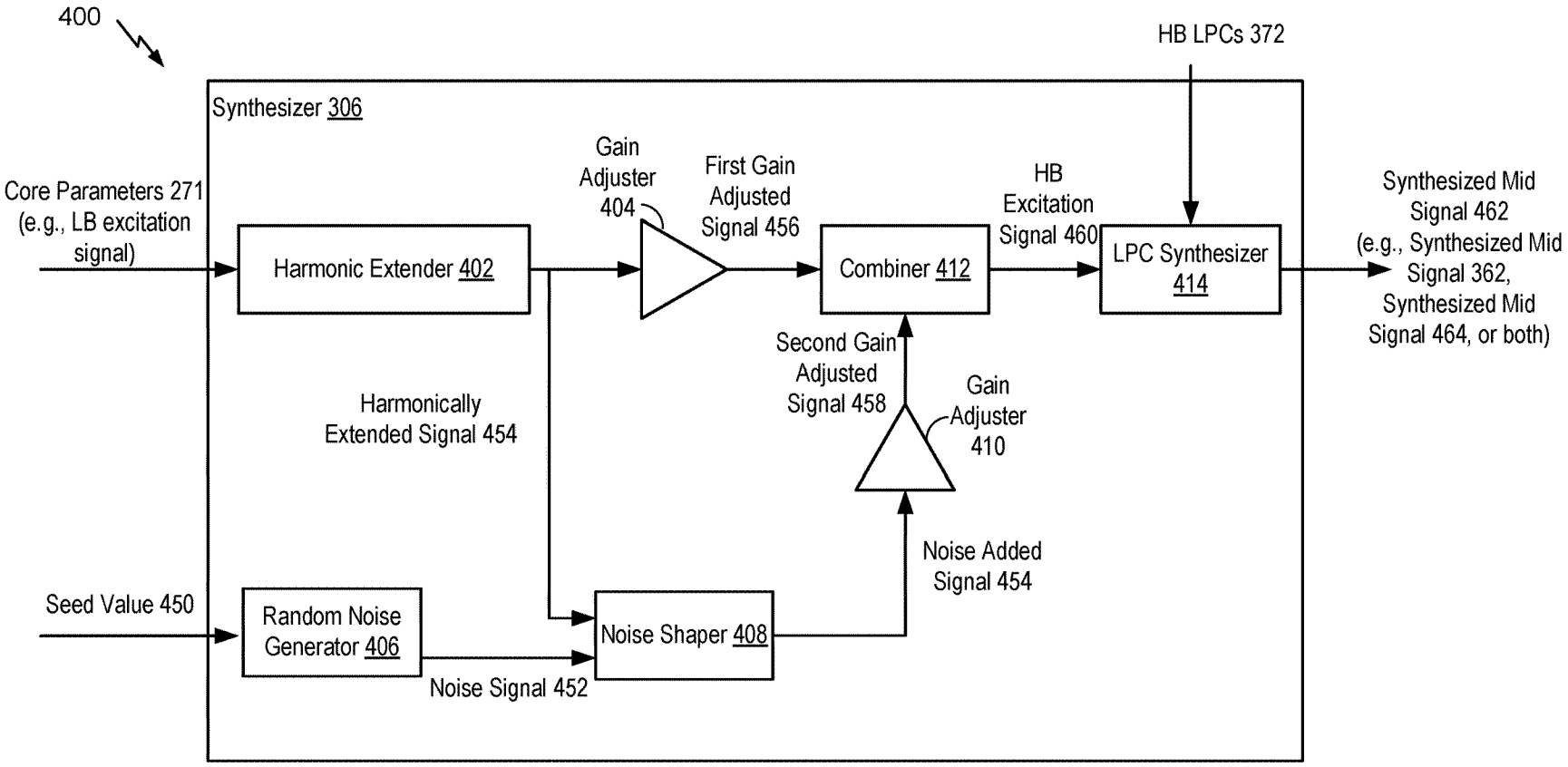
FIG. 4 is a diagram illustrating another example of a device of FIG. 1.

Referring to FIG. 4, an illustrative example of a device is shown and generally designated 400. One or more components of the device 400 may be included in the encoder 114, the first device 104, the system 100, or a combination thereof.

The device 400 include the synthesizer 306. The synthesizer 306 may include a harmonic extender 402 coupled, via a gain adjuster 404, to a combiner 412. The harmonic extender 402 may be coupled, via a noise shaper 408 and a gain adjuster 410, to the combiner 412. The synthesizer 306 may include a random noise generator 406 coupled to the noise shaper 408. The combiner 412 may be coupled to a LPC synthesizer 414.

During operation, the synthesizer 306 may estimate a HB excitation signal 460 (e.g., a non-linear harmonic HB excitation signal) based on a LB excitation signal and may generate the synthesized mid signal 362 based on the HB excitation signal 460 and the HB LPCs 372, as described herein. The harmonic extender 402 may receive the core parameters 271 from the LB mid core coder 220. The core parameters 271 may correspond to the LB excitation signal. The harmonic extender 402 may generate a harmonically extended signal 454 based on the core parameters 271 by harmonically extending the LB excitation signal. The harmonic extender 402 may provide the harmonically extended signal 454 to the gain adjuster 404 and to the noise shaper 408.

The gain adjuster 404 may generate a first gain adjusted signal 456 by applying a first gain to the harmonically extended signal 454. The gain adjuster 404 may provide the first gain adjusted signal 456 to the combiner 412. The random noise generator 406 may generate a noise signal 452 based on a seed value 450. The seed value 450 may be stored in the memory 153 of FIG. 1. The encoder 114 of FIG. 1 may update the seed value 450 subsequent to an access of the seed value 450. The random noise generator 406 may provide the noise signal 452 to the noise shaper 408. The noise shaper 408 may generate a noise added signal 454 by combining the harmonically extended signal 454 and the noise signal 452. The noise shaper 408 may provide the noise added signal 454 to the gain adjuster 410. The gain adjuster 410 may generate a second gain adjusted signal 458 by applying a second gain to the noise added signal 454. The gain adjuster 410 may provide the second gain adjusted signal 458 to the combiner 412. The combiner 412 may generate the HB excitation signal 460 by combining the first gain adjusted signal 456 (e.g., a high-band portion of the first gain adjusted signal 456) and the second gain adjusted signal 458 (e.g., a high-band portion of the second gain adjusted signal 458). The combiner 412 may provide the HB excitation signal 460 to the LPC synthesizer 414.

The LPC synthesizer 414 may generate a synthesized mid signal 462 (e.g., a synthesized high-band mid signal) based on the HB LPCs 372 and the HB excitation signal 460. For example, the LPC synthesizer 414 may generate the synthesized mid signal 462 by configuring a synthesis filter based on the HB LPCs 372 and providing the HB excitation signal 460 as an input to the synthesis filter. In a particular aspect, the synthesized mid signal 462 may correspond to the synthesized mid signal 362 (e.g., the coded mid BWE signal 273). In this aspect, the LPC synthesizer 414 may provide the synthesized mid signal 362 to the gain estimator 316 of FIG. 3 and to a spectral shape adjuster of FIG. 17.

In a particular aspect, the synthesizer 306 may generate multiple synthesized mid signals corresponding to distinct gains. For example, the synthesizer 306 may generate the synthesized mid signal 362 and a synthesized mid signal 464. Generating the synthesized mid signal 362 may include the gain adjuster 404 applying a first gain to the harmonically extended signal 454 to generate the first gain adjusted signal 456 and the gain adjuster 410 applying a second gain to the noise added signal 454 to generate the second gain adjusted signal 458. Generating the synthesized mid signal 464 may include the gain adjuster 404 applying a third gain to the harmonically extended signal 454 to generate the first gain adjusted signal 456 and the gain adjuster 410 applying a fourth gain to the noise added signal 454 to generate the second gain adjusted signal 458. The first gain may be the same as or distinct from the third gain. The second gain may be the same as or distinct from the fourth gain. In a particular aspect, a first weighting of a noise component to a harmonic component of the synthesized mid signal 362 may be distinct of a noise component to a harmonic component of the synthesized mid signal 464. The first weighting may be based on the first gain and the second gain. The second weighting may be based on the third gain and the fourth gain. The LPC synthesizer 414 may provide the synthesized mid signal 362 to the gain estimator 316 of FIG. 3 and may provide the synthesized mid signal 464 to the spectral shape adjuster of FIG. 17.

Figure 5:
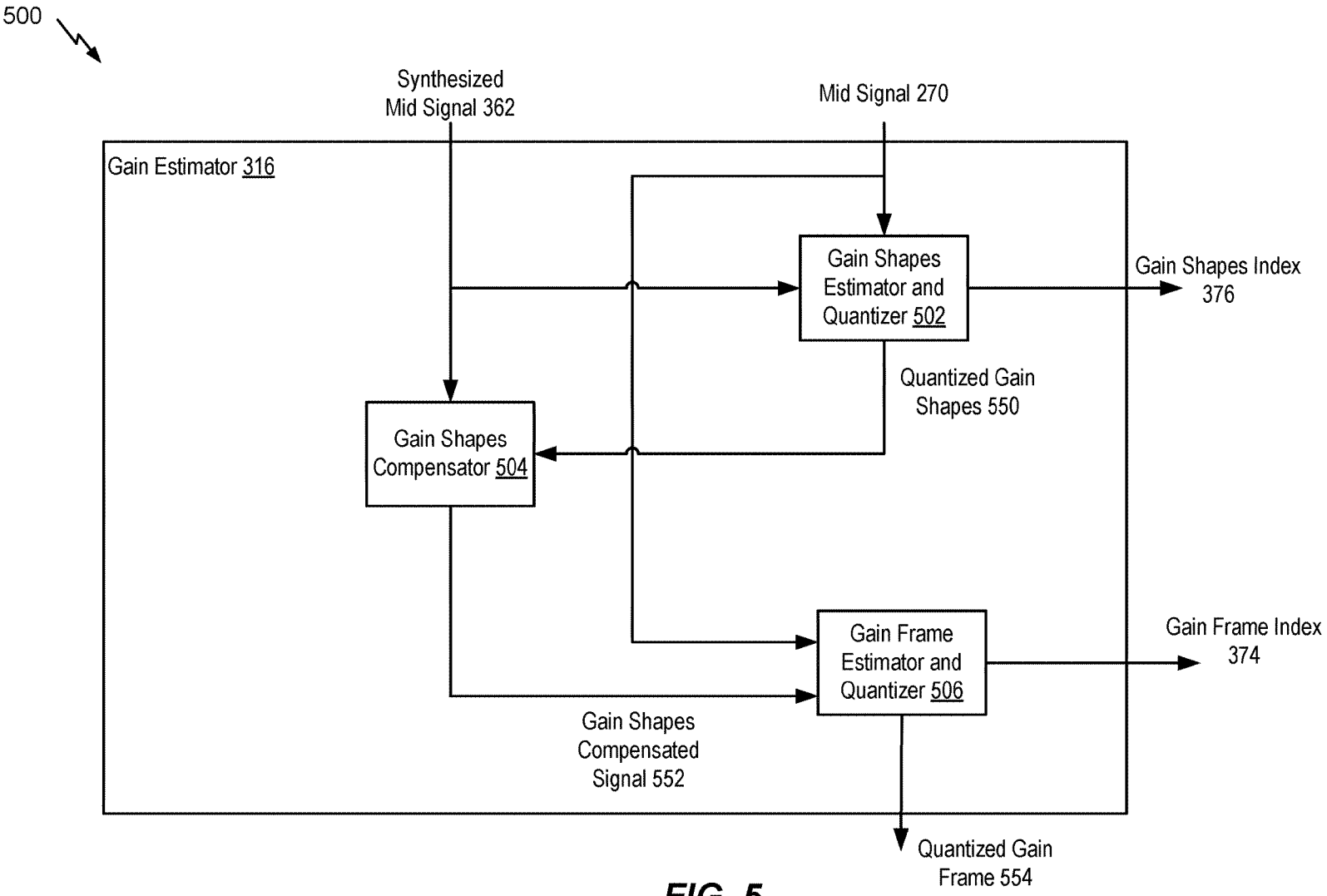
FIG. 5 is a diagram illustrating another example of a device of FIG. 1.

Referring to FIG. 5, an illustrative example of a device is shown and generally designated 500. One or more components of the device 500 may be included in the encoder 114, the first device 104, the system 100, or a combination thereof.

The device 500 includes the gain estimator 316. The gain estimator 316 may be configured to generate the gain shapes index 376, the gain frame index 374, or both, based on a comparison of the mid signal 270 (e.g., a high-band portion of the mid signal 270) and the synthesized mid signal 362 (e.g., a synthesized high-band mid signal). The gain estimator 316 may include a gain shapes estimator and quantizer 502, a gain shapes compensator 504, a gain frame estimator and quantizer 506, or a combination thereof.

During operation, the gain shapes estimator and quantizer 502 may receive the synthesized mid signal 362 from the synthesizer 306 of FIG. 3, the mid signal 270 from the midside generator 210, or both. The gain shapes estimator and quantizer 502 may determine quantized gain shapes 550 based on a comparison of the mid signal 270 (e.g., the high-band portion of the mid signal 270) and the synthesized mid signal 362 (e.g., a synthesized high-band mid signal). The quantized gain shapes 550 may correspond to a difference in gain shapes between the mid signal 270 (e.g., the high-band portion of the mid signal 270) and the synthesized mid signal 362 (e.g., the synthesized high-band mid signal). The gain shapes estimator and quantizer 502 may determine the gain shapes index 376 corresponding to the quantized gain shapes 550 based on a codebook. The gain shapes estimator and quantizer 502 may provide the gain shapes index 376 to the transmitter 110 of FIG. 1.

The gain shapes estimator and quantizer 502 may provide the quantized gain shapes 550 to the gain shapes compensator 504. The gain shapes compensator 504 may also receive the synthesized mid signal 362 from the synthesizer 306 of FIG. 3. The gain shapes compensator 504 may generate a gain shapes compensated signal 552 based on the synthesized mid signal 362 and the quantized gain shapes 550. For example, the gain shapes compensator 504 may generate the gain shapes compensated signal 552 by adjusting the synthesized mid signal 362 based on the quantized gain shapes 550.

The gain shapes compensator 504 may provide the gain shapes compensated signal 552 to the gain frame estimator and quantizer 506. The gain frame estimator and quantizer 506 may also receive the mid signal 270 from the midside generator 210 of FIG. 2. The gain frame estimator and quantizer 506 may generate a quantized gain frame 554 based on a comparison of the gain shapes compensated signal 552 and the mid signal 270 (e.g., a high-band portion of the mid signal 270). The gain frame estimator and quantizer 506 may generate a gain frame index 374 corresponding to the quantized gain frame 554 based on a codebook. The gain frame estimator and quantizer 506 may provide the gain frame index 374 to the transmitter 110 of FIG. 1.

Referring to FIG. 6, an illustrative example of a device is shown and generally designated 600. One or more components of the device 600 may be included in the encoder 114, the first device 104, the system 100, or a combination thereof.

The device 600 includes the BWE spatial balancer 212. The BWE spatial balancer 212 may include the reference detector 180, the gain analyzer 182, the spectral shape analyzer 184, or a combination thereof. The BWE spatial balancer 212 may be configured to receive the left HB signal 172, the right HB signal 174, the audio signal 228, the side signal 272, the coded mid BWE signal 273, or a combination thereof. The coded mid BWE signal 273 may include the mid signal 270, the synthesized mid signal 362, the harmonically extended signal 454, or the HB excitation signal 460.

The reference detector 180 may be configured to generate the HB reference signal indicator 164, as further described with reference to FIGS. 7-8. The reference detector 180 may provide the HB reference signal indicator 164 to the transmitter 110 of FIG. 1. The gain analyzer 182 may be configured to generate the first set of adjustment gain parameters 168, the second set of adjustment gain parameters 178, or both, as further described with reference to FIGS. 9-14. The gain analyzer 182 may provide the first set of adjustment gain parameters 168, the second set of adjustment gain parameters 178, or both, to the transmitter 110 of FIG. 1. The spectral shape analyzer 184 may be configured to generate the adjustment spectral shape parameter 166, the second adjustment spectral shape parameter 176, or both, as further described with reference to FIGS. 18-21. The spectral shape analyzer 184 may provide the adjustment spectral shape parameter 166, the second adjustment spectral shape parameter 176, or both, to the transmitter 110 of FIG. 1.

Figure 7A:
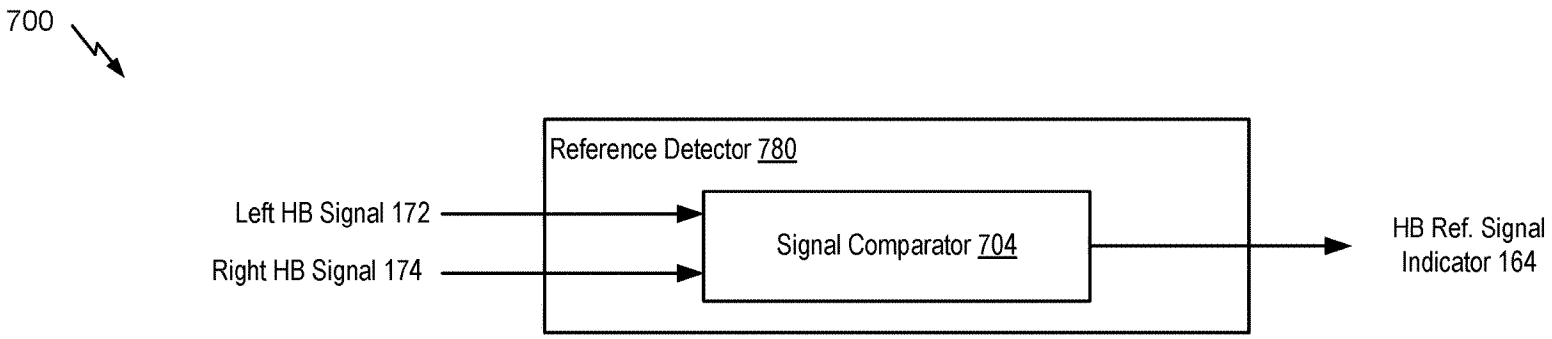
FIG. 7A is a diagram illustrating another example of a device of FIG. 1.

Referring to FIG. 7A, an illustrative example of a device is shown and generally designated 700. One or more components of the device 700 may be included in the encoder 114, the first device 104, the system 100, or a combination thereof.

The device 700 includes a reference detector 780. The reference detector 780 may correspond to the reference detector 180 of FIG. 1. The reference detector 780 includes a signal comparator 704. The signal comparator 704 may be configured to generate the HB reference signal indicator 164 based on a comparison of the left HB signal 172 and the right HB signal 174. For example, the signal comparator 704 may determine a left energy of the left HB signal 172 and a right energy of the right HB signal 174. The signal comparator 704 may designate the left HB signal 172 as a reference signal and the right HB signal 174 as a non-reference signal in response to determining that the left energy is greater than or equal to the right energy. The signal comparator 704 may determine that the left energy is greater than or equal to the right energy in response to determining that an energy difference between the left energy and the right energy satisfies a first threshold (e.g., left energy−right energy≥0) or that an energy ratio of the left energy and the right energy satisfies a second threshold (e.g., left energy/right energy≥1).

Alternatively, the signal comparator 704 may designate the right HB signal 174 as the reference signal and the left HB signal 172 as the non-reference signal in response to determining that the left energy is less than the right energy. The signal comparator 704 may determine that the left energy is less than the right energy in response to determining that the energy difference fails to satisfy the first threshold (e.g., left energy−right energy<0) or that the energy ratio fails to satisfy the second threshold (e.g., left energy/right energy<1). In some implementations, a hysteresis/smoothing logic may be implemented in addition to the energy-based comparator to avoid frequent reference channel switching.

Figure 7B:
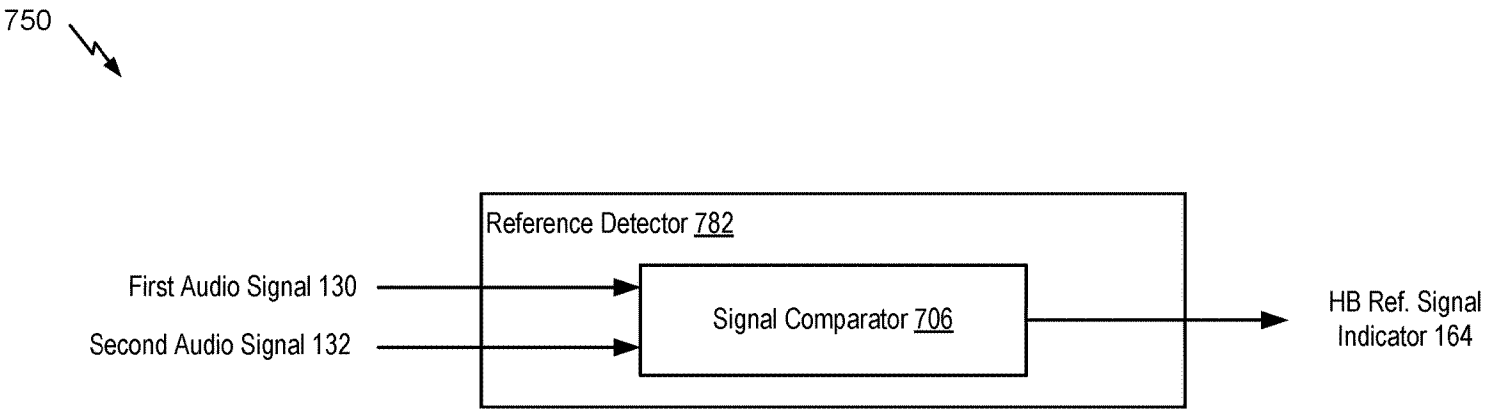
FIG. 7B is a diagram illustrating another example of a device of FIG. 1.

Referring to FIG. 7B, an illustrative example of a device is shown and generally designated 750. One or more components of the device 750 may be included in the encoder 114, the first device 104, the system 100, or a combination thereof.

The device 750 includes a reference detector 782. The reference detector 782 may correspond to the reference detector 180 of FIG. 1. The reference detector 782 includes a signal comparator 706. The signal comparator 706 may be configured to generate the HB reference signal indicator 164 based on a comparison of the first audio signal 130 (e.g., the left signal) and the second audio signal 132 (e.g., the right signal). For example, the signal comparator 706 may determine a first energy (e.g., a left full-band energy) of the first audio signal 130 and a second energy (e.g., a right full-band energy) of the second audio signal 132. The signal comparator 706 may designate the left HB signal 172 as a reference signal and the right HB signal 174 as a non-reference signal in response to determining that the first energy is greater than or equal to the second energy. The signal comparator 706 may determine that the first energy is greater than or equal to the second energy in response to determining that an energy difference between the first energy and the second energy satisfies a first threshold (e.g., first energy−second energy≥0) or that an energy ratio of the first energy and the second energy satisfies a second threshold (e.g., first energy/second energy≥1).

Alternatively, the signal comparator 706 may designate the right HB signal 174 as the reference signal and the left HB signal 172 as the non-reference signal in response to determining that the first energy is less than the second energy. The signal comparator 706 may determine that the first energy is less than the second energy in response to determining that the energy difference fails to satisfy the first threshold (e.g., first energy−second energy<0) or that the energy ratio fails to satisfy the second threshold (e.g., first energy/second energy<1). In some implementations, a hysteresis/smoothing logic may be implemented in addition to the energy-based comparator to avoid frequent reference channel switching.

In an alternative implementation, the reference detector 180 may generate the HB reference signal indicator 164 based on an inter-channel shift value (e.g., the final shift value 217 of FIG. 2). For example, the reference detector 180 may, in response to determining that the final shift value 217 is greater than or equal to a threshold (e.g., 0), designate the left HB signal 172 as a reference signal and designate the right HB signal 174 as a non-reference signal. As another example, the reference detector 180 may, in response to determining that the final shift value 217 is less than a threshold (e.g., 0), designate the right HB signal 174 as a reference signal and designate the left HB signal 172 as a non-reference signal.

In a particular aspect, the reference detector 180 designates the right HB signal 174 as a reference signal in response to determining that the final shift value 217 has a particular value (e.g., less than 0) indicating that a right audio signal (e.g., the second audio signal 132) is leading the left audio signal (e.g., the first audio signal 130). Alternatively, the reference detector 180 designates the left HB signal 172 as a reference signal in response to determining that the final shift value 217 has a particular value (e.g., greater than or equal to 0) indicating that a left audio signal (e.g., the first audio signal 130) is leading a right audio signal (e.g., the second audio signal 132).

In a particular implementation, the reference detector 180 may generate the HB reference signal indicator 164 based on the reference signal 240. For example, as described with reference to FIG. 2, the reference signal designator 209 may generate, based on the final shift value 217, the reference signal indicator 265 indicating that one (e.g., the reference signal 240) of the first audio signal 130 or the second audio signal 132 is designated as a reference signal. The reference detector 180 may, in response to determining that the reference signal 240 corresponds to the first audio signal 130, generate the HB reference signal indicator 164 to indicate that the left HB signal 172 is designated as a reference signal and that the right HB signal 174 is designated as a non-reference signal. Alternatively, the reference detector 180 may, in response to determining that the reference signal 240 corresponds to the second audio signal 132, generate the HB reference signal indicator 164 to indicate that the right HB signal 174 is designated as a reference signal and that the left HB signal 172 is designated as a non-reference signal.

In a particular implementation, the reference detector 180 may determine the HB reference signal indicator 164 in multiple stages, each stage refining the output of the previous stage. Each of the stages may correspond to a particular implementation described herein. As an illustrative example, at a first stage, the reference detector 180 may generate the HB reference signal indicator 164 based on the reference signal 240. For example, the reference detector 180 may generate the HB reference signal indicator 164 to indicate that the right HB signal 174 is designated as a high-band reference signal in response to determining that the reference signal 240 indicates that the second audio signal 132 (e.g., a right audio signal) is designated as a reference signal. Alternatively, the reference detector 180 may generate the HB reference signal indicator 164 to indicate that the left HB signal 172 is designated as a high-band reference signal in response to determining that the reference signal 240 indicates that the first audio signal 130 (e.g., a left audio signal) is designated as a reference signal.

At a second stage, the reference detector 180 may refine (e.g., update) the HB reference signal indicator 164 based on the gain parameter 261, the first energy, the second energy, or a combination thereof. For example, the reference detector 180 may set (e.g., update) the HB reference signal indicator 164 to indicate that the left HB signal 172 is designated as a reference channel and that the right HB signal 174 is designated as a non-reference channel in response to determining that the gain parameter 261 satisfies a first threshold, that a ratio of the first energy (e.g., the left full-band energy) and the right energy (e.g., the right full-band energy) satisfies a second threshold, or both. As another example, the reference detector 180 may set (e.g., update) the HB reference signal indicator 164 to indicate that the right HB signal 174 is designated as a reference channel and that the left HB signal 172 is designated as a non-reference channel in response to determining that the gain parameter 261 fails to satisfy the first threshold, that the ratio of the first energy (e.g., the left full-band energy) and the right energy (e.g., the right full-band energy) fails to satisfy the second threshold, or both.

At a third stage, the reference detector 180 may refine (e.g., further update) the HB reference signal indicator 164 based on the left energy and the right energy. For example, the reference detector 180 may set (e.g., update) the HB reference signal indicator 164 to indicate that the left HB signal 172 is designated as a reference channel and that the right HB signal 174 is designated as a non-reference channel in response to determining that a ratio of the left energy (e.g., the left HB energy) and the right energy (e.g., the right HB energy) satisfies a threshold. As another example, the reference detector 180 may set (e.g., update) the HB reference signal indicator 164 to indicate that the right HB signal 174 is designated as a reference channel and that the left HB signal 172 is designated as a non-reference channel in response to determining that a ratio of the left energy (e.g., the left HB energy) and the right energy (e.g., the right HB energy) fails to satisfy a threshold.

In a particular aspect, during a first stage, the reference detector 180 may generate the HB reference signal indicator 164 based on the reference signal 240. For example, subsequent to the first stage, the HB reference signal indicator 164 may indicate that the left HB signal 172 is designated as a high-band reference signal. The reference detector 180 may determine a left low-band energy of a low-band portion of the left audio signal (e.g., the first audio signal 130), a right low-band energy of a low-band portion of the right audio signal (e.g., the second audio signal 132), or both.

During a second stage, the reference detector 180 may determine that the left low-band energy is substantially less than the right low-band energy (e.g., right low-band energy−left low-band energy>threshold). The reference detector 180 may, in response to determining that the HB reference signal indicator 164 indicates that the left HB signal 172 is designated as a reference signal and that the left low-band energy is substantially less than the right low-band energy, update the HB reference signal indicator 164 to indicate that the right HB signal 174 is designated as a reference signal. Alternatively, the reference detector 180 may, in response to determining that the HB reference signal indicator 164 indicates that the right HB signal 174 is designated as a reference signal and that the right low-band energy is substantially less than the left low-band energy, update the HB reference signal indicator 164 to indicate that the left HB signal 172 is designated as a reference signal. The reference detector 180 may determine a left high-band energy of a high-band portion of the left audio signal (e.g., the first audio signal 130), a right high-band energy of a high-band portion of the right audio signal (e.g., the second audio signal 132), or both.

During a third stage, the reference detector 180 may update the HB reference signal indicator 164 based on the HB reference signal indicator 164, the left high-band energy, the right high-band energy, or a combination thereof. For example, the reference detector 180 may, in response to determining that the HB reference signal indicator 164 indicates that the left HB signal 172 is designated as a reference signal and that the left high-band energy is substantially less than the right high-band energy, update the HB reference signal indicator 164 to indicate that the right HB signal 174 is designated as a reference signal. Alternatively, the reference detector 180 may, in response to determining that the HB reference signal indicator 164 indicates that the right HB signal 174 is designated as a reference signal and that the right high-band energy is substantially less than the left high-band energy, update the HB reference signal indicator 164 to indicate that the left HB signal 172 is designated as a reference signal. In some implementations, a hysteresis/smoothing logic may be implemented in addition to the energy-based comparison to avoid frequent reference channel switching.

The signal comparator 704 may generate the HB reference signal indicator 164 to indicate whether the left HB signal 172 or the right HB signal 174 is designated as the reference signal. In a particular aspect, the HB reference signal indicator 164 may indicate the energy difference. A first value (e.g., a non-negative value) of the HB reference signal indicator 164 may indicate that the left HB signal 172 is designated as the reference signal and the right HB signal 174 is designated as the non-reference signal. A second value (e.g., a negative value) of the HB reference signal indicator 164 may indicate that the right HB signal 174 is designated as the reference signal and the left HB signal 172 is designated as the non-reference signal.

In another aspect, the HB reference signal indicator 164 may indicate the energy ratio. A first value (e.g., a value greater than or equal to 1, such as when the energy ratio is in decibels) of the HB reference signal indicator 164 may indicate that the left HB signal 172 is designated as the reference signal and the right HB signal 174 is designated as the non-reference signal. A second value (e.g., a value greater than or equal to 0 and less than 1) of the HB reference signal indicator 164 may indicate that the right HB signal 174 is designated as the reference signal and the left HB signal 172 is designated as the non-reference signal.

In a particular aspect, the HB reference signal indicator 164 may indicate a binary value (e.g., a bit-value). For example, a first value (e.g., "1") of the HB reference signal indicator 164 (e.g., a bit) may indicate that the left HB signal 172 is designated as the reference signal and the right HB signal 174 is designated as the non-reference signal. As another example, a second value (e.g., "0") of the HB reference signal indicator 164 may indicate that the right HB signal 174 is designated as the reference signal and the left HB signal 172 is designated as the non-reference signal. In a particular aspect, the HB reference signal indicator 164 may indicate the binary value (e.g., the first value or the second value) and an absolute value of the energy difference (e.g., |left energy−right energy|). In a particular aspect, the HB reference signal indicator 164 may correspond to a gain parameter (e.g., the first set of adjustment gain parameters 168 or the second set of adjustment gain parameters 178). The signal comparator 704 may provide the HB reference signal indicator 164 to the transmitter 110 of FIG. 1.

Figure 8:
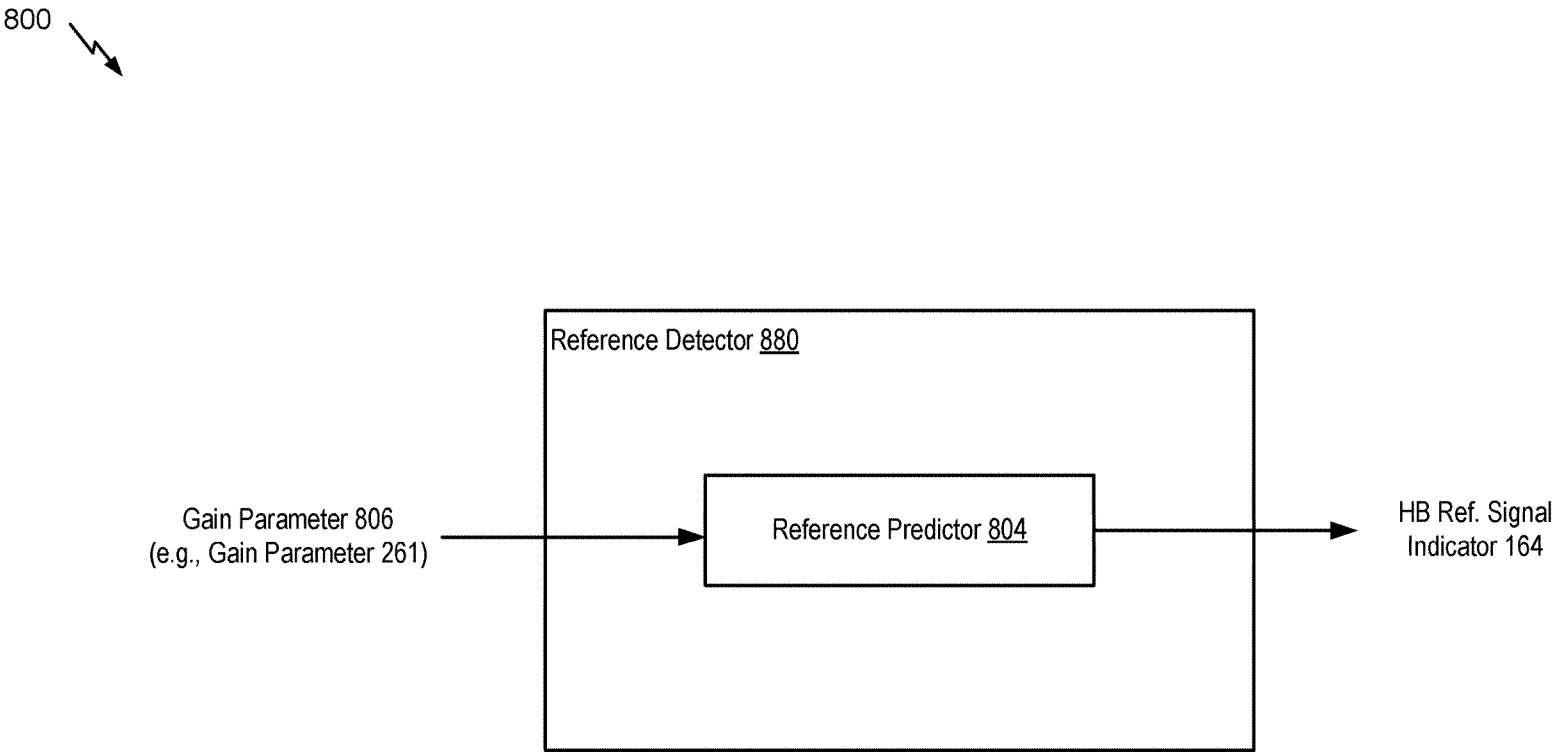
FIG. 8 is a diagram illustrating another example of a device of FIG. 1.

Referring to FIG. 8, an illustrative example of a device is shown and generally designated 800. One or more components of the device 800 may be included in the encoder 114, the first device 104, the system 100, or a combination thereof.

The device 800 includes a reference detector 880. The reference detector 880 may correspond to the reference detector 180 of FIG. 1. The reference detector 880 may include a reference predictor 804. The reference predictor 804 may be configured to generate the HB reference signal indicator 164 based on a gain parameter 806. In a particular aspect, the gain parameter 806 may correspond to the gain parameter 261 (e.g., $g_D$).

In a particular aspect, the gain parameter 806 may indicate a low-band energy difference (or a low-band energy ratio) of a left low-band energy of one or more low-band portions of the left LB signal 171 of FIG. 1 relative to a right low-band energy of one or more corresponding low-band portions of the right LB signal 173 of FIG. 1. For example, the encoder 114 may determine a first left low-band energy of a first left low-band portion of the left LB signal 171. The encoder 114 may determine a first right low-band energy of a first right low-band portion of the right LB signal 173. The first right low-band portion may correspond to the first left low-band portion (e.g., a sub-band of the low-band). The encoder 114 may determine a first low-band energy difference between the first left low-band energy and the first right low-band energy (e.g., the first low-band energy difference=the first left low-band energy−the first right low-band energy). The encoder 114 may determine one or more additional low-band energy differences.

In a particular aspect, the encoder 114 may determine a first low-band energy ratio of the first left low-band energy relative to the first right low-band energy (e.g., the first low-band energy ratio=the first left low-band energy/the first right low-band energy). The encoder 114 may determine one or more additional low-band energy ratios.

The encoder 114 may determine the gain parameter 806 based on the first low-band energy difference, the one or more additional low-band energy differences, the first low-band energy ratio, the one or more additional low-band energy ratios, or a combination thereof. The gain parameter 806 may include the first low-band energy difference, the first low-band energy ratio, an average of the first low-band energy difference and the one or more additional low-band energy differences, or an average of the first low-band energy ratio and the one or more additional low-band energy ratios.

The reference predictor 804 may designate the left HB signal 172 as a reference signal and the right HB signal 174 as a non-reference signal in response to determining that the gain parameter 806 satisfies (e.g., is greater than or equal to) a first threshold (e.g., 0 or 1). The reference predictor 804 may designate the right HB signal 174 as the reference signal and the left HB signal 172 as the non-reference signal in response to determining that the gain parameter 806 fails to satisfy (e.g., is less than) the first threshold (e.g., 0 or 1).

The HB reference signal indicator 164 may indicate whether the left HB signal 172 or the right HB signal 174 is designated as the reference signal. The HB reference signal indicator 164 may indicate the gain parameter 806. For example, a first value (e.g., non-negative or greater than or equal to 1) of the HB reference signal indicator 164 may indicate that the left HB signal 172 is designated as the reference signal and the right HB signal 174 is designated as the non-reference signal. A second value (e.g., negative or less than 1) may indicate that the right HB signal 174 is designated as the reference signal and the left HB signal 172 is designated as the non-reference signal.

In a particular aspect, the HB reference signal indicator 164 may indicate a binary value (e.g., a bit value). For example, a first value (e.g., 1) of the HB reference signal indicator 164 may indicate that the left HB signal 172 is designated as the reference signal and the right HB signal 174 is designated as the non-reference signal. A second value (e.g., 0) of the HB reference signal indicator 164 may indicate that the right HB signal 174 is designated as the reference signal and the left HB signal 172 is designated as the non-reference signal.

In a particular aspect, the HB reference signal indicator 164 may indicate the binary value and an absolute value of the gain parameter 806. The reference predictor 804 may provide the HB reference signal indicator 164 to the transmitter 110 of FIG. 1.

Figure 9:
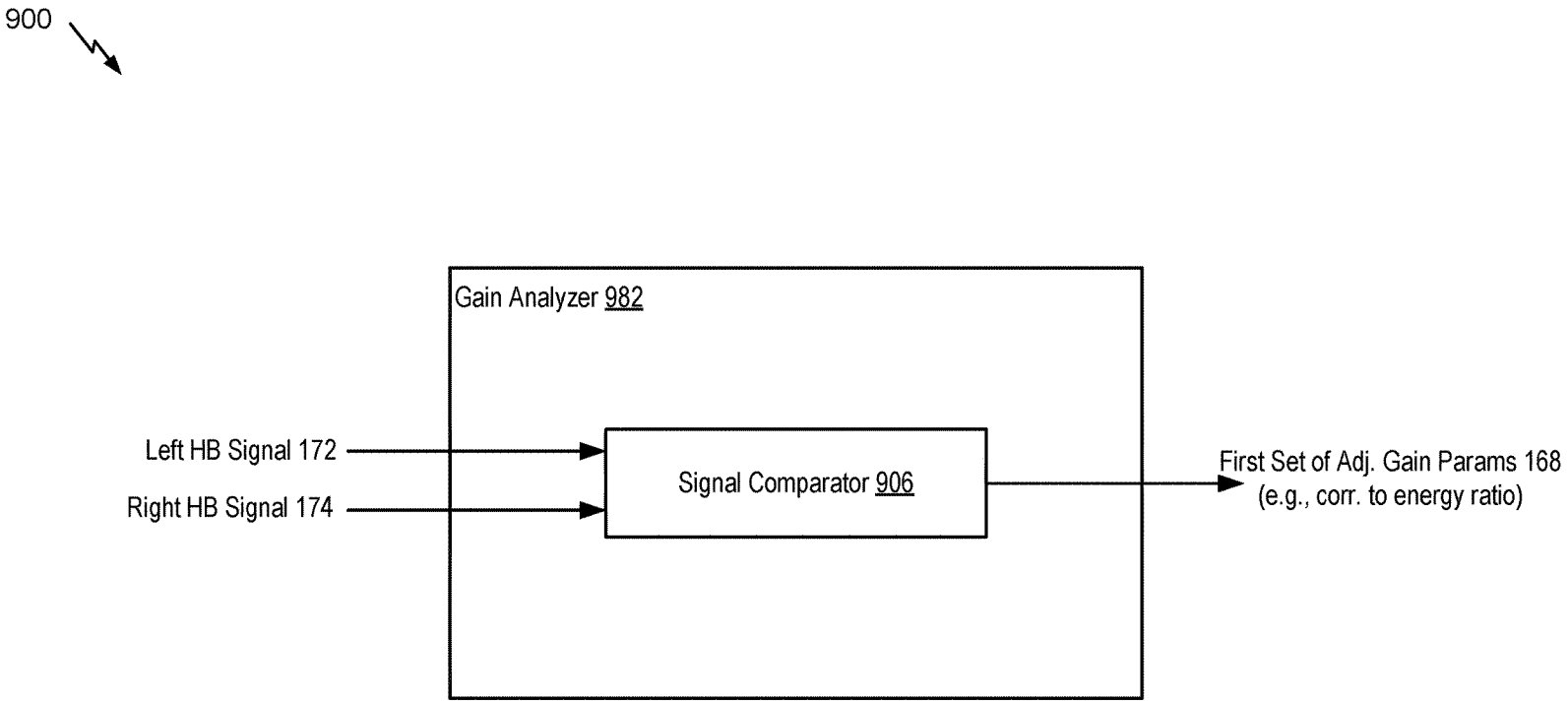
FIG. 9 is a diagram illustrating another example of a device of FIG. 1.

Referring to FIG. 9, an illustrative example of a device is shown and generally designated 900. One or more components of the device 900 may be included in the encoder 114, the first device 104, the system 100, or a combination thereof.

The device 900 includes a gain analyzer 982. The gain analyzer 982 may correspond to the gain analyzer 182 of FIG. 1. The gain analyzer 982 may include a signal comparator 906. The signal comparator 906 may be configured to generate the first set of adjustment gain parameters 168 based on a comparison of the left HB signal 172 and the right HB signal 174. For example, the signal comparator 906 may determine a left energy of the left HB signal 172 and a right energy of the right HB signal 174. The first set of adjustment gain parameters 168 may correspond to an energy ratio of the left energy relative to the right energy (e.g., left energy/right energy). In a particular aspect, the first set of adjustment gain parameters 168 may correspond to an energy difference between the left energy and the right energy (e.g., left energy−right energy). In a particular aspect, the first set of adjustment gain parameters 168 may indicate a decibel difference between the left energy and the right energy. In some implementations, the first set of adjustment gain parameters 168 may indicate an absolute value of the decibel difference. For example, sign (e.g., positive/negative) information of the decibel difference may be omitted from the first set of adjustment gain parameters 168. The HB reference signal indicator 164 may indicate the sign information of the decibel difference. For example, the HB reference signal indicator 164 may indicate a non-negative decibel difference when the HB reference signal indicator 164 indicates that the left HB signal 172 corresponds to a reference signal. As another example, the HB reference signal indicator 164 may indicate a negative decibel difference when the HB reference signal indicator 164 indicates that the right HB signal 174 corresponds to the reference signal. The gain analyzer 982 may provide the first set of adjustment gain parameters 168 to the transmitter 110 of FIG. 1.

Figure 10:
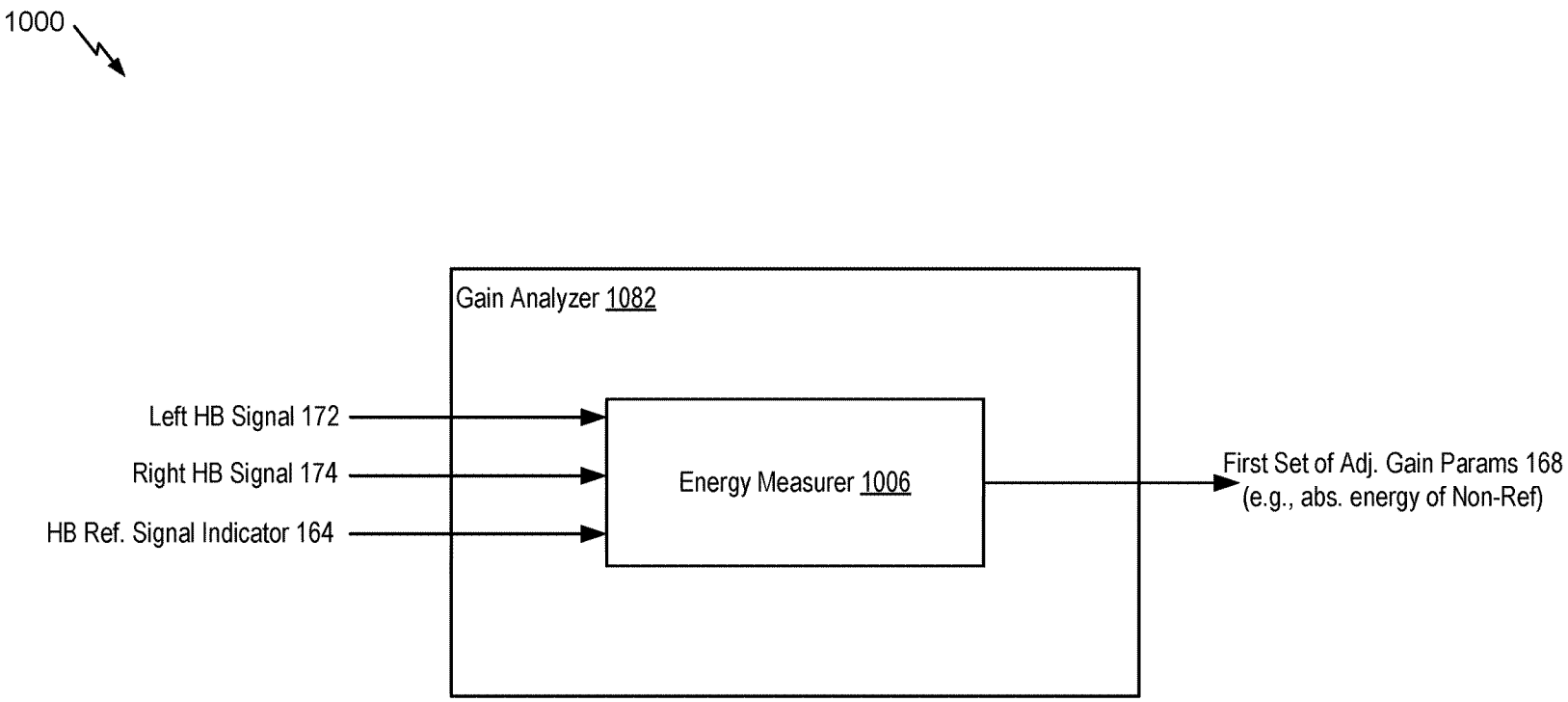
FIG. 10 is a diagram illustrating another example of a device of FIG. 1.

Referring to FIG. 10, an illustrative example of a device is shown and generally designated 1000. One or more components of the device 1000 may be included in the encoder 114, the first device 104, the system 100, or a combination thereof.

The device 1000 includes a gain analyzer 1082. The gain analyzer 1082 may correspond to the gain analyzer 182 of FIG. 1. The gain analyzer 1082 may include an energy measurer 1006. The energy measurer 1006 may be configured to generate the first set of adjustment gain parameters 168 based on the left HB signal 172, the right HB signal 174, the HB reference signal indicator 164, or a combination thereof, as described herein.

The energy measurer 1006 may determine whether the left HB signal 172 or the right HB signal 174 corresponds to a non-reference signal based on the HB reference signal indicator 164. For example, the energy measurer 1006 may, in response to determining that a first value of the HB reference signal indicator 164 indicates that the left HB signal 172 corresponds to the non-reference signal, determine a non-reference high-band energy by measuring an energy of the left HB signal 172. As another example, the energy measurer 1006 may, in response to determining that a second value of the HB reference signal indicator 164 indicates that the right HB signal 174 corresponds to the non-reference signal, determine the non-reference high-band energy by measuring an energy of the right HB signal 174. The first set of adjustment gain parameters 168 may indicate the non-reference high-band energy (e.g., an "absolute energy" of the non-reference signal that is not determined relative to the reference high-band energy). For example, the energy measurer 1006 may generate the first set of adjustment gain parameters 168 by quantizing the non-reference high-band energy. The energy measurer 1006 may provide the first set of adjustment gain parameters 168 to the transmitter 110 of FIG. 1.

Figure 11:
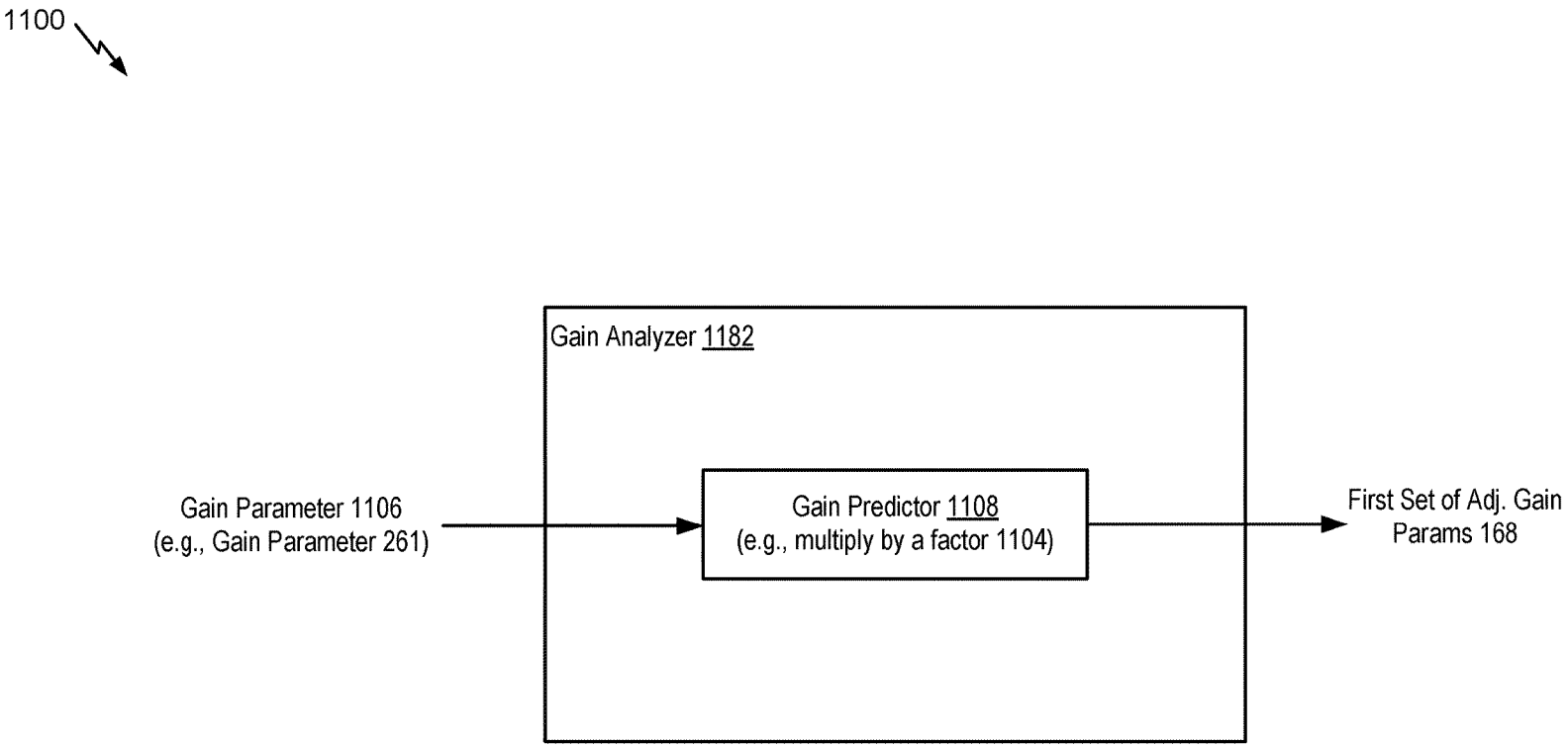
FIG. 11 is a diagram illustrating another example of a device of FIG. 1.

Referring to FIG. 11, an illustrative example of a device is shown and generally designated 1100. One or more components of the device 1100 may be included in the encoder 114, the first device 104, the system 100, or a combination thereof.

The device 1100 includes a gain analyzer 1182. The gain analyzer 1182 may correspond to the gain analyzer 182 of FIG. 1. The gain analyzer 1182 may include a gain predictor 1108. The gain predictor 1108 may be configured to generate the first set of adjustment gain parameters 168 based on a gain parameter 1106. For example, the gain predictor 1108 may generate the first set of adjustment gain parameters 168 by applying a factor 1104 (e.g., a multiplication factor of 2) to the gain parameter 1106. In a particular aspect, the first set of adjustment gain parameters 168 may indicate the factor 1104 (e.g., the multiplication factor of 2). The gain predictor 1108 may provide the first set of adjustment gain parameters 168 to the transmitter 110.

In a particular aspect, the gain parameter 1106 may correspond to the gain parameter 261 (e.g., $g_D$) of FIG. 2. In another aspect, the gain parameter 1106 may correspond to the gain parameter 806 of FIG. 8. The gain parameter 1106 may indicate a gain ratio (or a gain difference) of a left low-band energy of the left LB signal 171 and a right low-band energy of the right LB signal 173 (e.g., gain parameter 1106=(left low-band energy/right low-band energy) or (right low-band energy/left low-band energy) or (left low-band energy−right low-band energy) or (right low-band energy−left low-band energy)). In an alternate aspect, the gain parameter 1106 may indicate a gain ratio (or a gain difference) of a left energy of the left signal 131 and a right energy of the right signal 133 (e.g., gain parameter 1106=(left energy/right energy) or (right energy/left energy) or (left energy−right energy) or (right energy−left energy)). The first set of adjustment gain parameters 168 may correspond to a predicted energy ratio (or predicted energy difference).

Figure 12:
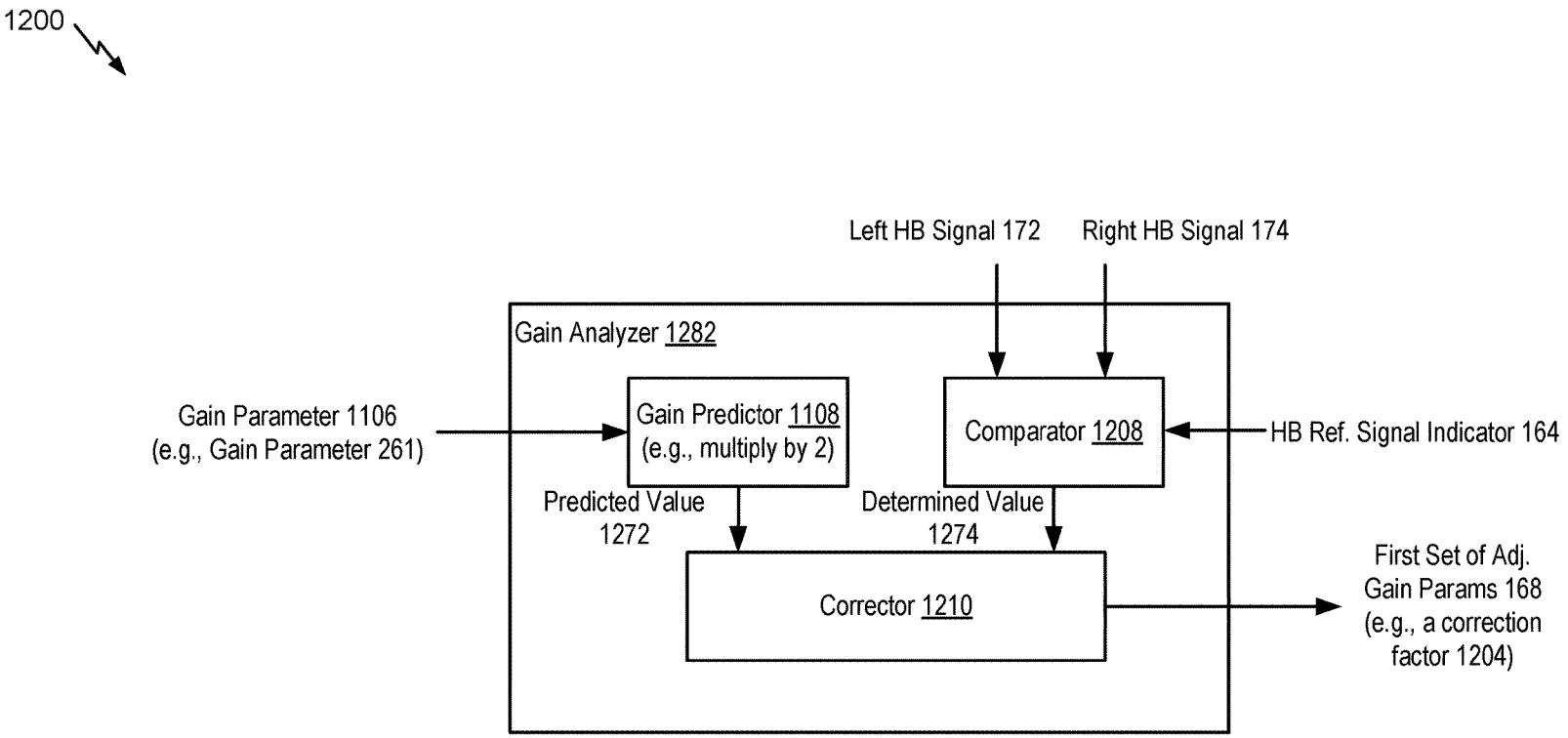
FIG. 12 is a diagram illustrating another example of a device of FIG. 1.

Referring to FIG. 12, an illustrative example of a device is shown and generally designated 1200. One or more components of the device 1200 may be included in the encoder 114, the first device 104, the system 100, or a combination thereof.

The device 1200 includes a gain analyzer 1282. The gain analyzer 1282 may correspond to the gain analyzer 182 of FIG. 1. The gain analyzer 1282 may include the gain predictor 1108, a comparator 1208, or both, coupled to a corrector 1210. The gain predictor 1108 may be configured to generate a predicted value 1272 based on the gain parameter 1106. For example, the gain predictor 1108 may generate the predicted value 1272 by applying a factor (e.g., a multiplication factor of 2) to the gain parameter 1106. The gain predictor 1108 may provide the predicted value 1272 to the corrector 1210.

The comparator 1208 may generate a determined value 1274 based on the left HB signal 172, the right HB signal 174, the HB reference signal indicator 164, or a combination thereof. For example, the comparator 1208 may determine a left high-band energy of the left HB signal 172 and a right high-band energy of the right HB signal 174. The determined value 1274 may correspond to a high-band energy ratio of the left high-band energy relative to the right high-band energy (e.g., left high-band energy/right high-band energy) or to a high-band energy difference between the left high-band energy and the right high-band energy (e.g., left high-band energy−right high-band energy).

In a particular aspect, the comparator 1208 may, based on the HB reference signal indicator 164, determine that one of the left HB signal 172 or the right HB signal 174 corresponds to a reference signal and that the other of the left HB signal 172 or the right HB signal 174 corresponds to a non-reference signal. The comparator 1208 may determine a non-reference high-band energy of the non-reference signal and a reference high-band energy of the reference signal. The determined value 1274 may correspond to a high-band energy ratio of the non-reference high-band energy relative to the reference high-band energy (e.g., non-reference high-band energy/reference high-band energy) or to a high-band energy difference between the non-reference high-band energy and the reference high-band energy (e.g., non-reference high-band energy−non-reference high-band energy).

The comparator 1208 may provide the determined value 1274 to the corrector 1210. The corrector 1210 may determine the first set of adjustment gain parameters 168 (e.g., a correction factor 1204) based on a comparison of the predicted value 1272 and the determined value 1274. For example, the first set of adjustment gain parameters 168 (e.g., the correction factor 1204) may correspond to a difference (or ratio) of the determined value 1274 and the predicted value 1272. The corrector 1210 may provide the first set of adjustment gain parameters 168 (e.g., the correction factor 1204) to the transmitter 110.

In a particular aspect, the comparator 1208 may determine a spectral shape difference of the left HB signal 172 as compared to the right HB signal 174. The determined value 1274 may indicate the spectral shape difference. The gain analyzer 1282 may determine the first set of adjustment gain parameters 168 based on the gain parameter 1106 (e.g., the gain parameter 261) and the determined value 1274. For example, the gain analyzer 1282 may generate the first set of adjustment gain parameters 168 by adjusting the gain parameter 1106 based on the determined value 1274.

Figure 13:
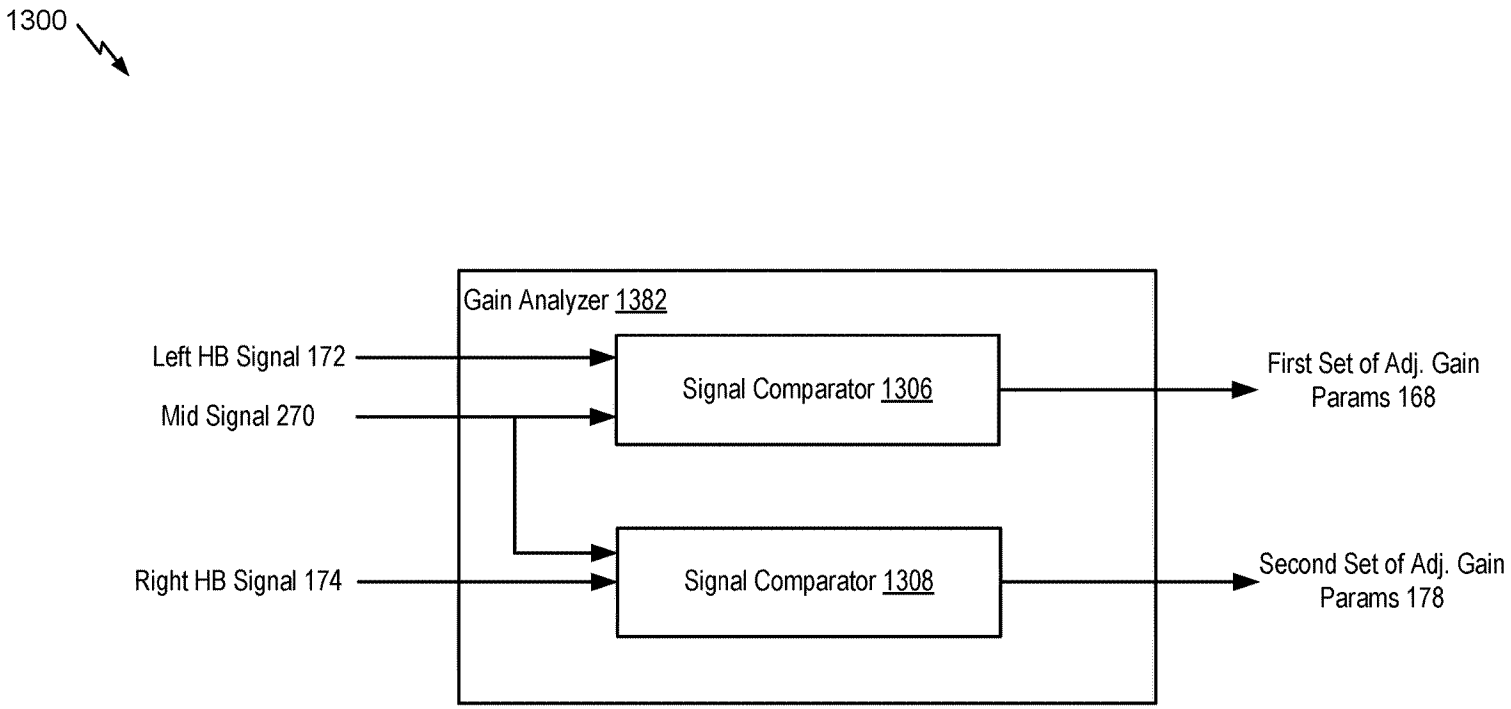
FIG. 13 is a diagram illustrating another example of a device of FIG. 1.

Referring to FIG. 13, an illustrative example of a device is shown and generally designated 1300. One or more components of the device 1300 may be included in the encoder 114, the first device 104, the system 100, or a combination thereof.

The device 1300 includes a gain analyzer 1382. The gain analyzer 1382 may correspond to the gain analyzer 182 of FIG. 1. The gain analyzer 1382 may include a signal comparator 1306, a signal comparator 1308, or both. The signal comparator 1306 may be configured to generate the first set of adjustment gain parameters 168 based on a comparison of the left HB signal 172 and the mid signal 270 (e.g., a high-band portion of the mid signal 270). For example, the first set of adjustment gain parameters 168 may indicate a gain difference between the left HB signal 172 and the mid signal 270 (e.g., the high-band portion of the mid signal 270). The signal comparator 1306 may provide the first set of adjustment gain parameters 168 to the transmitter 110 of FIG. 1.

The signal comparator 1308 may be configured to generate the second set of adjustment gain parameters 178 based on a comparison of the right HB signal 174 and the mid signal 270 (e.g., the high-band portion of the mid signal 270). For example, the second set of adjustment gain parameters 178 may indicate a gain difference between the mid signal 270 (e.g., the high-band portion of the mid signal 270) and the right HB signal 174. The signal comparator 1308 may provide the second set of adjustment gain parameters 178 to the transmitter 110 of FIG. 1.

Figure 14:
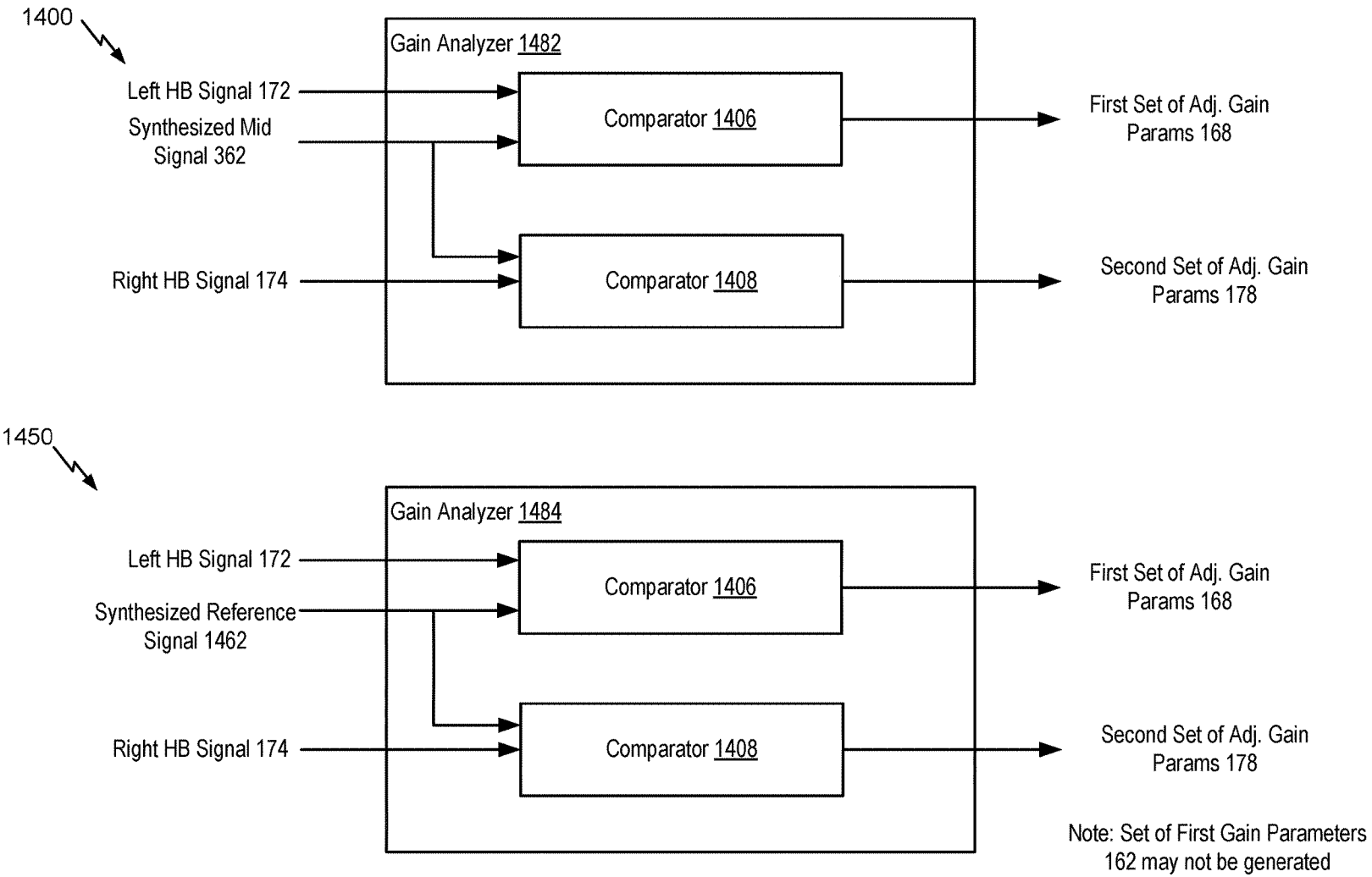
FIG. 14 is a diagram illustrating other examples of a device of FIG. 1.

Referring to FIG. 14, an illustrative example of a device is shown and generally designated 1400. One or more components of the device 1400 may be included in the encoder 114, the first device 104, the system 100, or a combination thereof.

The device 1400 includes a gain analyzer 1482. The gain analyzer 1482 may correspond to the gain analyzer 182 of FIG. 1. The gain analyzer 1482 may include a comparator 1406, a comparator 1408, or both. The comparator 1406 may be configured to generate the first set of adjustment gain parameters 168 based on a comparison of the left HB signal 172 and the synthesized mid signal 362. For example, the first set of adjustment gain parameters 168 may indicate a gain difference between the left HB signal 172 and the synthesized mid signal 362 (e.g., a synthesized high-band mid signal). The comparator 1406 may provide the first set of adjustment gain parameters 168 to the transmitter 110 of FIG. 1.

The comparator 1408 may be configured to generate the second set of adjustment gain parameters 178 based on a comparison of the right HB signal 174 and the synthesized mid signal 362 (e.g., the synthesized high-band mid signal). For example, the second set of adjustment gain parameters 178 may indicate a gain difference between the synthesized mid signal 362 (e.g., the synthesized high-band mid signal) and the right HB signal 174. The signal comparator 1308 may provide the second set of adjustment gain parameters 178 to the transmitter 110 of FIG. 1.

In a particular aspect, the gain analyzer 182 may estimate the first set of adjustment gain parameters 168 based on the gain parameter 261, as described with reference to FIG. 11. The gain analyzer 182 may determine the second set of adjustment gain parameters 178 based on the first set of adjustment gain parameters 168. For example, the gain analyzer 182 may generate the second set of adjustment gain parameters 178 by applying a factor (e.g., a multiplication factor of 2) to the first set of adjustment gain parameters 168. In a particular aspect, the second set of adjustment gain parameters 178 may indicate the factor (e.g., the multiplication factor of 2). The gain analyzer 182 may provide at least one of the gain parameter 261, the first set of adjustment gain parameters 168, or the second set of adjustment gain parameters 178 to the transmitter 110.

In FIG. 14, another illustrative example of a device is shown and generally designated 1450. One or more components of the device 1450 may be included in the encoder 114, the first device 104, the system 100, or a combination thereof.

The device 1400 includes a gain analyzer 1484. The gain analyzer 1484 may correspond to the gain analyzer 182 of FIG. 1. The gain analyzer 1484 may include the comparator 1406, the comparator 1408, or both.

The encoder 114 may generate a synthesized reference signal 1462. For example, the encoder 114 may designate one of the left HB signal 172 or the right HB signal 174 as a reference signal and the other of the left HB signal 172 or the right HB signal 174 as a non-reference signal, as described with reference to FIG. 6. The encoder 114 may generate the LPC parameters 102 based on the reference signal. For example, an LP analyzer and quantizer of the encoder 114 may generate quantized HB LSFs corresponding to the reference signal. The LP analyzer and quantizer may generate the LPC parameters 102 (e.g., a HB LSF index) corresponding to the quantized HB LSFs.

The encoder 114 may generate the synthesized reference signal 1462 based on the LPC parameters 102. For example, the LPC analyzer and quantizer may provide the quantized HB LSFs to an LSF to LPC converter of the encoder 114. The LSF to LPC converter may generate HB LPCs based on the quantized HB LSFs. A synthesizer of the encoder 114 may generate the synthesized reference signal 1462 based on the HB LPCs. The synthesizer may provide the synthesized reference signal 1462 to the comparator 1406, the comparator 1408, or both.

The comparator 1406 may be configured to generate the first set of adjustment gain parameters 168 based on a comparison of the left HB signal 172 and the synthesized reference signal 1462. For example, the first set of adjustment gain parameters 168 may indicate a gain difference between the left HB signal 172 and the synthesized reference signal 1462 (e.g., a synthesized high-band reference signal). The comparator 1406 may provide the first set of adjustment gain parameters 168 to the transmitter 110 of FIG. 1.

The comparator 1408 may be configured to generate the second set of adjustment gain parameters 178 based on a comparison of the right HB signal 174 and the synthesized reference signal 1462 (e.g., the synthesized high-band reference signal). For example, the second set of adjustment gain parameters 178 may indicate a gain difference between the synthesized reference signal 1462 (e.g., the synthesized high-band reference signal) and the right HB signal 174. The signal comparator 1308 may provide the second set of adjustment gain parameters 178 to the transmitter 110 of FIG. 1.

The transmitter 110 may transmit at least one of the gain parameter 261, the first set of adjustment gain parameters 168, or the second set of adjustment gain parameters 178. In a particular aspect, the transmitter 110 may transmit the first set of adjustment gain parameters 168 and the second set of adjustment gain parameters 178 and may refrain from transmitting the set of first gain parameters 162. In this aspect, the encoder 114 of FIG. 1 may refrain from generating the set of first gain parameters 162.

Figure 15:
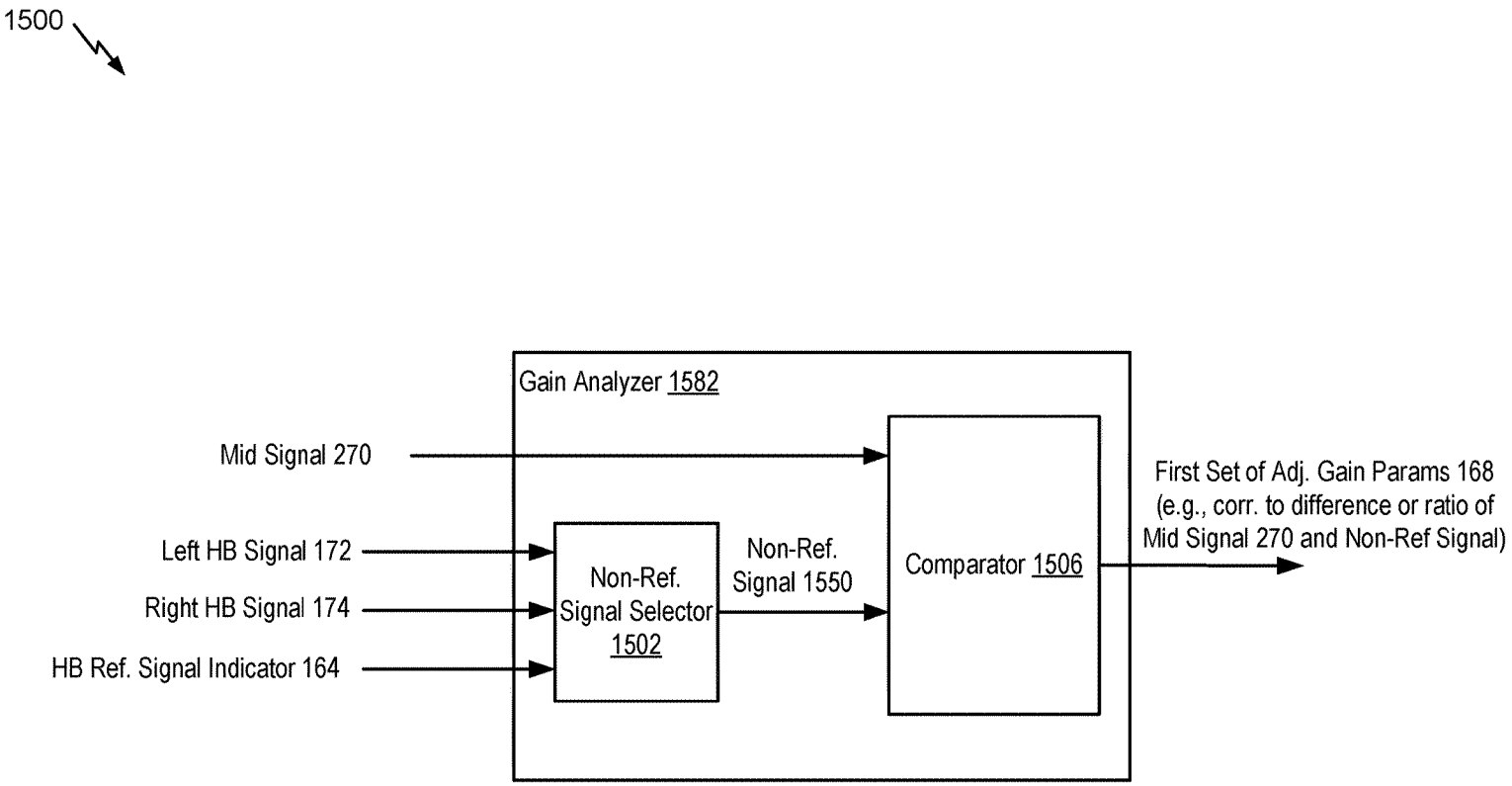
FIG. 15 is a diagram illustrating another example of a device of FIG. 1.

Referring to FIG. 15, an illustrative example of a device is shown and generally designated 1500. One or more components of the device 1500 may be included in the encoder 114, the first device 104, the system 100, or a combination thereof.

The device 1500 includes a gain analyzer 1582. The gain analyzer 1582 may correspond to the gain analyzer 182 of FIG. 1. The gain analyzer 1582 may include a non-reference signal selector 1502 coupled to a comparator 1506. The non-reference signal selector 1502 may be configured to select one of the left HB signal 172 or the right HB signal 174 based on the HB reference signal indicator 164. For example, the non-reference signal selector 1502 may, in response to determining that the HB reference signal indicator 164 has a first value, determine that the right HB signal 174 corresponds to a non-reference signal 1550. Alternatively, the non-reference signal selector 1502 may, in response to determining that the HB reference signal indicator 164 has a second value, determine that the left HB signal 172 corresponds to the non-reference signal 1550. The non-reference signal selector 1502 may provide the non-reference signal 1550 to the comparator 1506.

The comparator 1506 may be configured to generate the first set of adjustment gain parameters 168 based on the non-reference signal 1550 and the mid signal 270. For example, the comparator 1506 may determine a non-reference high-band gain corresponding to a difference between energy of the non-reference signal 1550 and energy of the mid signal 270. It should be understood that a 'difference' between a first energy (A) and a second energy (B) may correspond to the first energy subtracted from the second energy (B-A), the second energy subtracted from the first energy (A-B), a ratio of the first energy relative to the second energy (A/B or B/A), or a combination thereof. A sum of a first difference of energies and a second difference of energies may correspond to the first difference added to the second difference, the first difference multiplied by the second difference, or both. A difference between the first difference and the second difference may correspond to the first difference subtracted from the second difference, the second difference subtracted from the first difference, a ratio of the first difference relative to the second difference, or a combination thereof. It should be understood that "energy" and "power" are used interchangeably herein. In some aspects, "energy" may correspond to signal power, a square root of average power of a signal, a root mean square (RMS) of a signal, or a combination thereof.

The first set of adjustment gain parameters 168 may indicate the non-reference high-band gain. The comparator 1506 may provide the first set of adjustment gain parameters 168 to the transmitter 110 of FIG. 1. In a particular aspect, the encoder 114 of FIG. 1 may refrain from generating the second set of adjustment gain parameters 178. A decoder may generate a predicted second set of adjustment gain parameters based on the first set of adjustment gain parameters 168, as further described with reference to FIG. 26.

Figure 16:
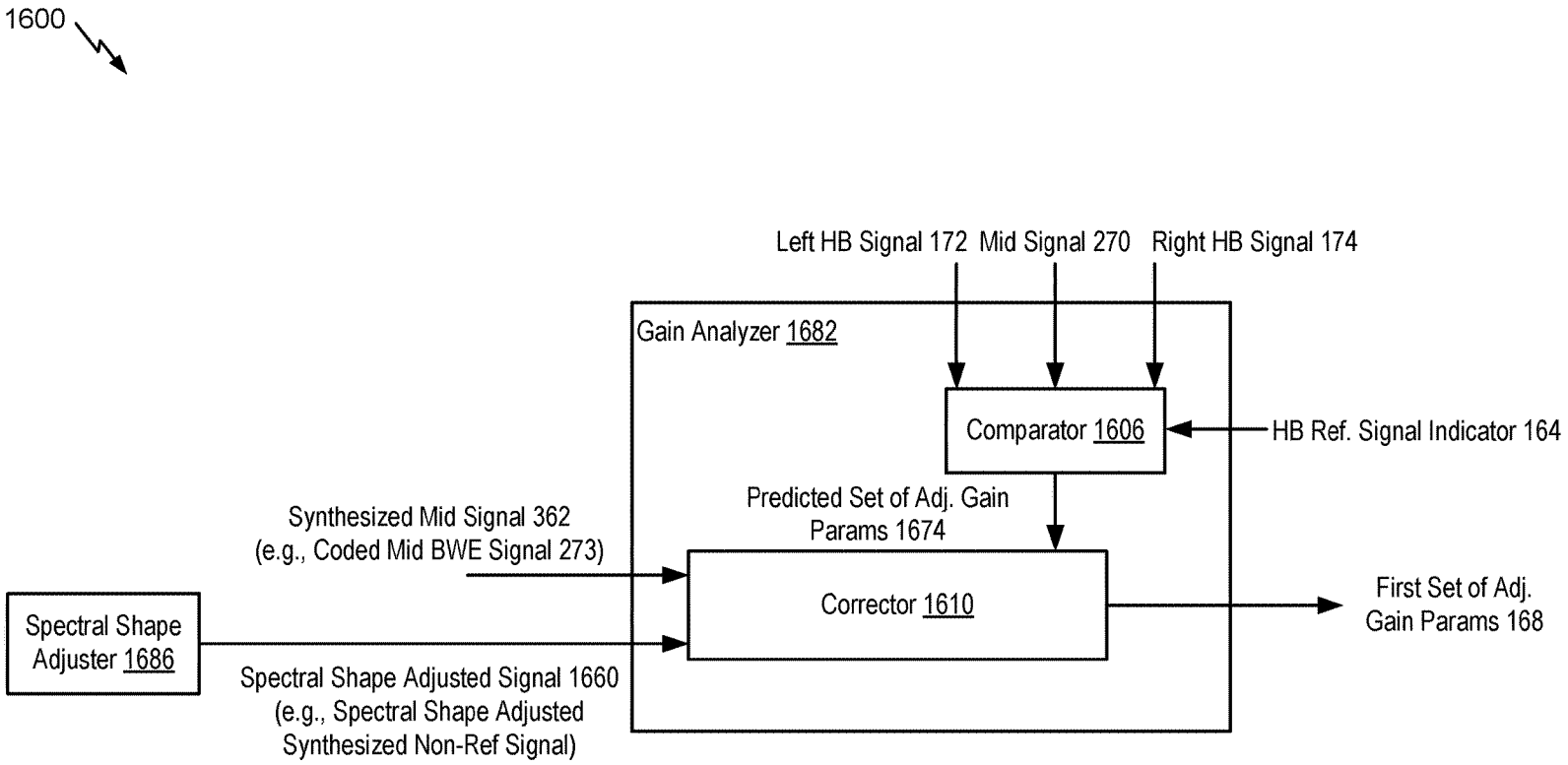
FIG. 16 is a diagram illustrating another example of a device of FIG. 1.

Referring to FIG. 16, an illustrative example of a device is shown and generally designated 1600. One or more components of the device 1600 may be included in the encoder 114, the first device 104, the system 100, or a combination thereof.

The device 1600 includes a gain analyzer 1682 coupled to a spectral shape adjuster 1686. The spectral shape adjuster 1686 is configured to generate a spectral shape adjusted signal 1660 (e.g., a spectral shape adjusted synthesized non-reference signal), as further described with reference to FIG. 17. The gain analyzer 1682 may correspond to the gain analyzer 182 of FIG. 1. The gain analyzer 1682 may include a comparator 1606 coupled to a corrector 1610. The spectral shape adjuster 1686 may be coupled to the corrector 1610.

The comparator 1606 may be configured to generate a predicted set of adjustment gain parameters 1674 based on the left HB signal 172, the right HB signal 174, the mid signal 270, the HB reference signal indicator 164, or a combination thereof, as described herein. The comparator 1606 may provide the predicted set of adjustment gain parameters 1674 to the corrector 1610. The corrector 1610 may receive the spectral shape adjusted signal 1660 (e.g., a modified synthesized high-band non-reference signal) from the spectral shape adjuster 1686. The corrector 1610 may generate the first set of adjustment gain parameters 168 based on the synthesized mid signal 362 (e.g., the coded mid BWE signal 273) and the spectral shape adjusted signal 1660, as described herein.

The comparator 1606 may determine whether the left HB signal 172 or the right HB signal 174 corresponds to a non-reference signal based on the HB reference signal indicator 164. For example, the comparator 1606 may, in response to determining that a first value of the HB reference signal indicator 164 indicates that the left HB signal 172 corresponds to the non-reference signal, determine a non-reference high-band gain corresponding to a difference between an energy of the left HB signal 172 and an energy of the mid signal 270. As another example, the comparator 1606 may, in response to determining that a second value of the HB reference signal indicator 164 indicates that the right HB signal 174 corresponds to the non-reference signal, determine the non-reference high-band gain corresponding to a difference between an energy of the right HB signal 174 and the energy of the mid signal 270. The predicted set of adjustment gain parameters 1674 may indicate the non-reference high-band gain. The comparator 1606 may provide the predicted set of adjustment gain parameters 1674 to the corrector 1610.

The corrector 1610 may generate a set of adjustment gain parameters based on the synthesized mid signal 362 and the spectral shape adjusted signal 1660. For example, the corrector 1610 may determine a synthesized high-band gain corresponding to a difference between an energy of the synthesized mid signal 362 and an energy of the spectral shape adjusted signal 1660. The set of adjustment gain parameters may indicate the synthesized high-band gain. The corrector 1610 may generate the first set of adjustment gain parameters 168 based on the set of adjustment gain parameters and the predicted set of adjustment gain parameters 1674. For example, the first set of adjustment gain parameters 168 may indicate a difference between the set of adjustment gain parameters and the predicted set of adjustment gain parameters 1674. As another example, the first set of adjustment gain parameters 168 may correspond to a product of the predicted set of adjustment gain parameters 1674 and the ratio of the first energy of the synthesized mid signal 362 and the second energy of the spectral shape adjusted signal 1660 (e.g., first set of adjustment gain parameters 168=predicted set of adjustment gain parameters 1674*(first energy of the synthesized mid signal 362/second energy of the spectral shape adjusted signal 1660). The corrector 1610 may provide the first set of adjustment gain parameters 168 to the transmitter 110 of FIG. 1. In a particular aspect, the encoder 114 of FIG. 1 may refrain from generating the second set of adjustment gain parameters 178. A decoder at a receiving device may generate a predicted second set of adjustment gain parameters based on the first set of adjustment gain parameters 168, as further described with reference to FIG. 26.

Figure 17:
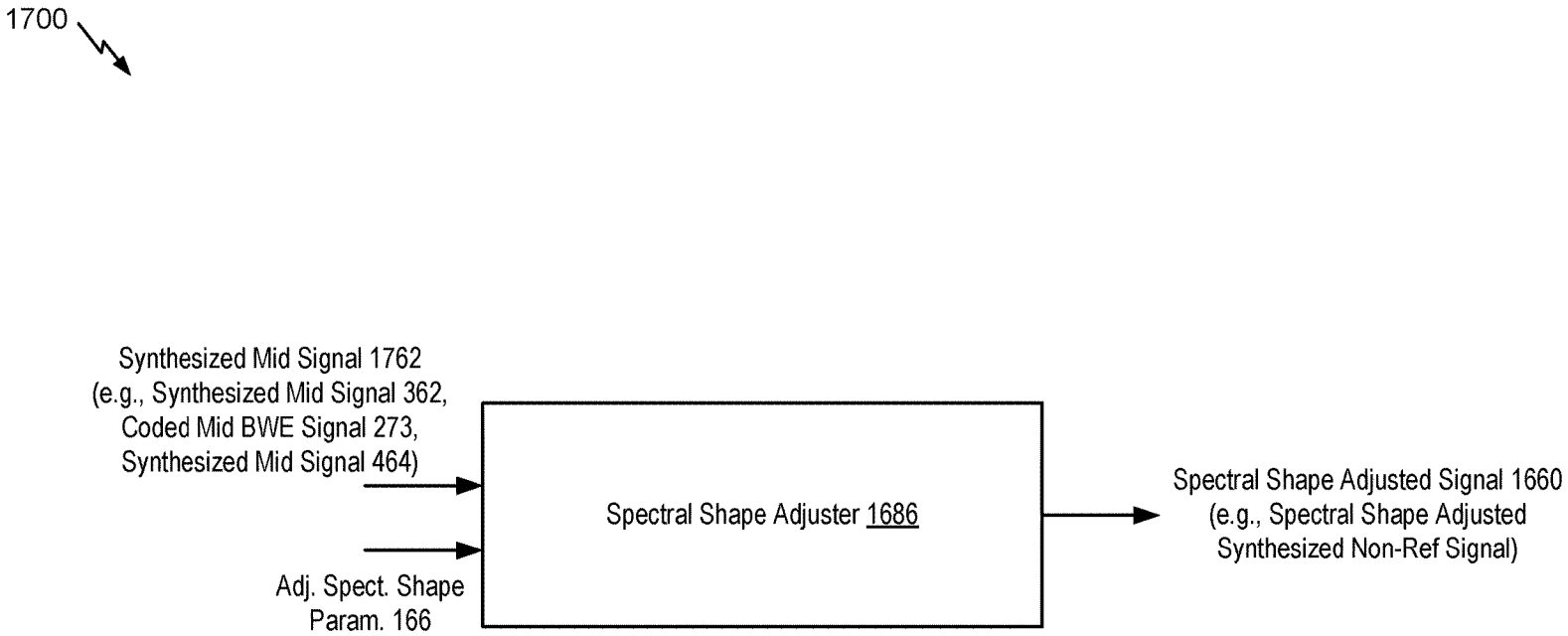
FIG. 17 is a diagram illustrating another example of a device of FIG. 1.

Referring to FIG. 17, an illustrative example of a device is shown and generally designated 1700. One or more components of the device 1700 may be included in the encoder 114, the first device 104, the system 100, or a combination thereof.

The device 1700 may include the spectral shape adjuster 1686. The spectral shape adjuster 1686 may be configured to generate the spectral shape adjusted signal 1660 based on a synthesized mid signal 1762 and the adjustment spectral shape parameter 166. For example, the spectral shape adjuster 1686 may include a spectral shaping filter (e.g., $H(z)=1/(1-uz^{-1})$). The adjustment spectral shape parameter 166 may correspond to a parameter or coefficient (e.g., "u") of the spectral shaping filter, as described with reference to FIG. 18. The spectral shape adjusted signal 1660 may correspond to a spectral shape adjusted synthesized non-reference signal. For example, the adjustment spectral shape parameter 166 may indicate a spectral shape difference of the non-reference signal (e.g., the left HB signal 172) relative to the mid signal 270 (e.g., the high-band portion of the mid signal 270). The spectral shape adjusted signal 1660 may represent a synthesized non-reference signal generated by applying a spectral tilt to the synthesized mid signal 1762 based on the adjustment spectral shape parameter 166. The synthesized mid signal 1762 may correspond to the synthesized mid signal 362 or the synthesized mid signal 464, as described with reference to FIG. 4. In a particular implementation, the synthesized mid signal 1762 may correspond to the synthesized mid signal 362. In an alternate implementation, the synthesized mid signal 362 may be replaced with a second synthesized mid signal (e.g., the synthesized mid signal 464). For example, the synthesized mid signal 1762 may correspond to the synthesized mid signal 464. The synthesized mid signal 464 may be generated by performing similar steps used to generate the synthesized mid signal 362. For example, as described with reference to FIG. 4, the synthesized mid signal 362 may correspond to a first set of gains applied by the gain adjuster 404 and the gain adjuster 410. The synthesized mid signal 464 may correspond to a second set of gains applied by the gain adjuster 404 and the gain adjuster 410. The first set of gains may be distinct from the second set of gains. The first set of gains may correspond to gains used at the encoder to In a particular aspect, the synthesized mid signal 1762 corresponds to the synthesized mid signal 362. In this aspect, the gain estimator 316 of FIG. 3 generates the set of first gain parameters 162 based on the same mid signal (e.g., the synthesized mid signal 362) as used by the spectral shape adjuster 1686 to generate the spectral shape adjusted signal 1660 (e.g., a spectral shape adjusted synthesized non-reference signal).

Figure 18:
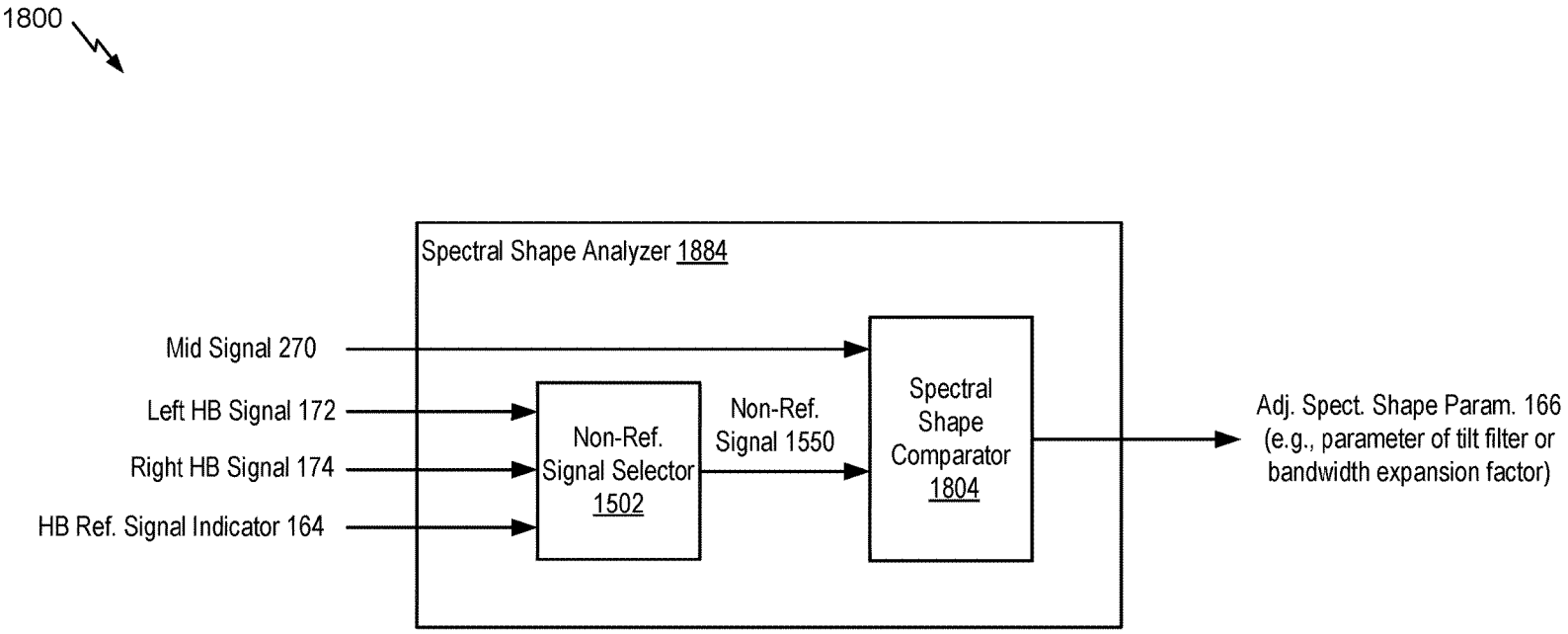
FIG. 18 is a diagram illustrating another example of a device of FIG. 1.

In an alternative aspect, the synthesized mid signal 1762 corresponds to the synthesized mid signal 464. In this aspect, the gain estimator 316 of FIG. 3 generates the set of first gain parameters 162 based on the synthesized mid signal 362 that is distinct from the synthesized mid signal 464 used by the spectral shape adjuster 1686 to generate the spectral shape adjusted signal 1660 (e.g., a spectral shape adjusted synthesized non-reference signal). As described with reference to FIG. 16, the corrector 1610 may generate the first set of adjustment gain parameters 168. The set of first gain parameters 162 may correspond to a first weighting of a noise component to a harmonic component that is distinct from a second weighting of a noise component to a harmonic component associated with the first set of adjustment gain parameters 168. Referring to FIG. 18, an illustrative example of a device is shown and generally designated 1800. One or more components of the device 1800 may be included in the encoder 114, the first device 104, the system 100, or a combination thereof.

The device 1800 includes a spectral shape analyzer 1884. The spectral shape analyzer 1884 may correspond to the spectral shape analyzer 184 of FIG. 1. The spectral shape analyzer 1884 may include the non-reference signal selector 1502, a spectral shape comparator 1804, or both. The non-reference signal selector 1502 may be configured to select one of the left HB signal 172 or the right HB signal 174 as the non-reference signal 1550, as described with reference to FIG. 15.

The non-reference signal selector 1502 may provide the non-reference signal 1550 to the spectral shape comparator 1804. The spectral shape comparator 1804 may be configured to generate the adjustment spectral shape parameter 166 based on a comparison of the non-reference signal 1550 and the mid signal 270 (e.g., a high-band portion of the mid signal 270). For example, the spectral shape comparator 1804 may generate the adjustment spectral shape parameter 166 based on a comparison of a first spectral shape of the non-reference signal 1550 and a second spectral shape of the mid signal 270 (e.g., the high-band portion of the mid signal 270). Although referred to as the spectral shape comparator 1804, in other implementations, the spectral shape comparator 1804 may include or correspond to a spectral shape estimator, a spectral shape analyzer, or a parameter refiner (e.g., a spectral shape parameter refiner).

The adjustment spectral shape parameter 166 (e.g., u) may correspond to a parameter (e.g., a coefficient) of a tilt filter (e.g., $H(z)=1/(1+uz^{-1})$). In a particular aspect, the adjustment spectral shape parameter 166 may correspond to a LPC bandwidth expansion factor (e.g., $\gamma$), as described further with reference to FIG. 39.

Figure 19:
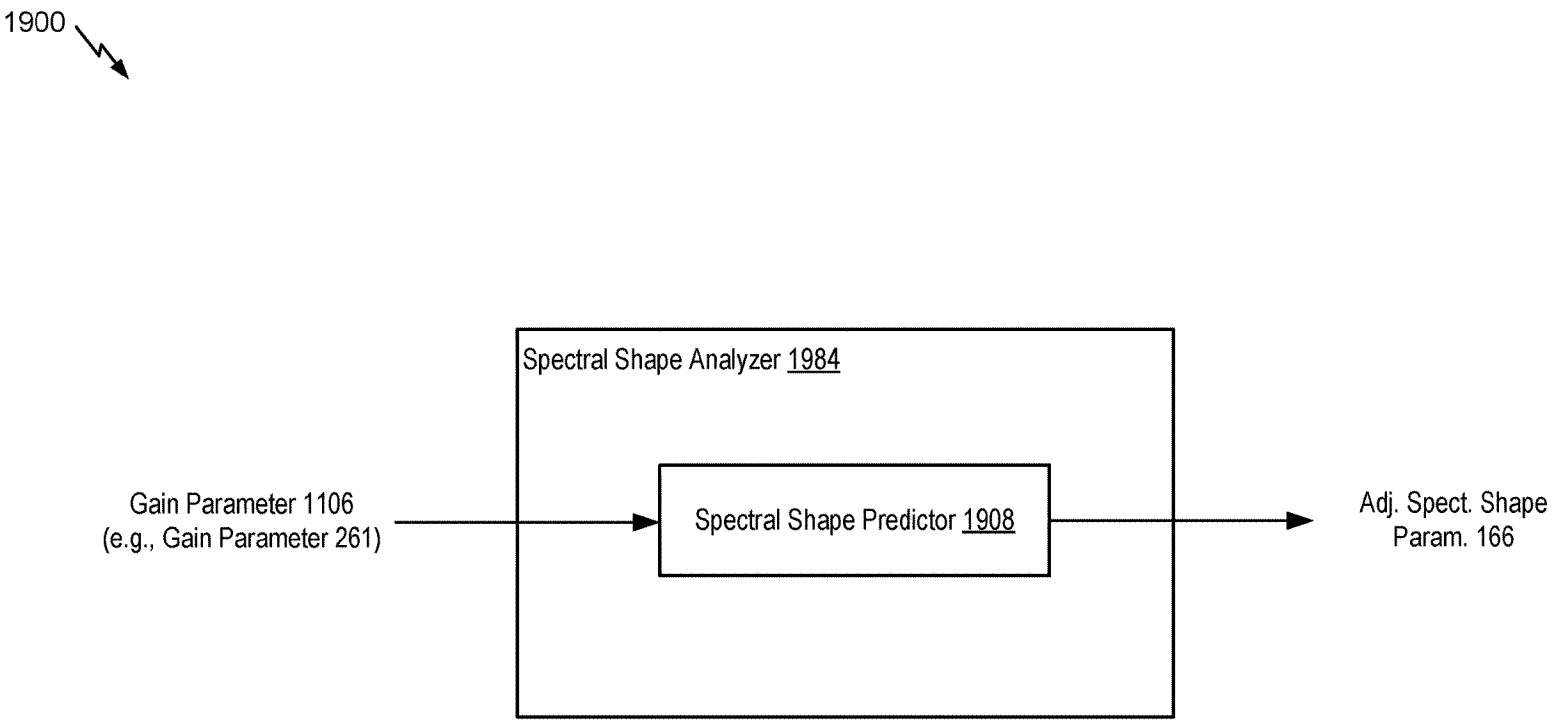
FIG. 19 is a diagram illustrating another example of a device of FIG. 1.

Referring to FIG. 19, an illustrative example of a device is shown and generally designated 1900. One or more components of the device 1900 may be included in the encoder 114, the first device 104, the system 100, or a combination thereof.

The device 1900 includes a spectral shape analyzer 1984. The spectral shape analyzer 1984 may correspond to the spectral shape analyzer 184 of FIG. 1. The spectral shape analyzer 1984 may include a spectral shape predictor 1908.

The spectral shape predictor 1908 may be configured to generate the adjustment spectral shape parameter 166 based on the gain parameter 1106. For example, the spectral shape predictor 1908 may determine the adjustment spectral shape parameter 166 by applying a factor to the gain parameter 1106. The spectral shape predictor 1908 may provide the adjustment spectral shape parameter 166 to the transmitter 110 of FIG. 1.

The gain parameter 1106 may correspond to the gain parameter 261 ($g_D$). The gain parameter 1106 may correspond to a low-band gain parameter. For example, the gain parameter 1106 may be based on a left LB energy of the left LB signal 171 and a right LB energy of the right LB signal 173. To illustrate, the gain parameter 1106 may indicate a LB energy ratio (e.g., the left LB energy/the right LB energy) or a LB energy difference (e.g., the left LB energy−the right LB energy). The "LB energy ratio" may also be referred to as a "ratio of LB energies."

In a particular aspect, the gain parameter 1106 may correspond to a high-band gain parameter. For example, the gain parameter 1106 may be based on a left HB energy of the left HB signal 172 and a right HB energy of the right HB signal 174, as described with reference to FIG. 11. To illustrate, the gain parameter 1106 may indicate a HB energy ratio (e.g., the left HB energy/the right HB energy) or a HB energy difference (e.g., the left HB energy−the right HB energy).

Figure 20:
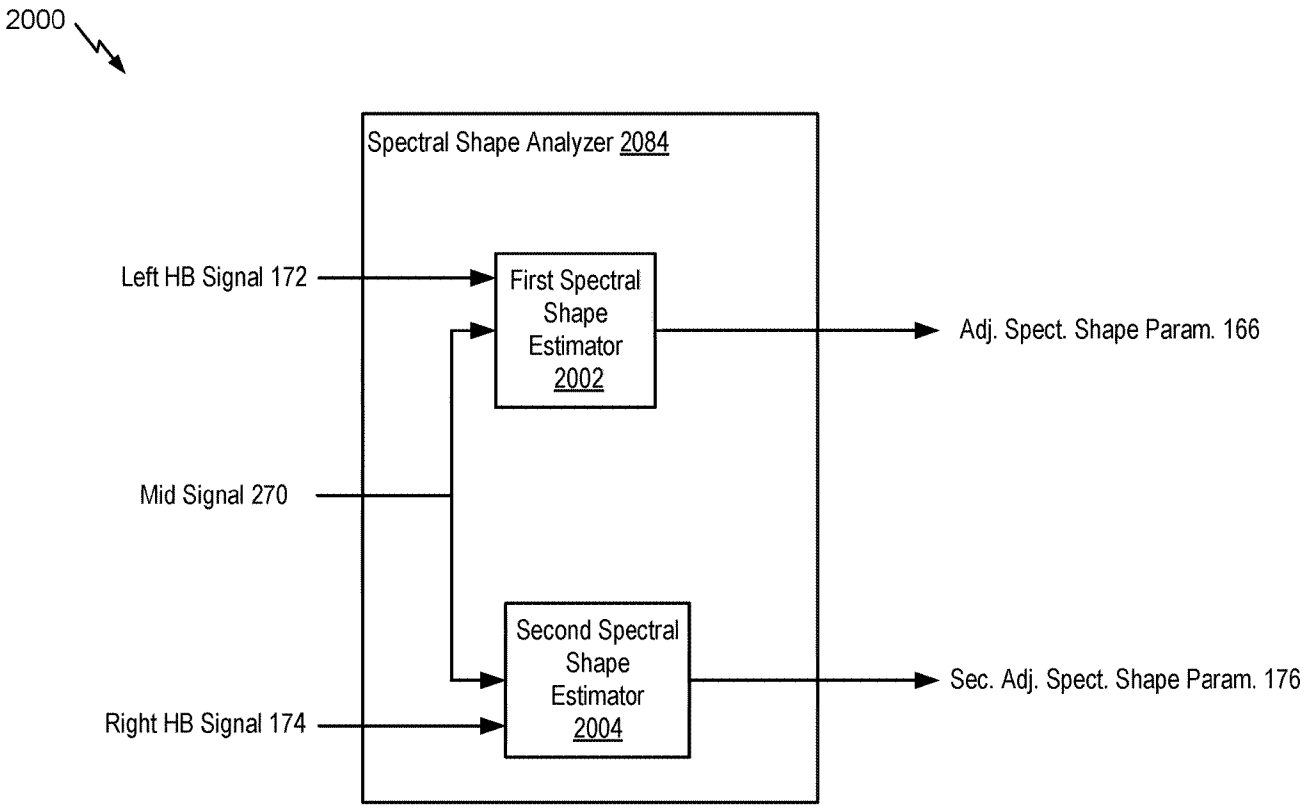
FIG. 20 is a diagram illustrating another example of a device of FIG. 1.

Referring to FIG. 20, an illustrative example of a device is shown and generally designated 2000. One or more components of the device 2000 may be included in the encoder 114, the first device 104, the system 100, or a combination thereof.

The device 2000 includes a spectral shape analyzer 2084. The spectral shape analyzer 2084 may correspond to the spectral shape analyzer 184 of FIG. 1. The spectral shape analyzer 2084 may include a first spectral shape estimator 2002, a second spectral shape estimator 2004, or both. The first spectral shape estimator 2002 may be configured to generate the adjustment spectral shape parameter 166 based on a comparison of the left HB signal 172 and the mid signal 270 (e.g., a high-band portion of the mid signal 270). For example, the adjustment spectral shape parameter 166 may indicate a spectral shape difference of the left HB signal 172 relative to the mid signal 270 (e.g., the high-band portion of the mid signal 270). The first spectral shape estimator 2002 may provide the adjustment spectral shape parameter 166 to the transmitter 110 of FIG. 1.

The second spectral shape estimator 2004 may be configured to generate the second adjustment spectral shape parameter 176 based on a comparison of the right HB signal 174 and the mid signal 270 (e.g., the high-band portion of the mid signal 270). For example, the second set of adjustment gain parameters 178 may indicate a spectral shape difference between the mid signal 270 (e.g., the high-band portion of the mid signal 270) and the right HB signal 174. The second spectral shape estimator 2004 may provide the second adjustment spectral shape parameter 176 to the transmitter 110 of FIG. 1.

Figure 21:
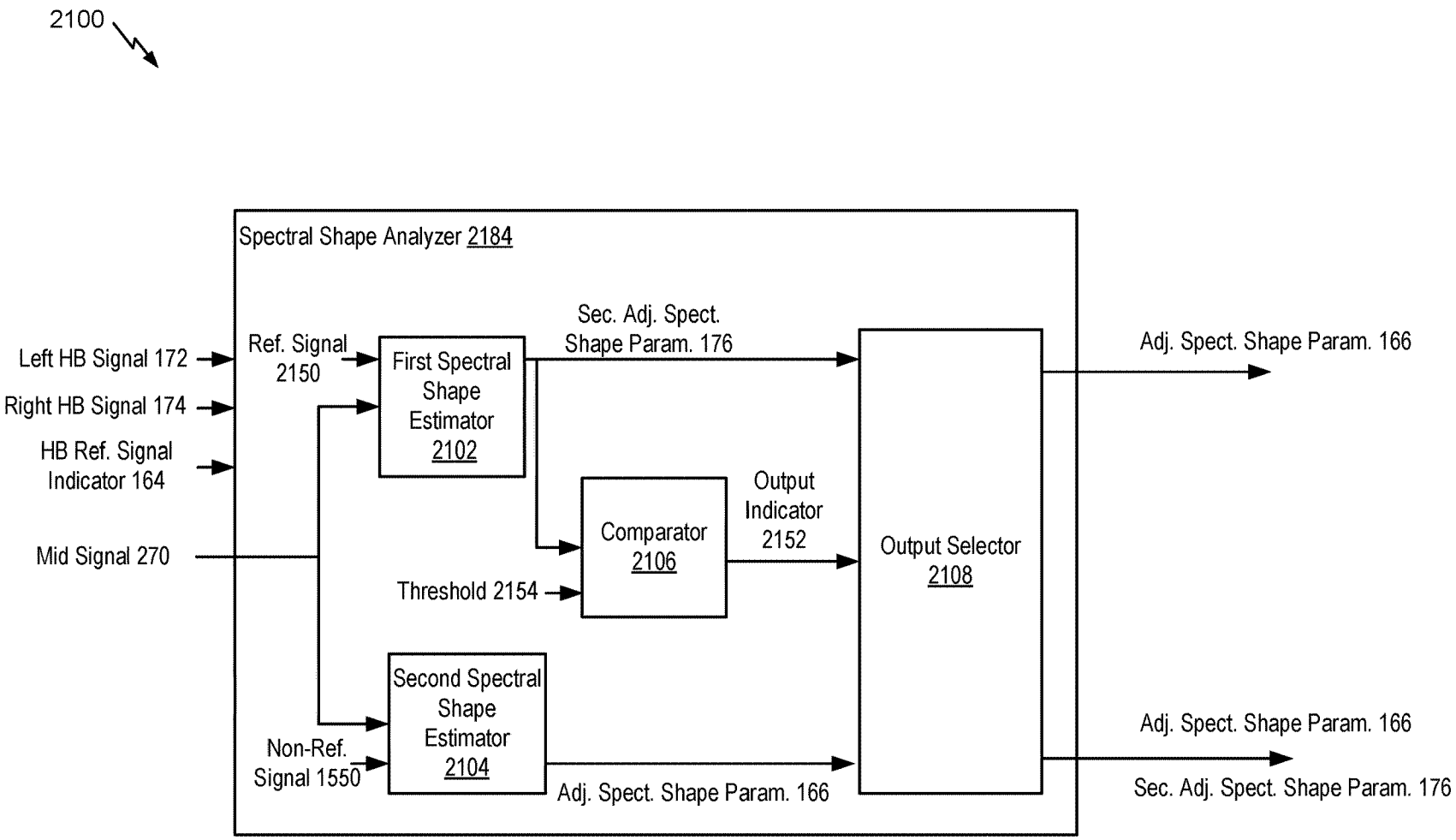
FIG. 21 is a diagram illustrating another example of a device of FIG. 1.

Referring to FIG. 21, an illustrative example of a device is shown and generally designated 2100. One or more components of the device 2100 may be included in the encoder 114, the first device 104, the system 100, or a combination thereof.

The device 2100 includes a spectral shape analyzer 2184. The spectral shape analyzer 2184 may correspond to the spectral shape analyzer 184 of FIG. 1. The spectral shape analyzer 2184 may include a first spectral shape estimator 2102, a second spectral shape estimator 2104, or both. The first spectral shape estimator 2102, the second spectral shape estimator 2104, or both, may be coupled to an output selector 2108. The first spectral shape estimator 2102 may be coupled, via a comparator 2106, to the output selector 2108.

The spectral shape analyzer 2184 may be configured to determine the non-reference signal 1550 based on the left HB signal 172, the right HB signal 174, the HB reference signal indicator 164, or a combination thereof, as further described with reference to FIG. 15. The spectral shape analyzer 2184 may, in response to determining that the HB reference signal indicator 164 has a first value, determine that right HB signal 174 corresponds to the non-reference signal 1550 and the left HB signal 172 corresponds to a reference signal 2150. The spectral shape analyzer 2184 may provide the reference signal 2150 (e.g., the left HB signal 172) to the first spectral shape estimator 2102 and the non-reference signal 1550 (e.g., the right HB signal 174) to the second spectral shape estimator 2104. Alternatively, the spectral shape analyzer 2184 may, in response to determining that the HB reference signal indicator 164 has a second value, determine that right HB signal 174 corresponds to the reference signal 2150 and the left HB signal 172 corresponds to the non-reference signal 1550. The spectral shape analyzer 2184 may provide the reference signal 2150 (e.g., the right HB signal 174) to the first spectral shape estimator 2102 and the non-reference signal 1550 (e.g., the left HB signal 172) to the second spectral shape estimator 2104.

The first spectral shape estimator 2102 may be configured to generate the second adjustment spectral shape parameter 176 based on a comparison of the reference signal 2150 and the mid signal 270 (e.g., a high-band portion of the mid signal 270). For example, the second adjustment spectral shape parameter 176 may indicate a spectral shape difference between the reference signal 2150 and the mid signal 270 (e.g., the high-band portion of the mid signal 270). The first spectral shape estimator 2102 may provide the second adjustment spectral shape parameter 176 to the comparator 2106, the output selector 2108, or both.

The second spectral shape estimator 2104 may be configured to generate the adjustment spectral shape parameter 166 based on a comparison of the non-reference signal 1550 and the mid signal 270 (e.g., the high-band portion of the mid signal 270). For example, the adjustment spectral shape parameter 166 may indicate a spectral shape difference between the non-reference signal 1550 and the mid signal 270 (e.g., the high-band portion of the mid signal 270). The second spectral shape estimator 2104 may provide the adjustment spectral shape parameter 166 to the output selector 2108.

The comparator 2106 may generate an output indicator 2152 based on a comparison of the second adjustment spectral shape parameter 176 and a threshold 2154. For example, the comparator 2106 may generate the output indicator 2152 having a first value (e.g., 0) in response to determining that the second adjustment spectral shape parameter 176 satisfies (e.g., is less than or equal to) the threshold 2154. As another example, the comparator 2106 may generate the output indicator 2152 having a second value (e.g., 1) in response to determining that the second adjustment spectral shape parameter 176 fails to satisfy (e.g., is greater than) the threshold 2154.

The comparator 2106 may provide the output indicator 2152 to the output selector 2108. The output selector 2108 may, in response to determining that the output indicator 2152 has the first value (e.g., 0), provide the adjustment spectral shape parameter 166 and refrain from providing the second adjustment spectral shape parameter 176 to the transmitter 110. Alternatively, the output selector 2108 may, in response to determining that the output indicator 2152 has the second value (e.g., 1), provide the adjustment spectral shape parameter 166 and the second adjustment spectral shape parameter 176 to the transmitter 110.

The second adjustment spectral shape parameter 176 may satisfy the threshold 2154 when a spectral shape difference between the reference signal 2150 and the mid signal 270 (e.g., the high-band portion of the mid signal 270) is less than or equal to a threshold spectral shape difference. When the spectral shape of the reference signal 2150 is substantially similar to a spectral shape of the mid signal 270 (e.g., the high-band portion of the mid signal 270), the spectral shape analyzer 2184 may refrain from sending the second adjustment spectral shape parameter 176 because a decoder at a receiving device (e.g., the second device 106) may generate a synthesized reference signal based on a synthesized mid signal (e.g., a high-band portion of the synthesized mid signal).

The second adjustment spectral shape parameter 176 may fail to satisfy the threshold 2154 when the spectral shape difference is greater than the threshold spectral shape difference. When the spectral shape of the reference signal 2150 is distinct from the spectral shape of the mid signal 270 (e.g., the high-band portion of the mid signal 270), the spectral shape analyzer 2184 may send the second adjustment spectral shape parameter 176 because the decoder at the receiving device (e.g., the second device 106) may generate the synthesized reference signal by adjusting a spectral shape of the synthesized mid signal (e.g., the high-band portion of the synthesized mid signal) based on the second adjustment spectral shape parameter 176.

Figure 22:
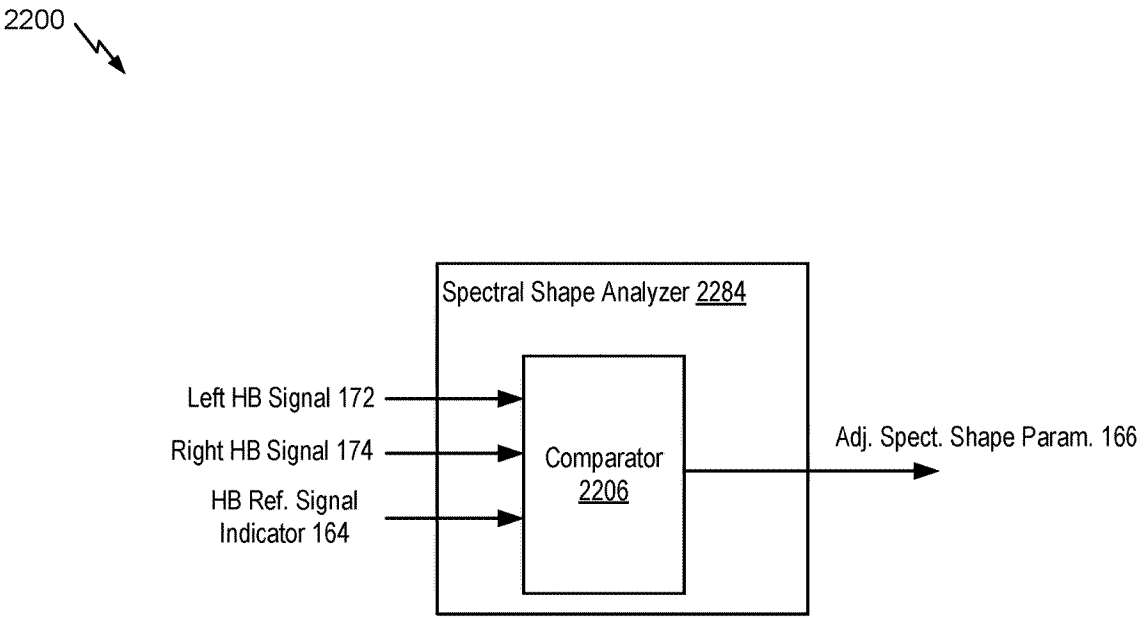
FIG. 22 is a diagram illustrating another example of a device of FIG. 1.

Referring to FIG. 22, an illustrative example of a device is shown and generally designated 2200. One or more components of the device 2200 may be included in the encoder 114, the first device 104, the system 100, or a combination thereof.

The device 2200 includes a spectral shape analyzer 2284. The spectral shape analyzer 2284 may correspond to the spectral shape analyzer 184 of FIG. 1. The spectral shape analyzer 2284 may include a comparator 2206.

The spectral shape analyzer 2284 may be configured to determine that one of the the left HB signal 172 or the right HB signal 174 corresponds to the non-reference signal 1550, as described with reference to FIG. 18. The spectral shape analyzer 2284 may determine that the other of the left HB signal 172 or the right HB signal 174 corresponds to a reference signal. The comparator 2206 may generate the adjustment spectral shape parameter 166 based on a comparison of the reference signal and the non-reference signal 1550. For example, the adjustment spectral shape parameter 166 may indicate a spectral shape difference between the reference signal and the non-reference signal 1550. The adjustment spectral shape parameter 166 may indicate the spectral shape difference by indicating a filter mapping, a LPC bandwidth expansion factor, or a split-band scaling of the high-band. In a particular aspect, the adjustment spectral shape parameter 166 may indicate the spectral shape difference by indicating a mapping from a spectral shape of the non-reference signal 1550 to a spectral shape of the reference signal (or vice versa).

The comparator 2206 may provide the adjustment spectral shape parameter 166 to the transmitter 110. In a particular aspect, the encoder 114 of FIG. 1 may refrain from generating the second adjustment spectral shape parameters 176.

Figure 23:
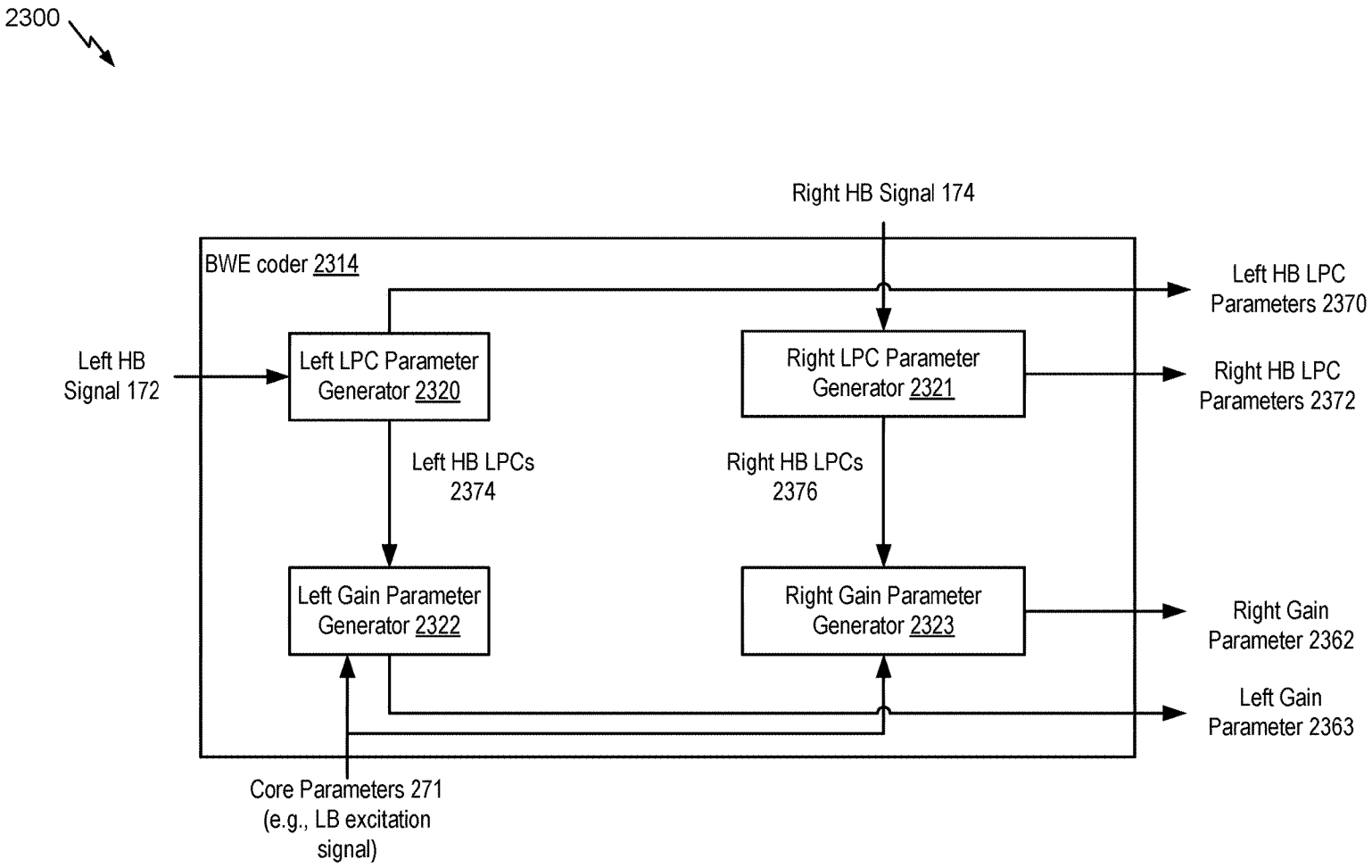
FIG. 23 is a diagram illustrating another example of a device of FIG. 1.

Referring to FIG. 23, an illustrative example of a device is shown and generally designated 2300. One or more components of the device 2300 may be included in the encoder 114, the first device 104, the system 100, or a combination thereof.

The device 2300 includes a BWE coder 2314. The BWE coder 2314 may correspond to the BWE spatial balancer 212, the mid BWE coder 214 of FIG. 2, or both. The BWE coder 2314 may include a left LPC parameter generator 2320 coupled to a left gain parameter generator 2322. The BWE coder 2314 may include a right LPC parameter generator 2321 coupled to a right gain parameter generator 2323.

The left LPC parameter generator 2320 may be configured to generate left HB LPCs 2374, left HB LPC parameters 2370, or both, based on the left HB signal 172. For example, the left LPC parameter generator 2320 may generate quantized left HB LSFs based on the left HB signal 172. The left LPC parameter generator 2320 may generate the left HB LPC parameters 2370 (e.g., a LSF index) corresponding to the quantized left HB LSFs based on a codebook. The left LPC parameter generator 2320 may provide the left HB LPC parameters 2370 (e.g., the LSF index) to the transmitter 110 of FIG. 1. The left LPC parameter generator 2320 may convert the quantized left HB LSFs to the left HB LPCs 2374. The left LPC parameter generator 2320 may provide the left HB LPCs 2374 to the left gain parameter generator 2322.

The left gain parameter generator 2322 may receive the left HB LPCs 2374 from the left LPC parameter generator 2320, the core parameters 271 (e.g., a LB excitation signal) from the LB mid core coder 220, or both. The left gain parameter generator 2322 may be configured to generate one or more left gain parameters 2363 based on the left HB LPCs 2374, the core parameters 271 (e.g., the LB excitation signal), or both. For example, the left gain parameter generator 2322 may generate the HB excitation signal 460 of FIG. 4 based on the core parameters 271, as described with reference to FIG. 4.

The left gain parameter generator 2322 may generate a synthesized left HB signal based on the left HB LPCs 2374 and the HB excitation signal 460. For example, the left gain parameter generator 2322 may generate the synthesized left HB signal by configuring a synthesis filter using the HB LPCs 2374 and providing the HB excitation signal 460 as an input to the synthesis filter.

The left gain parameter generator 2322 may determine the left gain parameters 2363 based on a comparison of the left HB signal 172 and the synthesized left HB signal. The left gain parameters 2363 (e.g., a left gain frame index, a left gain shapes index, or both) may indicate a gain difference of the left HB signal 172 relative to the synthesized left HB signal. The left gain parameter generator 2322 may provide the left gain parameters 2363 to the transmitter 110 of FIG. 1.

The right LPC parameter generator 2321 may be configured, similarly to the left LPC parameter generator 2320, to generate right HB LPCs 2376, right HB LPC parameters 2372, or both, based on the right HB signal 174. The right LPC parameter generator 2321 may provide the right HB LPCs 2376 to the right gain parameter generator 2323, the right HB LPC parameters 2372 to the transmitter 110, or both. The right gain parameter generator 2323 may be configured, similarly to the left gain parameter generator 2322, to generate a right gain parameter 2362 based on the right HB LPCs 2376, the core parameters 271, or both. The right gain parameter generator 2323 may provide the right gain parameter 2362 to the transmitter 110.

The transmitter 110 may be configured to transmit the left HB LPC parameters 2370, the right HB LPC parameters 2372, the right gain parameter 2362, the left gain parameter 2363, or a combination thereof. In a particular aspect, the encoder 114 may refrain from generating the LPC parameters 102, the set of first gain parameters 162, or both, corresponding to the mid signal 270. The transmitter 110 may refrain from transmitting the LPC parameters 102, the set of first gain parameters 162, or both.

FIGS. 1-23 therefore illustrate examples of devices and architectures that can be used for encoding the upper band of multiple channel inputs to a coder. As described with reference to the multi-channel encoder of FIG. 2, the downmix module (the signal path from the signal pre-processor 202 to the midside generator 210) may be configured to produce mid and side signals at an input sampling rate ($FS_{in}$). This mid and side are further split into two bands (the LB and the HB). The low-band may span frequencies from 0-8 kHz and the high-band may span frequencies above 8 kHz (e.g., 8-16 kHz). For coding the mid channel, a split band BWE based approach may be used, for example, the low-band mid signal ($Mid@FS_{core}$) may be coded using an algebraic code-excited linear prediction (ACELP) core coder and the $mid_{HB}$ may be coded using a BWE technique (like time-domain bandwidth extension). The low-band side signal ($Side@FS_{core}$) may be coded using any signal coding techniques.

Explicit waveform coding of the high-band side signal is unnecessary because signal phase perception in the high-band is greatly lower than for low-band, hence an inter-channel spatial balancer (e.g., the BWE spatial balancer 212 of FIG. 2) can be used to map/derive the high-band channels from the $mid_{HB}$. In the examples depicted in FIGS. 2-23, coding of stereo (2-channel) high-band content is described, but the examples may be extended to the case of more than two channels. For the case of coding stereo (2-channel) content, encoding may be performed using the assumption that the $mid_{HB}$ would be fairly similar to the dominant channel's HB signal ($L_{HB}$ or $R_{HB}$).

Thus, on the encoder, the inter-channel spatial balancer may be configured to determine a high-band reference channel ($Ref_{HB}$) which fits the assumption that $mid_{HB}$ is approximately similar in energy level and the spectral shape to $Ref_{HB}$, and the other channel is referred to as the high-band non-reference channel $NonRef_{HB}$. The inter-channel spatial balancer may also be configured to determine a gain mapping from the $Ref_{HB}$ to the $NonRef_{HB}$. The inter-channel spatial balancer may also be configured to determine a spectral shape mapping from the $Ref_{HB}$ to the $NonRef_{HB}$.

Several methods are described for choosing the high-band reference channel. For example, as described with reference to FIG. 8, the high-band reference may be based on the down mix gain of the low-band, e.g., when $g_D$<=1, $Ref_{HB}$=Left and when $g_D$>1, $Ref_{HB}$=Right. In such implementations, there is no need to transmit an additional, dedicated bit to indicate the HB reference. In other alternative implementations, the reference could be chosen based in the LB interchannel gains estimated in a subset of bands. In a particular example, such as described with reference to FIG. 7B, the HB reference may be determined based on the energies of the left channel and the right channel. As another example, such as described with reference to FIG. 7A, the HB reference may be determined based on the energies of the $L_{HB}$ and the $R_{HB}$ signals. The HB reference signal indicator 164 that indicates reference channel of the HB can be either explicitly transmitted as a bit or implicitly transmitted as a gain parameter which can span from negative to positive ranges in decibels (dB). A positive gain in dB could indicate that the left channel HB has higher energy than the right channel HB and vice versa. When reference signal indicator 164 is transmitted as an explicit bit, the first set of adjustment gain parameters 168 could be an absolute value of the gain difference in decibels. The HB reference signal indicator 164, whether transmitted explicitly, transmitted implicitly, or determined at the decoder based on the down mix gain of the low-band (e.g., $g_D$), may be used at the decoder to map synthesized Ref and NonRef signals to Left and Right signals, such as by using a selector as described in further detail with reference to FIGS. 29-31.

Several methods of estimating and transmitting the high-band inter channel gain are also described. For example, the relative energy ratio of the L and the R channels high-band signals can be quantized and transmitted, such as described with reference to FIG. 9. The relative energy ratio may be used at a gain adjuster of a decoder, such as described in further detail with reference to FIGS. 29, 31, and 35. Alternatively, the absolute energy of the $NonRef_{HB}$ channel can be quantized and transmitted, such as described with reference to FIG. 10. The first set of adjustment gain parameters 168 indicating absolute energy may be used at a gain adjuster of a decoder, such as described in further detail with reference to FIGS. 28, 29, and 34. The first set of adjustment gain parameters 168 can be transmitted as a modification factor to be applied on the mid channel Gain-Frame (when TBE is used as the BWE). Based on the relative energy ratio or based on the absolute energy of the $NonRef_{HB}$, the Gain Frame may applied during the Non-$Ref_{HB}$ channel generation process, such as described in further detail with reference to FIGS. 29-31.

Other methods of estimating and transmitting the high-band inter channel gain include predicting the high-band relative gain (on the encoder and on the decoder) from the low-band gain differences, such as described with reference to FIG. 11 and such as described in further detail with reference to FIGS. 35 and 37. For example, if g_downmix=7 dB, g_high-band can be 7*2 dB. Alternatively, a prediction factor could be transmitted. As another example, a prediction may be made with enhanced accuracy (at the encoder and the decoder) of the high-band relative gain difference based on the g_downmix and based on the inter channel spectral shape differences between $L_{HB}$ and $R_{HB}$, such as described with reference to FIG. 12. In a particular example, gain frame parameters corresponding to one channel may be transmitted as the first set of adjustment gain parameters 168, as described with reference to FIGS. 9-12 and 15-16. A predicted second set of adjustment parameters indicating gain frame parameters corresponding to the other channel may be determined (at the decoder) based on the first set of adjustment gain parameters 168, as described with reference to FIGS. 26-27.

Several methods of implementing high-band inter channel spectral shape mapping are also described. For example, spectral shape mapping can be a tilt mapping filter (H(z)) with one or more filter coefficients that can be transmitted, such as described with reference to FIG. 18. For example, $H(z)=1/(1+uz^{-1})$ where u is transmitted as the adjustment spectral shape parameter 166. In this example, $Ref_{HB}(t)=mid_{HB}(t)$, and $NonRef_{HB}(t)$ is the filtered $mid_{HB}(t)$ through the filter H(z) at the decoder, such as described in further detail with reference to FIG. 38.

Figure 29:
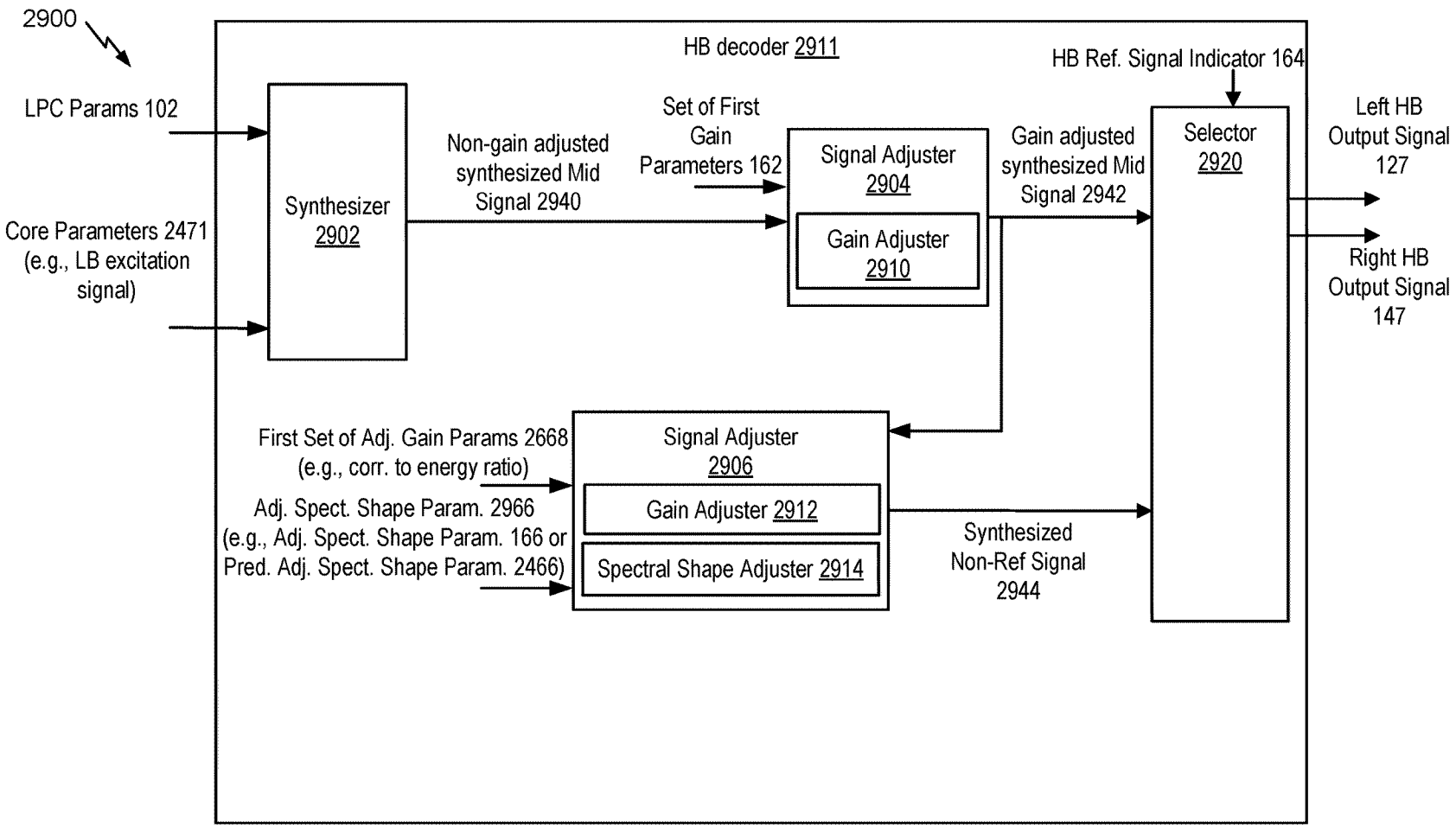
FIG. 29 is a diagram illustrating another example of a device of FIG. 1.

As another example, spectral shape (e.g., tilt) mapping coefficients could be predicted on the encoder/decoder from the high-band relative gain differences and/or the downmix gain, such as with reference to FIG. 19 (at an encoder) and FIG. 29 (at a decoder). In an implementation where TBE is used as the BWE model for high-band coding, spectral shape mapping can be performed based on a LPC bandwidth expansion factor that is either transmitted or predicted, such as with reference to FIG. 18 (at an encoder) and FIG. 39 (at a decoder). As an illustrative example, $mid_{HB}(t)=(1/A_{MID}(z))*exc_{HB}(t)$, $Ref_{HB}(t)=mid_{HB}(t)$, and $NonRef_{HB}(t)=(1/A_{NONREF}(z))*exc_{HB}(t)$, where $(1/A(z))$ represents LPC synthesis filtering through an LPC filter represented in the z-transform domain. In an example where $A(z)=(1+a_{1Z}^{-1}+a_{2Z}^{-2}+\ldots+a_{MZ}^{-M})$, where M denotes the LPC order, bandwidth expansion of A(z) can be performed as: $A_{NONREF}(Z)=(1+\gamma^1 a_{1Z}^{-1}+\gamma^2 a_{2Z}^{-2}+\ldots+\gamma^M a_{MZ}^{-M})$, where $\gamma$ is the bandwidth expansion factor, which may be transmitted from the encoder to the decoder. As another example, spectral shape (e.g., tilt) mapping from the mid to the left and the right channels can be transmitted or predicted, such as described with reference to FIG. 21 (at an encoder) and FIG. 31 (at a decoder), such as when the spectral shape (e.g., tilt) of the mid is not close to the spectral shape (e.g., tilt) of the left channel and is also not close to the spectral shape (e.g., tilt) of the right channels.

Another alternative implementation of the high-band gain framework is that the mid channel's high-band is coded, then the gain mapping parameters from the mid to each of the channels may be transmitted. Here, the mid channel's gain frame is also transmitted (as the set of first gain parameters 162) and two separate gain mapping parameters are transmitted, such as described with reference to the first set of adjustment gain parameters 168 and the second set of adjustment gain parameters 178 of FIG. 13 (at an encoder) and FIG. 31 (at a decoder).

An alternative implementation of the high-band spectral shape framework is that the mid channel's high-band is coded, then the spectral shape mapping parameters from the mid to each of the channels may be transmitted. The mid channel's spectral shape information (e.g., LPCs of the HB) may also be transmitted and two separate spectral shape mapping parameters are transmitted, such as described with reference to the adjustment spectral shape parameter 166 and the second adjustment spectral shape parameter 176 of FIG. 20 (at an encoder) and FIG. 31 (at a decoder).

Another alternative implementation of the high-band gain framework is that two separate gain frame parameters may be transmitted, e.g., one gain frame parameter for each for the Left and Right channels, and no gain parameter is transmitted for the mid channel, such as described with reference to FIG. 14. When the decoder (e.g., the decoder of FIG. 31 configured to omit the set of first gain parameters 162) is set up to play out the mid channel, a simple high-band downmix could be performed at the decoder, such as according to $M_{HB}=(L_{HB}+R_{HB})/2$. The high-band downmix may correspond to low-band downmix used to generate the low-band mid signal. For example, the mid signal may be generated according to $M=(L+R)/2$.

Another alternative implementation of the high-band spectral shape framework is that two separate spectral shape information parameters are transmitted (e.g., LPCs), one each for the Left and Right channels, and no LPCs for the mid channel is transmitted, such as described with reference to FIG. 23. When the decoder is set up to play out the mid channel, a simple high-band downmix could be performed, such as according to $M_{HB}=(L_{HB}+R_{HB})/2$.

In implementations where separate L and R channel high-band gain and high-band spectral shape information is transmitted, the concept of a reference high-band channel may be omitted.

Figure 24:
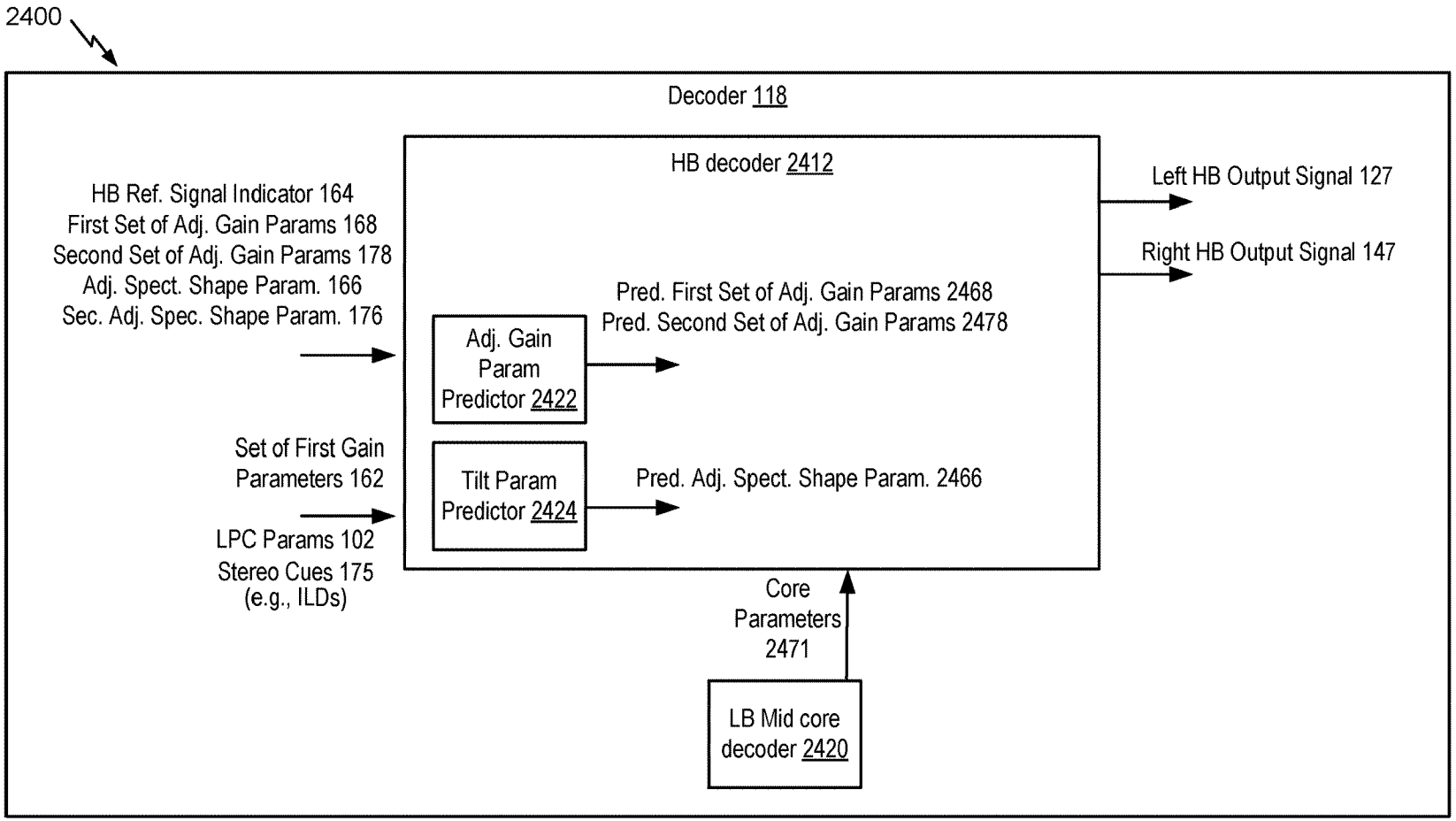
FIG. 24 is a diagram illustrating another example of a device of FIG. 1.

FIG. 24 depicts a particular example 2400 of a decoder, such as the decoder 118 of FIG. 1, that may be configured to perform signal decoding based on the implementations described above with reference to FIGS. 1-23. The decoder 118 includes a core decoder for a low-band portion of a received encoded Mid signal (LB Mid core decoder) 2420 coupled to a high-band (HB) decoder 2412. The LB Mid core decoder 2420 is configured to receive an encoded low-band portion of a Mid signal and to generate a synthesized version of the low-band portion of the Mid signal.

The HB decoder 2412 is configured to receive encoded signal information such as the set of first gain parameters 162 and the LPC parameters 102 of FIG. 1. The HB decoder 2412 may also receive the HB reference signal indicator 164, the first set of adjustment gain parameters 168, the second set of adjustment gain parameters 178, the adjustment spectral shape parameter 166, the second adjustment spectral shape parameter 176, the stereo cues 175, or a combination thereof. The HB decoder 2412 may also be configured to receive one or more core parameters 2471, such as a residual or excitation signal, from the LB Mid core decoder 2420.

The HB decoder 2412 may include an adjustment gain parameter predictor 2422. The adjustment gain parameter predictor 2422 is configured to generate a predicted first set of adjustment gain parameters 2468, a predicted second set of adjustment gain parameters 2478, or a combination thereof. Example implementations of the adjustment gain parameter predictor 2422 are described with reference to FIGS. 25-27.

The HB decoder 2412 may include a tilt parameter predictor 2424. The adjustment gain parameter predictor 2422 is configured to generate a predicted adjustment spectral shape parameter 2466 based on the stereo cues 175, as described with reference to FIG. 28.

The HB decoder 2412 is configured to generate a synthesized version of the left HB output signal 127 and a synthesized version of the right HB output signal 147. Example implementations of the HB decoder 2412 and components thereof are described with reference to FIGS. 29-39.

By generating the left HB output signal 127 and the right HB output signal 147 without receiving separate sets of LPC parameters for the high-band portion of the left signal and for the high-band portion of the right signal, stereo signals may be synthesized using reduced transmission bandwidth as compared to a system that uses separate sets of LPC parameters for the left and right high-band portions.

Figure 25:
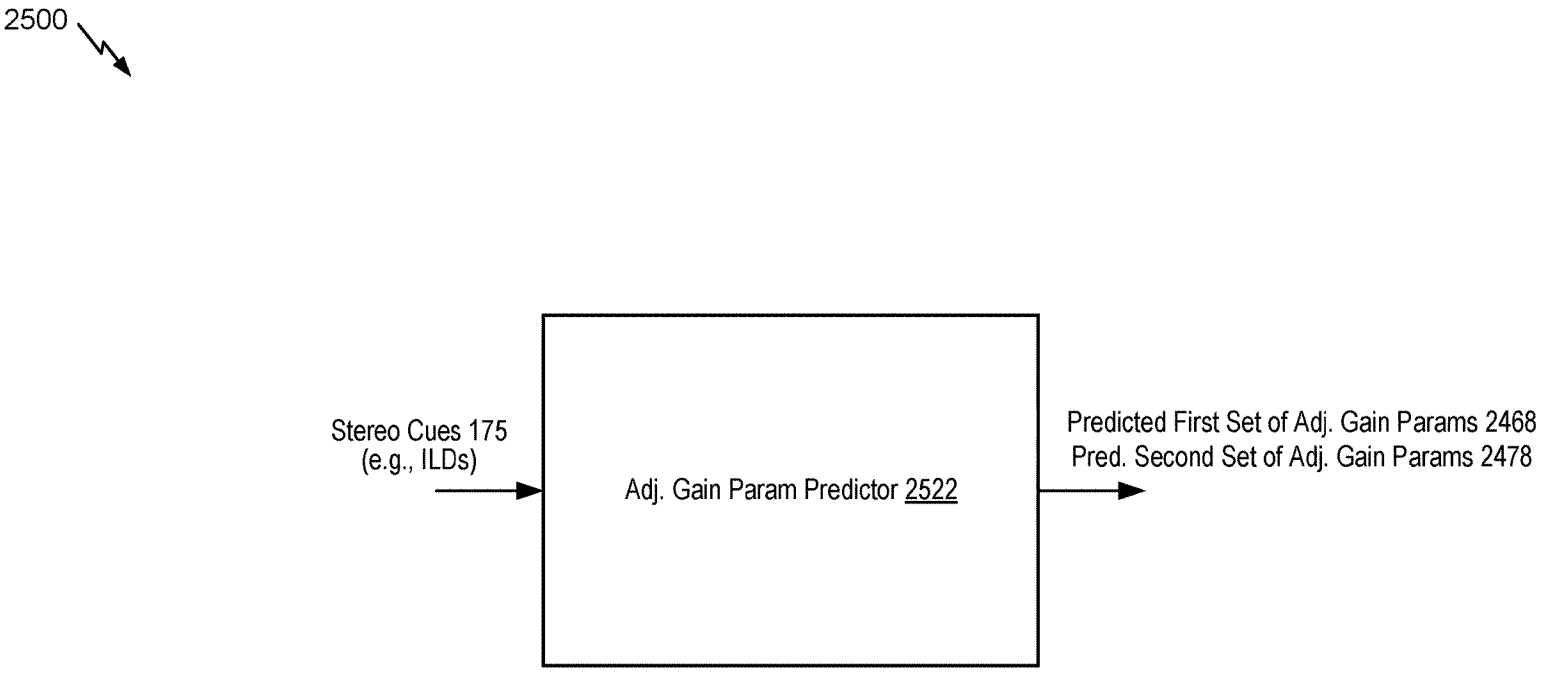
FIG. 25 is a diagram illustrating another example of a device of FIG. 1.

Referring to FIG. 25, an illustrative example of a device is shown and generally designated 2500. One or more components of the device 2500 may be included in the decoder 118, the second device 106, the system 100, or a combination thereof.

The device 2500 includes an adjustment gain parameter predictor 2522. The adjustment gain parameter predictor 2522 may correspond to the adjustment gain parameter predictor 2422 of FIG. 24. The adjustment gain parameter predictor 2522 may be configured to generate the predicted first set of adjustment gain parameters 2468, the predicted second set of adjustment gain parameters 2478, or both, based on the stereo cues 175. The stereo cues 175 may include ILD parameter values, as described with reference to FIG. 1.

The adjustment gain parameter predictor 2522 may generate the predicted first set of adjustment gain parameters 2468, the predicted second set of adjustment gain parameters 2478, or both, based on the ILD parameter values, as described herein. A first ILD parameter value of the stereo cues 175 may indicate a ratio (e.g., 3) of energy (e.g., 1.5) of a first frequency range of the left HB signal 172 and energy (e.g., 0.5) of the first frequency range of the right HB signal 174. A second ILD parameter value of the stereo cues 175 may indicate a ratio of energy of a second frequency range of the left HB signal 172 and energy of the second frequency range of the right HB signal 174.

The adjustment gain parameter predictor 2522 may determine a first predicted parameter value of the predicted first set of adjustment gain parameters 2468 and a first particular predicted parameter value of the predicted second set of adjustment gain parameters 2478 based on the first ILD parameter value (e.g., 3). For example, the adjustment gain parameter predictor 2522 may multiply the first ILD parameter value by a first factor to determine the first predicted parameter value. The first predicted parameter value may indicate a ratio of the energy of the first frequency range of the left HB signal 172 and energy of the first frequency range of the mid signal 270 of FIG. 2.

The adjustment gain parameter predictor 2522 may multiple the first ILD parameter value by a second factor to determine the first particular predicted parameter value. The first particular predicted parameter value may indicate a ratio of the energy of the first frequency range of the right HB signal 174 and energy of the first frequency range of the mid signal 270 of FIG. 2. The adjustment gain parameter predictor 2522 may determine, based on the second ILD parameter value, a second predicted parameter value of the predicted first set of adjustment gain parameters 2468, a second particular predicted value of the predicted second set of adjustment gain parameters 2478, or both.

In a particular aspect, the decoder 118 may generate the predicted first set of adjustment gain parameters 2468, the predicted second set of adjustment gain parameters 2478, or a combination thereof, in response to determining that encoded signal information indicates the stereo cues 175 and that the first set of adjustment gain parameters 168, the second set of adjustment gain parameters 178, or a combination thereof are absent from (e.g., not indicated by) the encoded signal information.

Figure 26:
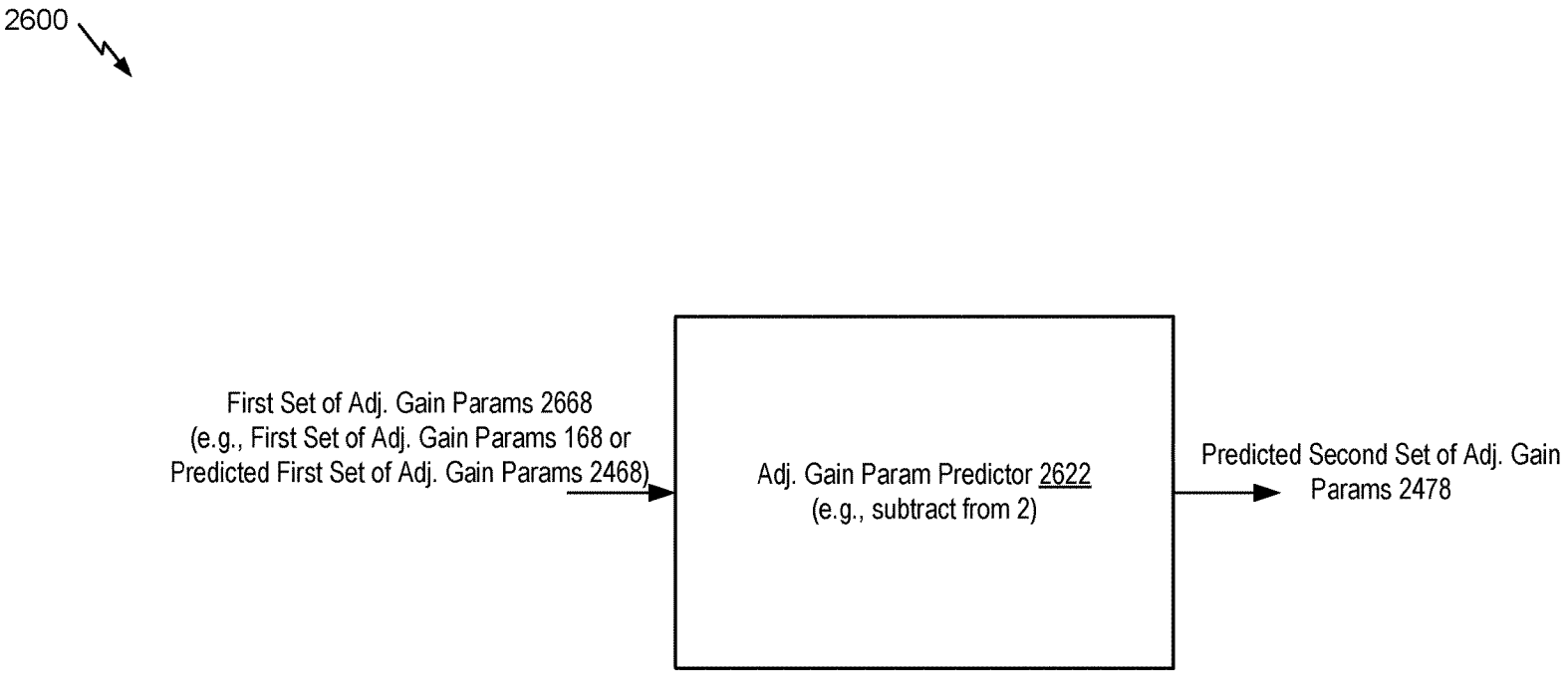
FIG. 26 is a diagram illustrating another example of a device of FIG. 1.

Referring to FIG. 26, an illustrative example of a device is shown and generally designated 2600. One or more components of the device 2600 may be included in the decoder 118, the second device 106, the system 100, or a combination thereof.

The device 2600 includes an adjustment gain parameter predictor 2622. The adjustment gain parameter predictor 2622 may correspond to the adjustment gain parameter predictor 2422 of FIG. 24. The adjustment gain parameter predictor 2622 is configured to generate the predicted second set of adjustment gain parameters 2478 based on the first set of adjustment gain parameters 2668, as described herein. The first set of adjustment gain parameters 2668 may include the first set of adjustment gain parameters 168 or the predicted first set of adjustment gain parameters 2468. In a particular aspect, the decoder 118 may generate the predicted second set of adjustment gain parameters 2478 in response to determining that encoded signal information indicates the first set of adjustment gain parameters 168 and that the second set of adjustment gain parameters 178 is absent from (e.g., not indicated by) the encoded signal information.

The adjustment gain parameter predictor 2622 may determine the predicted second set of adjustment gain parameters 2478 by applying a function (e.g., subtraction, multiplication, division, or addition) to the first set of adjustment gain parameters 2668. For example, the adjustment gain parameter predictor 2622 may determine the predicted second set of adjustment gain parameters 2478 (e.g., 1.5) by subtracting the first set of adjustment gain parameters 2668 (e.g., 0.5) from a particular value (e.g., 2).

In a particular aspect, the first set of adjustment gain parameters 2668 may indicate a difference between energy of the non-reference signal 1550 and energy of the mid signal 270, as described with reference to FIG. 15. The energy of the mid signal 270 may be between (e.g., in the middle of) the energy of the non-reference signal 1550 and energy of the reference signal 2150. In this aspect, the predicted second set of adjustment gain parameters 2478 may indicate a difference between the energy of the reference signal 2150 and the energy of the mid signal 270.

Figure 27:
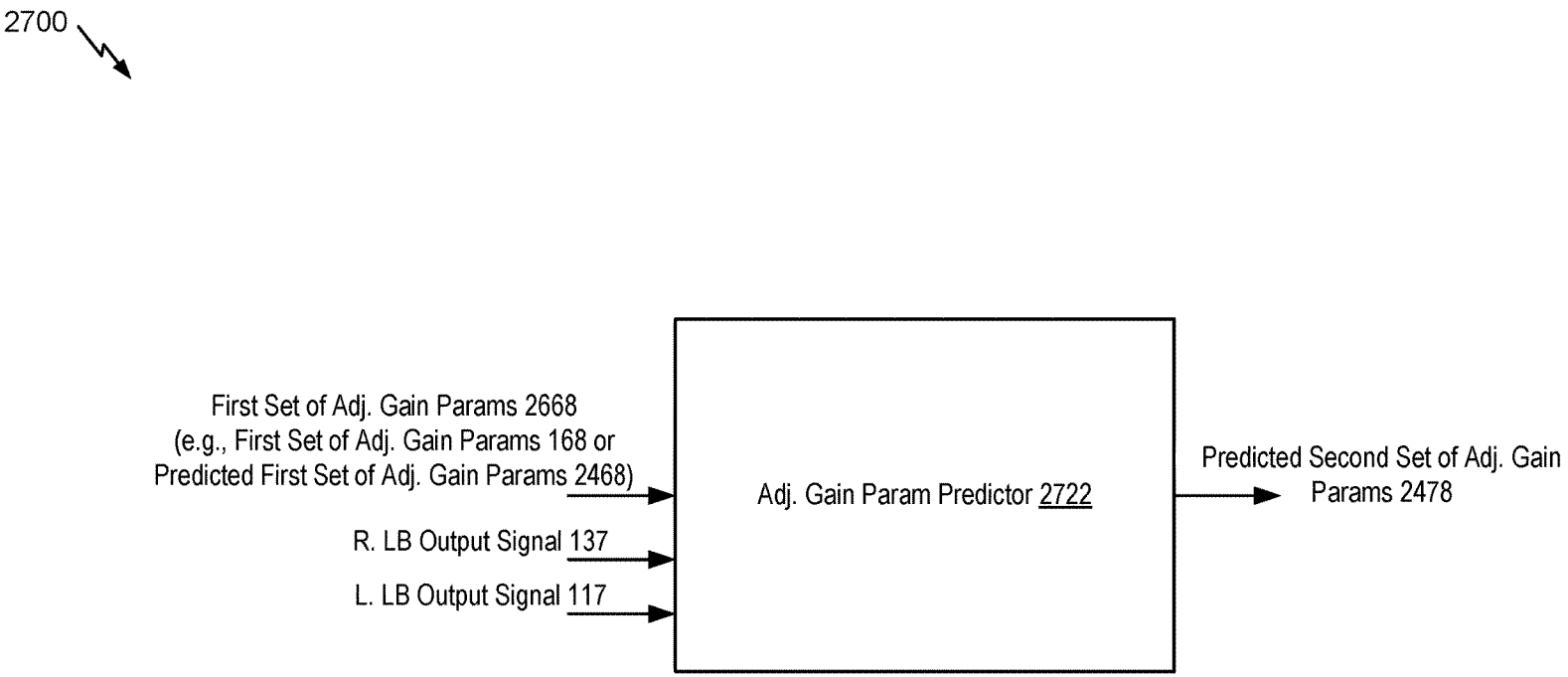
FIG. 27 is a diagram illustrating another example of a device of FIG. 1.

Referring to FIG. 27, an illustrative example of a device is shown and generally designated 2700. One or more components of the device 2700 may be included in the decoder 118, the second device 106, the system 100, or a combination thereof.

The device 2700 includes an adjustment gain parameter predictor 2722. The adjustment gain parameter predictor 2722 may correspond to the adjustment gain parameter predictor 2422 of FIG. 24. The adjustment gain parameter predictor 2722 is configured to generate the predicted second set of adjustment gain parameters 2478 based on the first set of adjustment gain parameters 2668, the right LB output signal 137, the left LB output signal 117, or a combination thereof, as described herein. In a particular aspect, the adjustment gain parameter predictor 2722 may generate the predicted second set of adjustment gain parameters 2478 based on the first set of adjustment gain parameters 2668, the right LB output signal 137, the left LB output signal 117, or a combination thereof, in response to determining that the HB reference signal indicator 164 of FIG. 1 (or a non-reference signal indicator) has a particular value (e.g., 0) indicating that a left channel corresponds to the HB non-reference channel.

The adjustment gain parameter predictor 2722 may generate the predicted second set of adjustment gain parameters 2478 based on the following Equation:

$$G_2 = G_1 * \frac{E_L}{E_R} \qquad \text{Equation 8}$$

where $G_2$ corresponds to the predicted second set of adjustment gain parameters 2478, $G_1$ corresponds to the first set of adjustment gain parameters 2668, $E_L$ corresponds to energy of the left LB output signal 117, and $E_R$ corresponds to energy of the right LB output signal 137.

Figure 28:
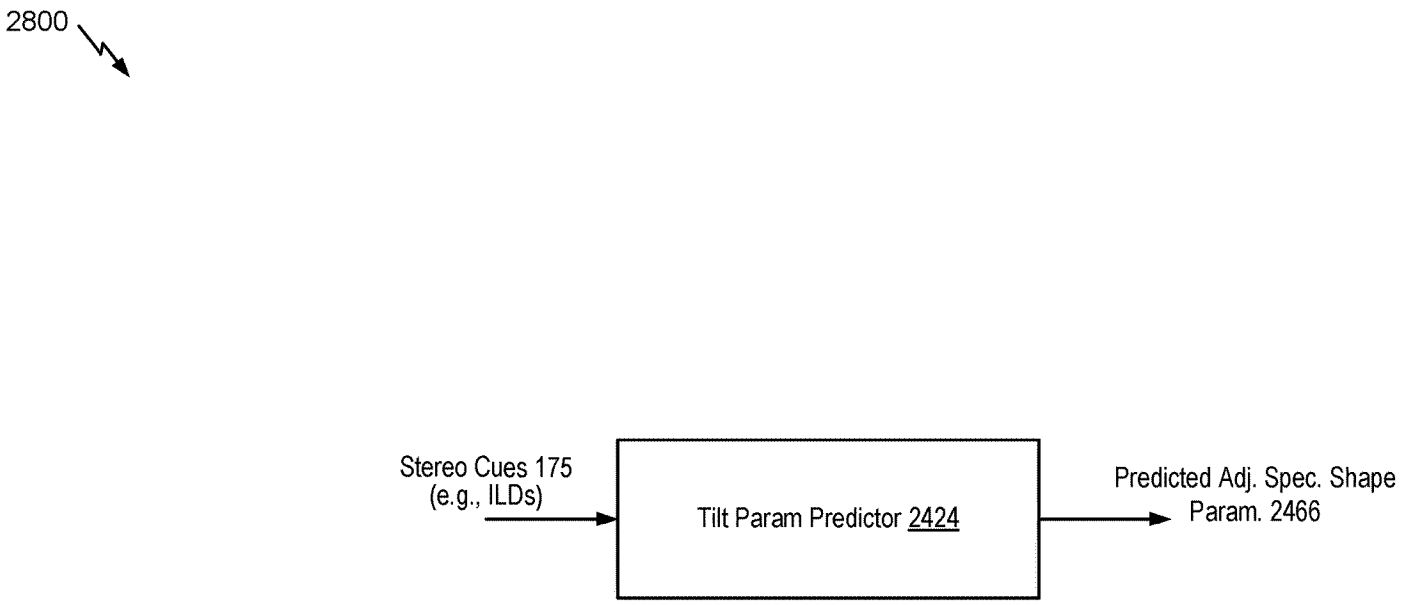
FIG. 28 is a diagram illustrating another example of a device of FIG. 1.

Referring to FIG. 28, an illustrative example of a device is shown and generally designated 2800. One or more components of the device 2800 may be included in the decoder 118, the second device 106, the system 100, or a combination thereof.

The device 2800 includes the tilt parameter predictor 2424. The tilt parameter predictor 2424 is configured to generate the predicted adjustment spectral shape parameter 2466 based on the stereo cues 175, as described herein.

The stereo cues 175 may include ILD parameter values, as described with reference to FIG. 1. The tilt parameter predictor 2424 may generate the predicted adjustment spectral shape parameter 2466 based on the ILD parameter values. For example, the tilt parameter predictor 2424 may generate the predicted adjustment spectral shape parameter 2466 by performing curve fitting based on the ILD parameter values.

In a particular aspect, the decoder 118 may generate the predicted adjustment spectral shape parameter 2466 in response to determining that encoded signal information indicates the stereo cues 175 and that the adjustment spectral shape parameter 166, the second adjustment spectral shape parameter 176, or both are absent from (e.g., not indicated by) the encoded signal information.

Referring to FIG. 29, an illustrative example of a device is shown and generally designated 2900. One or more components of the device 2900 may be included in the decoder 118, the second device 106, the system 100, or a combination thereof.

The device 2900 includes a HB decoder 2911. The HB decoder 2911 may correspond to the HB decoder 2412 of FIG. 24. The HB decoder 2911 includes a synthesizer 2902 coupled to a signal adjuster 2904. The signal adjuster 2904 may be coupled to a signal adjuster 2906. The signal adjuster 2904, the signal adjuster 2906, or both, may be coupled to a selector 2920. The signal adjuster 2904 may include a gain adjuster 2910. The signal adjuster 2906 may include a gain adjuster 2912, a spectral shape adjuster 2914, or both. The gain adjuster 2910, the gain adjuster 2912, or both, may correspond to the gain adjuster 183 of FIG. 1. The spectral shape adjuster 2914 may correspond to the spectral shape adjuster 185 of FIG. 1.

The synthesizer 2902 may be configured to generate a non-gain adjusted synthesized mid signal 2940 based on the LPC parameters 102, the core parameters 2471, or both, as further described with reference to FIG. 33. The synthesizer 2902 may provide the non-gain adjusted synthesized mid signal 2940 to the gain adjuster 2910. The gain adjuster 2910 may be configured to generate a gain adjusted synthesized mid signal 2942 (e.g., a modified non-linear harmonic high-band excitation of the mid signal) based on the non-gain adjusted synthesized mid signal 2940 and the set of first gain parameters 162, as further described with reference to FIG. 34. For example, the gain adjuster 2910 may apply an overall gain (e.g., gain frame), temporal gain shapes, or a combination thereof, to the non-gain adjusted synthesized mid signal 2940 to generate the gain adjusted synthesized mid signal 2942. The gain adjuster 2910 may provide the gain adjusted synthesized mid signal 2942 to the selector 2920, the signal adjuster 2906, or both.

The signal adjuster 2906 may be configured to generate a synthesized non-reference signal 2944 based on the first set of adjustment gain parameters 2668, an adjustment spectral shape parameter 2966, or both, as further described with reference to FIGS. 35-39. The adjustment spectral shape parameter 2966 may include the adjustment spectral shape parameter 166 or the predicted adjustment spectral shape parameter 2466. The first set of adjustment gain parameters 2668 may correspond to an energy ratio or an energy difference, as described with reference to FIG. 9. The signal adjuster 2906 may provide the synthesized non-reference signal 2944 to the selector 2920.

The selector 2920 may, based on the HB reference signal indicator 164, select one of the gain adjusted synthesized mid signal 2942 or the synthesized non-reference signal 2944 as the left HB output signal 127. The selector 2920 may select the other of the gain adjusted synthesized mid signal 2942 or the synthesized non-reference signal 2944 as the right HB output signal 147. For example, the selector 2920 may, in response to determining that the HB reference signal indicator 164 has a first value (e.g., 1), select the gain adjusted synthesized mid signal 2942 as the left HB output signal 127 and the synthesized non-reference signal 2944 as the right HB output signal 147.

Alternatively, the selector 2920 may, in response to determining that the HB reference signal indicator 164 has a second value (e.g., 0), select the gain adjusted synthesized mid signal 2942 as the right HB output signal 147 and the synthesized non-reference signal 2944 as the left HB output signal 127.

The selector 2920 may store one or more samples of the left HB output signal 127 and one or more samples of the right HB output signal 147. In a particular aspect, the selector 2920 may, from processing a first frame to processing a second frame, perform overlap add of a portion of the gain adjusted synthesized mid signal 2942 and a portion of the synthesized non-reference signal 2944 based on variations in the HB reference signal indicator 164. For example, the selector 2920 may perform overlap add of samples at frame boundaries for a smoother temporal evolution when the HB reference signal indicator 164 changes from a first value corresponding to a first frame to a second value corresponding to a next frame. In a particular aspect, the selector 2920 may perform overlap add of samples at frame boundaries for a smoother temporal evolution when a LB core coder mode is changed from one frame to the next frame. For example, the selector 2920 may perform overlap add of samples at frame boundaries in response to detecting that the LB core coder mode changed between a non-ACELP mode (e.g., a discontinuous transmission (DTX) mode, a transform-domain transform coded excitation (TCX)/modified discrete cosine transform (MDCT) coder) and an ACELP mode.

In a particular aspect, the spectral shape adjuster 2914 may be configured to, instead of receiving the adjustment spectral shape parameter 166 from the first device 104, estimate the adjustment spectral shape parameter 166 based on a gain parameter. For example, the spectral shape adjuster 2914 may generate the adjustment spectral shape parameter 166 by applying a factor to the gain parameter. The gain parameter may correspond to the gain parameter 261. The second device 106 may receive the gain parameter 261 from the first device 104. The gain parameter may correspond to a low-band gain parameter. For example, the gain parameter may be based on a left LB energy of the left LB output signal 117 and a right LB energy of the right LB output signal 137. To illustrate, the gain parameter may indicate a LB energy ratio (e.g., the left LB energy/the right LB energy) or a LB energy difference (e.g., the left LB energy−the right LB energy).

In a particular aspect, the gain parameter may correspond to a high-band gain parameter. For example, the gain parameter may be based on a left HB energy of the left HB signal 172 and a right HB energy of the right HB signal 174, as described with reference to FIG. 11. The gain parameter may include the first set of adjustment gain parameters 168.

Although FIG. 29 depicts the signal adjuster 2906 receiving the gain adjusted synthesized mid signal 2942, in another implementation, the signal adjuster 2906 instead receives the non-gain adjusted synthesized mid signal 2940.

Figure 30:
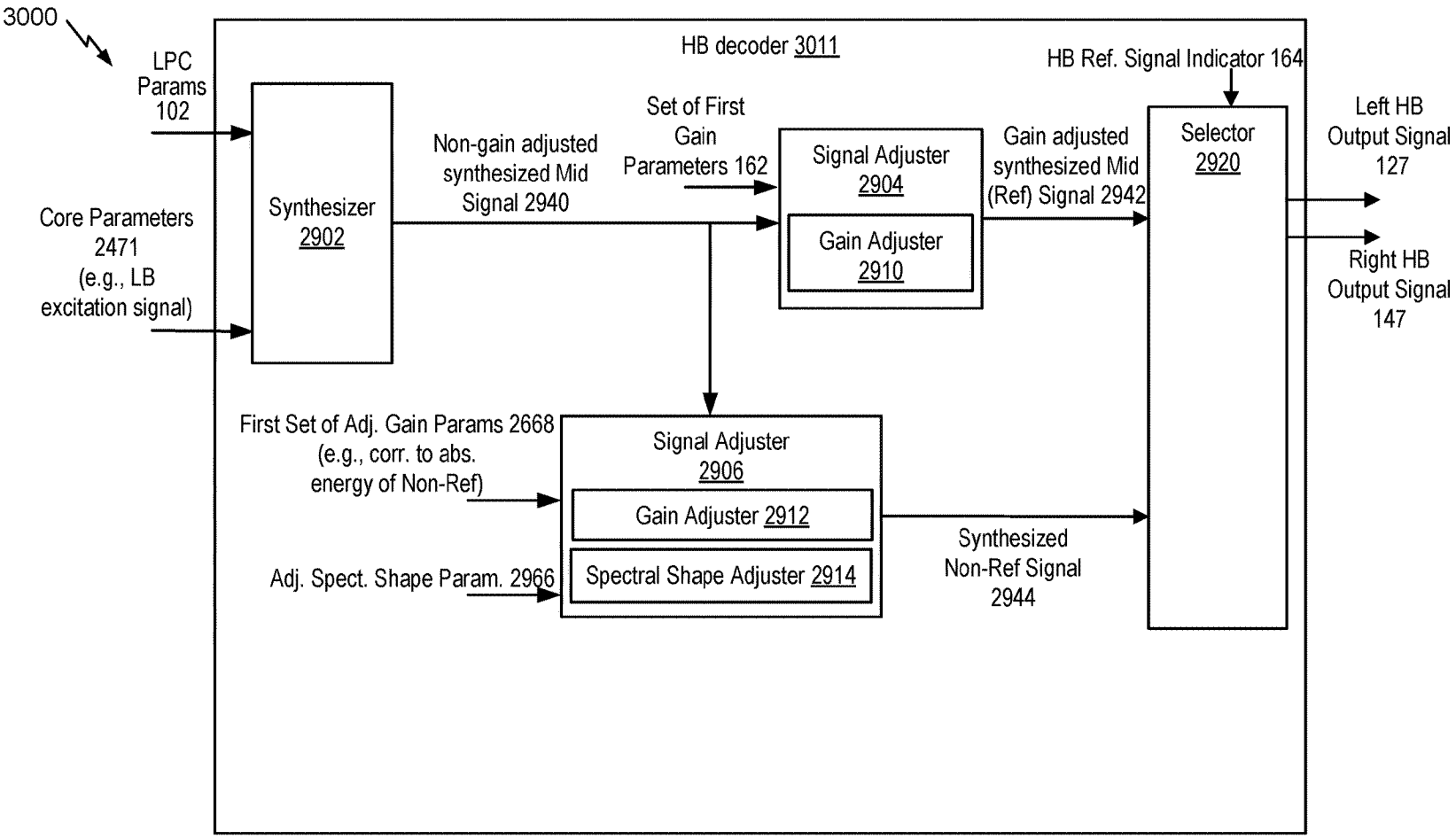
FIG. 30 is a diagram illustrating another example of a device of FIG. 1.

Referring to FIG. 30, an illustrative example of a device is shown and generally designated 3000. One or more components of the device 3000 may be included in the decoder 118, the second device 106, the system 100, or a combination thereof.

The device 3000 includes a HB decoder 3011. The HB decoder 3011 may correspond to the HB decoder 2412 of FIG. 24. The device 3000 may differ from the device 2900 in that the first set of adjustment gain parameters 2668 may correspond to an energy (e.g., absolute energy) of a non-reference signal, as described with reference to FIG. 10. Although FIG. 30 depicts the signal adjuster 2906 receiving the non-gain adjusted synthesized mid signal 2940, in another implementation, the signal adjuster 2906 instead receives the gain adjusted synthesized mid signal 2942.

The signal adjuster 2904 may generate a reference signal (e.g., the gain adjusted synthesized mid signal 2942) based on the set of first gain parameters 162. The signal adjuster 2906 may generate a non-reference signal (e.g., the synthesized non-reference signal 2944) based on the first set of adjustment gain parameters 2668 (e.g., the first set of adjustment gain parameters 168).

In a particular aspect, the set of first gain parameters 162 are based on the synthesized mid signal 362, as described with reference to FIG. 3. The synthesized mid signal 362 may correspond to a first weighting of a noise component to a harmonic component, as described with reference to FIG. 4. Consequently, the set of first gain parameters 162 based on the synthesized mid signal 362 and the reference signal (e.g., the gain adjusted synthesized mid signal 2942) based on the set of first gain parameters 162 may correspond to the first weighting.

In a particular aspect, the first set of adjustment gain parameters 168 are based on the synthesized mid signal 464, as described with reference to FIGS. 16-17. The synthesized mid signal 464 may correspond to a second weighting of a noise component to a harmonic component, as described with reference to FIG. 4. Consequently, the first set of adjustment gain parameters 168 based on the synthesized mid signal 464 and the non-reference signal (e.g., the synthesized non-reference signal 2944) based on the first set of adjustment gain parameters 168 may correspond to the second weighting. The HB decoder 3011 may thus generate a reference signal corresponding to a first weighting of a noise component to a harmonic component and a non-reference signal corresponding to a second weighting of a noise component to a harmonic component.

Figure 31:
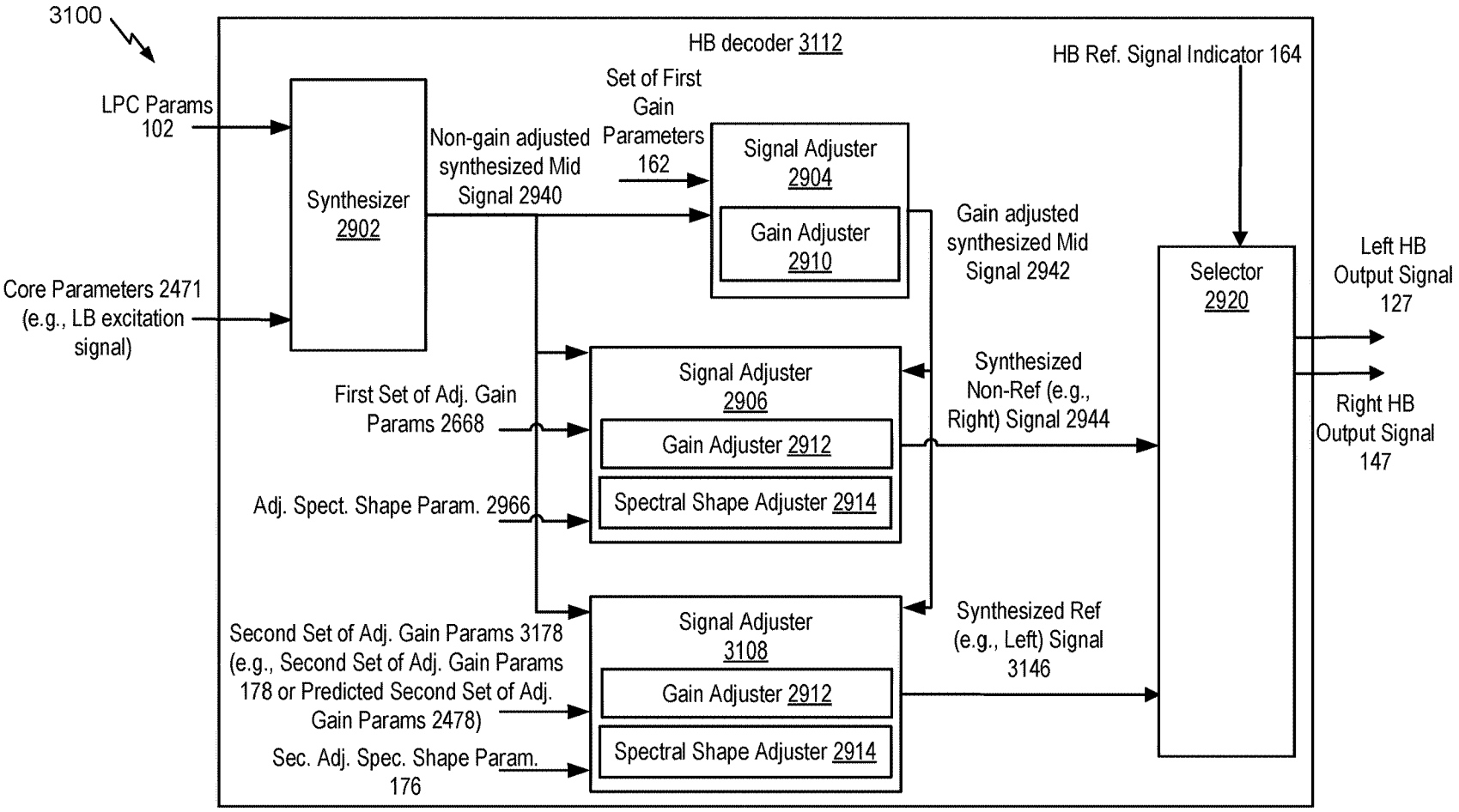
FIG. 31 is a diagram illustrating another example of a device of FIG. 1.

Referring to FIG. 31, an illustrative example of a device is shown and generally designated 3100. One or more components of the device 3100 may be included in the decoder 118, the second device 106, the system 100, or a combination thereof.

The device 3100 includes a HB decoder 3112. The HB decoder 3112 may correspond to the HB decoder 2412 of FIG. 24. The HB decoder 3112 may differ from the HB decoder 2911 in that the HB decoder 3112 may include a signal adjuster 3108. The synthesizer 2902 may be coupled to provide the non-gain adjusted synthesized mid signal 2940 to the signal adjuster 3108. Alternatively, the signal adjuster 2904 may be coupled to provide the gain adjusted synthesized mid signal 2942 to the signal adjuster 3108. The signal adjuster 3108 may include the gain adjuster 2912, the spectral shape adjuster 2914, or both (e.g., as components that are shared with the signal adjuster 2906 or as distinct (unshared) components having similar structure).

The signal adjuster 3108 may be configured to generate a synthesized reference signal 3146 based on a second set of adjustment gain parameters 3178, the second adjustment spectral shape parameter 176, or both, as further described with reference to FIGS. 35-39. The second set of adjustment gain parameters 3178 may include the second set of adjustment gain parameters 178 or the predicted second set of adjustment gain parameters 2478.

The selector 2920 may, based on the HB reference signal indicator 164, select one of the synthesized reference signal 3146 or the synthesized non-reference signal 2944 as the left HB output signal 127. The selector 2920 may select the other of the synthesized reference signal 3146 or the synthesized non-reference signal 2944 as the right HB output signal 147. For example, the selector 2920 may, in response to determining that the HB reference signal indicator 164 has a first value (e.g., 1), select the synthesized reference signal 3146 as the left HB output signal 127 and the synthesized non-reference signal 2944 as the right HB output signal 147. Alternatively, the selector 2920 may, in response to determining that the HB reference signal indicator 164 has a second value (e.g., 0), select the synthesized reference signal 3146 as the right HB output signal 147 and the synthesized non-reference signal 2944 as the left HB output signal 127.

Figure 32:
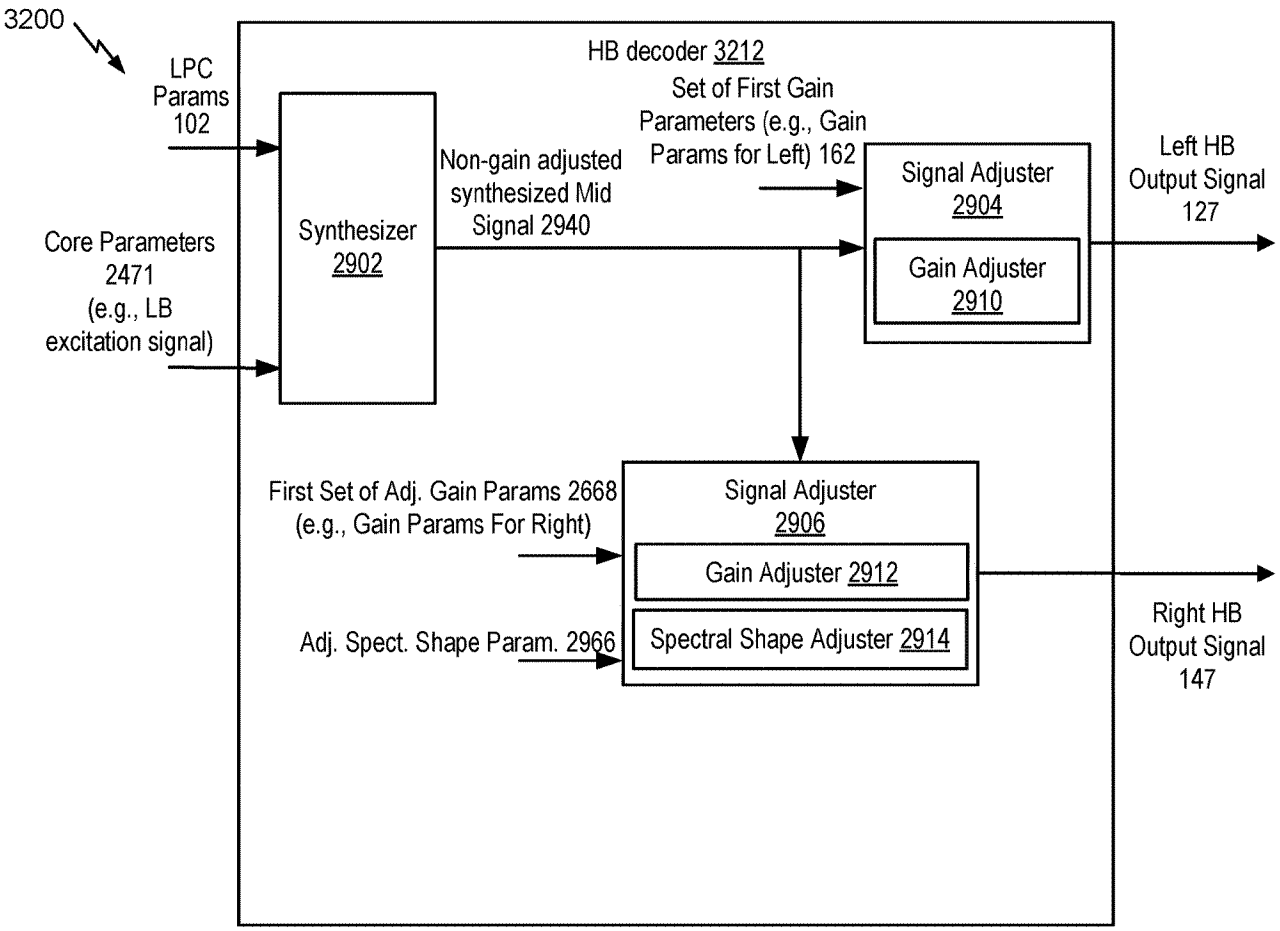
FIG. 32 is a diagram illustrating another example of a device of FIG. 1.

Referring to FIG. 32, an illustrative example of a device is shown and generally designated 3200. One or more components of the device 3200 may be included in the decoder 118, the second device 106, the system 100, or a combination thereof.

The device 3200 includes the HB decoder 3212. The HB decoder 3212 may differ from the HB decoder 2911 of FIG. 29 in that the gain adjusted synthesized mid signal 2942 may correspond to the left HB output signal 127 and the synthesized non-reference signal 2944 of FIG. 29 may correspond to the right HB output signal 147. The set of first gain parameters 162 may correspond to the left HB output signal 127. The first set of adjustment gain parameters 2668, the adjustment spectral shape parameter 2966, or both, may correspond to the right HB output signal 147.

Figure 33:
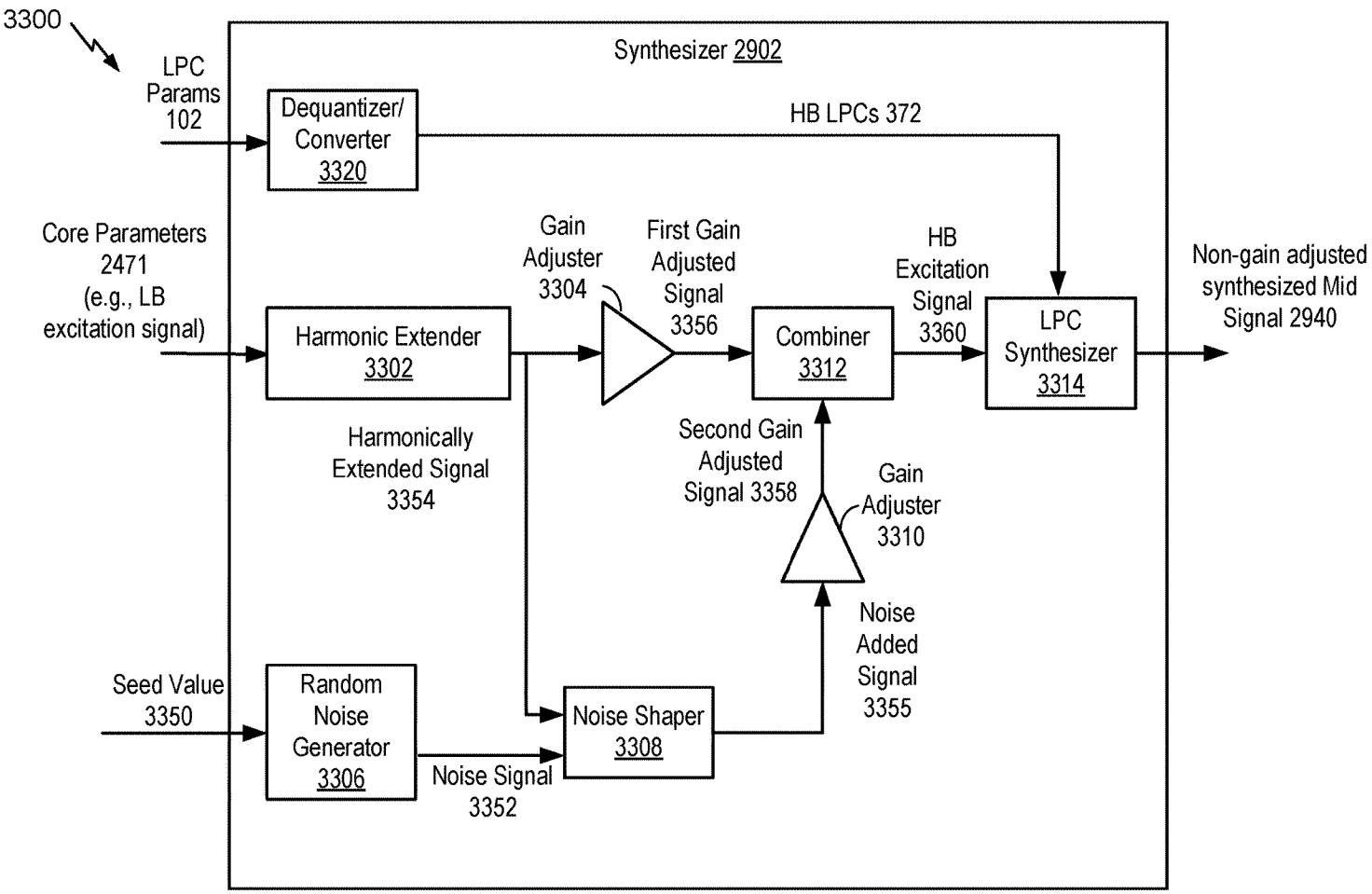
FIG. 33 is a diagram illustrating another example of a device of FIG. 1.

Referring to FIG. 33, an illustrative example of a device is shown and generally designated 3300. One or more components of the device 3300 may be included in the decoder 118, the second device 106, the system 100, or a combination thereof.

The device 3300 includes the synthesizer 2902. The synthesizer 2902 may include a dequantizer/converter 3320 coupled to a LPC synthesizer 3314. The synthesizer 2902 may include a harmonic extender 3302 coupled via a gain adjuster 3304 to a combiner 3312. The harmonic extender 3302 may also be coupled, via a noise shaper 3308 and a gain adjuster 3310, to the combiner 3312. The synthesizer 2902 may include a random noise generator 3306 coupled to the noise shaper 3308. The combiner 3312 may be coupled to the LPC synthesizer 3314. The synthesizer 2902 may be configured to operate similarly to the synthesizer 306 of FIG. 3.

During operation, the dequantizer/converter 3320 may generate the HB LPCs 372 based on the LPC parameters 102. For example, the LPC parameters 102 may include a HB LSF index. The dequantizer/converter 3330 may determine HB LSFs corresponding to the HB LSF index based on a codebook. The dequantizer/converter 3330 may convert the HB LSFs to the HB LPCs 372. The dequantizer/converter 3330 may provide the HB LPCs 372 to the LPC synthesizer 3314.

The synthesizer 2902 may generate a HB excitation signal 3360 based on a LB excitation signal and may generate the non-gain adjusted synthesized mid signal 2940 based on the HB excitation signal 3360 and the HB LPCs 372, as described herein. The harmonic extender 3302 may receive the core parameters 2471 from the LB Mid core decoder 2420 of FIG. 24. The core parameters 2471 may correspond to the LB excitation signal. The harmonic extender 3302 may generate a harmonically extended signal 3354 based on the core parameters 2471 by harmonically extending the LB excitation signal. The harmonic extender 3302 may provide the harmonically extended signal 3354 to the gain adjuster 3304, to the noise shaper 3308, or both.

The gain adjuster 3304 may generate a first gain adjusted signal 3356 by applying a first gain to the harmonically extended signal 3354. The gain adjuster 3304 may provide the first gain adjusted signal 3356 to the combiner 3312. The random noise generator 3306 may generate a noise signal 3352 based on a seed value 3350. The seed value 3350 may be the same as or distinct from the seed value 450 of FIG. 4. The random noise generator 3306 may provide the noise signal 3352 to the noise shaper 3308. The noise shaper 3308 may generate a noise added signal 3355 by combining the harmonically extended signal 3354 and the noise signal 3352. The noise shaper 3308 may provide the noise added signal 3355 to the gain adjuster 3310. The gain adjuster 3310 may generate a second gain adjusted signal 3358 by applying a second gain to the noise added signal 3355. The gain adjuster 3310 may provide the second gain adjusted signal 3358 to the combiner 3312. The combiner 3312 may generate the HB excitation signal 3360 by combining the first gain adjusted signal 3356 (e.g., a high-band portion of the first gain adjusted signal 3356) and the second gain adjusted signal 3358 (e.g., a high-band portion of the second gain adjusted signal 3358). The combiner 3312 may provide the HB excitation signal 3360 to the LPC synthesizer 3314.

The LPC synthesizer 3314 may generate the non-gain adjusted synthesized mid signal 2940 (e.g., a synthesized high-band mid signal) based on the HB LPCs 372 and the HB excitation signal 3360. For example, the LPC synthesizer 3314 may generate the non-gain adjusted synthesized mid signal 2940 by configuring a synthesis filter based on the HB LPCs 372 and providing the HB excitation signal 3360 as an input to the synthesis filter.

Figure 34:
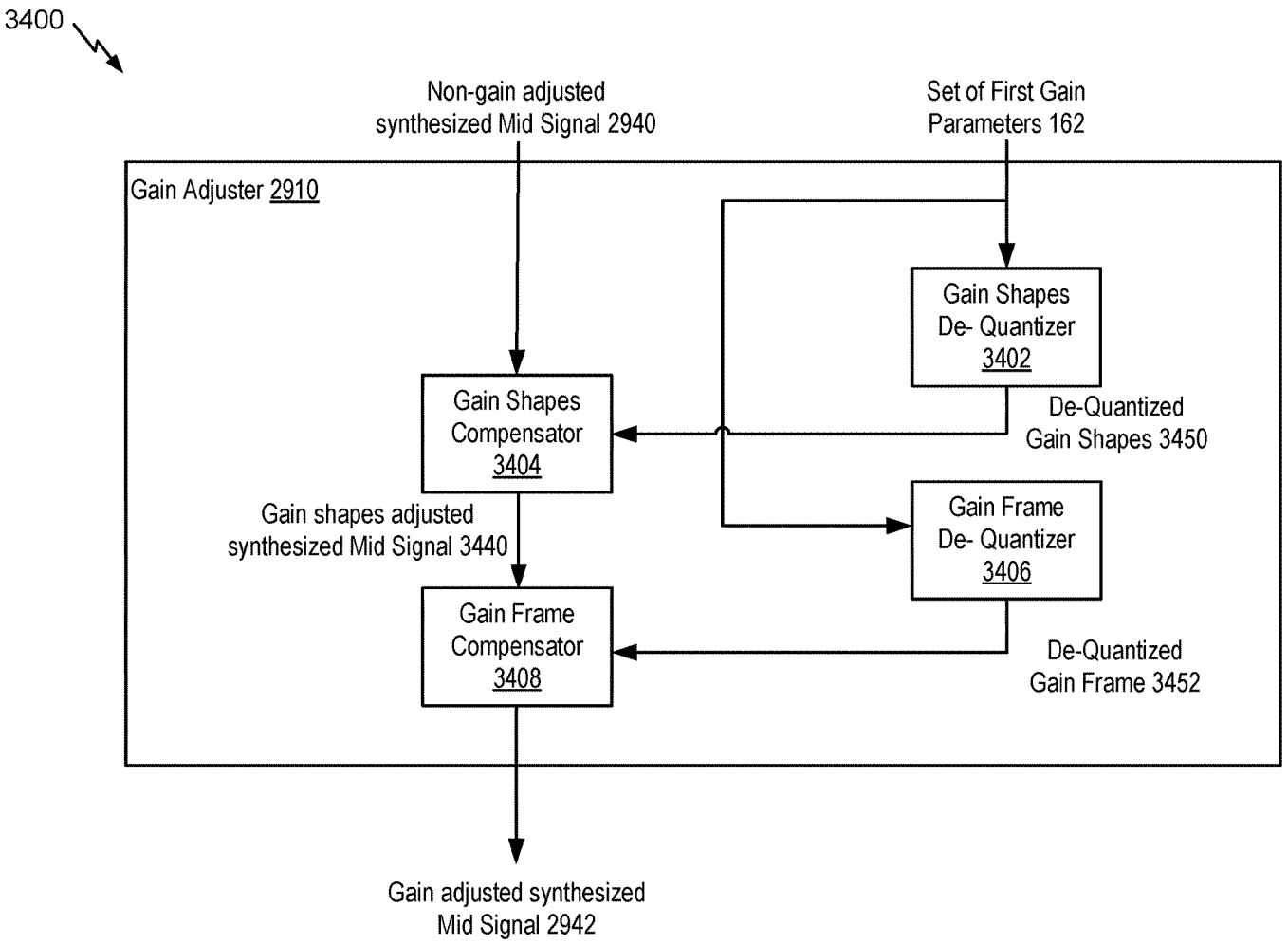
FIG. 34 is a diagram illustrating another example of a device of FIG. 1.

Referring to FIG. 34, an illustrative example of a device is shown and generally designated 3400. One or more components of the device 3400 may be included in the decoder 118, the second device 106, the system 100, or a combination thereof.

The device 3400 includes the gain adjuster 2910. The gain adjuster 2910 may include a gain shapes de-quantizer 3402 coupled to a gain shapes compensator 3404. The gain adjuster 2910 may include a gain frame de-quantizer 3406 coupled to a gain frame compensator 3408. The gain shapes compensator 3404 may be coupled to the gain frame compensator 3408.

During operation, the gain shapes de-quantizer 3402 may generate de-quantized gain shapes 3450 based on the set of first gain parameters 162. For example, the set of first gain parameters 162 may include the gain shapes index 376. The gain shapes de-quantizer 3402 may determine the de-quantized gain shapes 3450 corresponding to the gain shapes index 376. The gain shapes de-quantizer 3402 may provide the de-quantized gain shapes 3450 to the gain shapes compensator 3404.

The gain frame de-quantizer 3406 may generate de-quantized gain frame 3452 based on the set of first gain parameters 162. For example, the set of first gain parameters 162 may include the gain frame index 374. The gain frame de-quantizer 3406 may determine the de-quantized gain frame 3452 corresponding to the gain frame index 374. The gain frame de-quantizer 3406 may provide the de-quantized gain frame 3452 to the gain frame compensator 3408.

The gain shapes compensator 3404 may receive the de-quantized gain shapes 3450 from the gain shapes de-quantizer 3402, the non-gain adjusted synthesized mid signal 2940 from the synthesizer 2902 of FIG. 29, or both. The gain shapes compensator 3404 may generate a gain shapes adjusted synthesized mid signal 3440 based on the non-gain adjusted synthesized mid signal 2940 and the de-quantized gain shapes 3450. For example, the gain shapes compensator 3404 may generate the gain shapes adjusted synthesized mid signal 3440 by adjusting the non-gain adjusted synthesized mid signal 2940 based on the de-quantized gain shapes 3450. The gain shapes compensator 3404 may provide the gain shapes adjusted synthesized mid signal 3440 to the gain frame compensator 3408.

The gain frame compensator 3408 may receive the de-quantized gain frame 3452 from the gain frame de-quantizer 3406, the gain shapes adjusted synthesized mid signal 3440 from the gain shapes compensator 3404, or both. The gain frame compensator 3408 may generate the gain adjusted synthesized mid signal 2942 based on the gain shapes adjusted synthesized mid signal 3440 and the de-quantized gain frame 3452. For example, the gain frame compensator 3408 may generate the gain adjusted synthesized mid signal 2942 by adjusting the gain shapes adjusted synthesized mid signal 3440 based on the de-quantized gain frame 3452.

Figure 35:
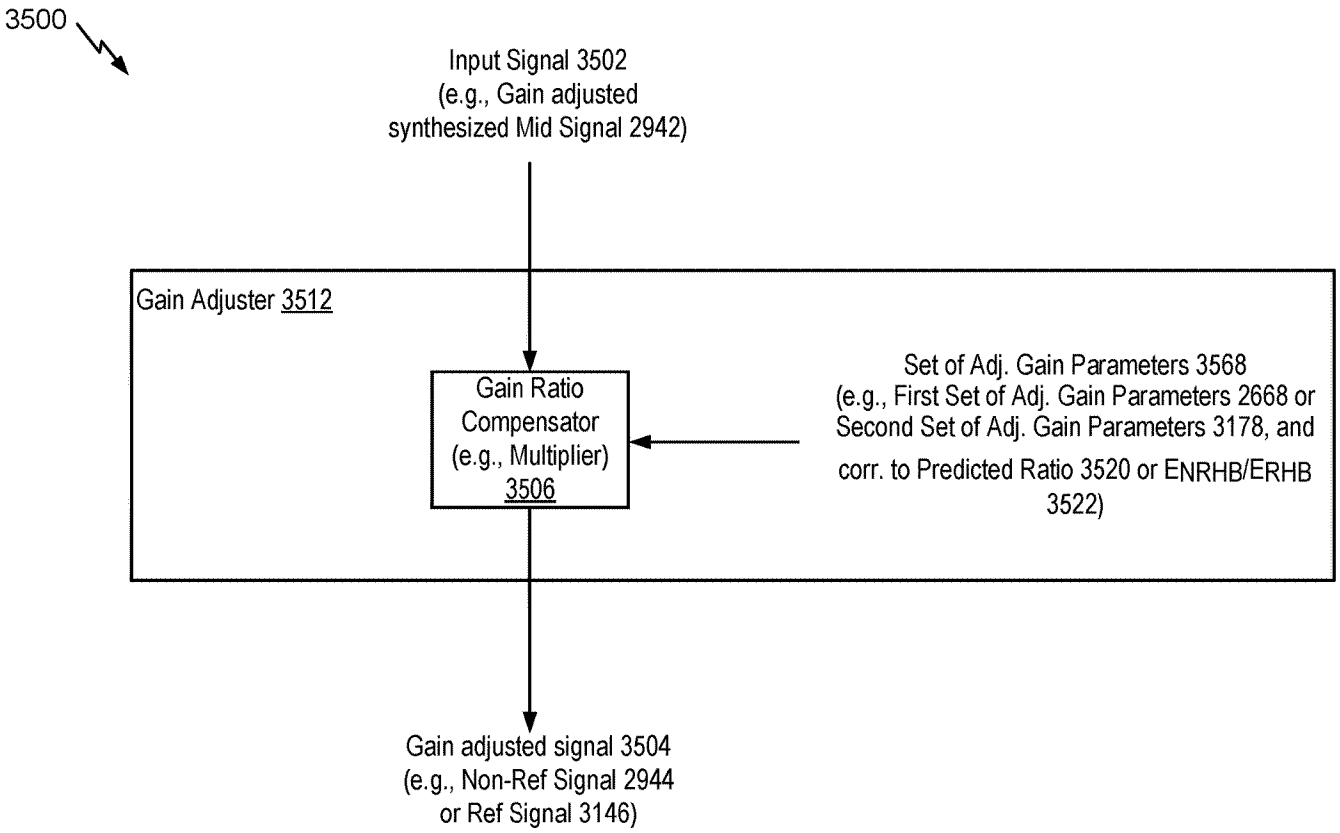
FIG. 35 is a diagram illustrating another example of a device of FIG. 1.

Referring to FIG. 35, an illustrative example of a device is shown and generally designated 3500. One or more components of the device 3500 may be included in the decoder 118, the second device 106, the system 100, or a combination thereof.

The device 3500 includes a gain adjuster 3512. The gain adjuster 3512 may correspond to the gain adjuster 2912 of FIG. 29. The gain adjuster 3512 may include a gain ratio compensator 3506 (e.g., a multiplier). The gain ratio compensator 3506 may be configured to generate a gain adjusted signal 3504 based on an input signal 3502 and a set of adjustment gain parameters 3568. For example, the gain ratio compensator 3506 may generate the gain adjusted signal 3504 by applying (e.g., multiplying) the set of adjustment gain parameters 3568 to the input signal 3502. The set of adjustment gain parameters 3568 may indicate an energy value (e.g., an energy ratio value) of the gain adjusted signal 3504. The set of adjustment gain parameters 3568 may correspond to the first set of adjustment gain parameters 2668 or the second set of adjustment gain parameters 3178.

The input signal 3502 may include the gain adjusted synthesized mid signal 2942 and the gain adjusted signal 3504 may include the non-reference signal 2944 or the reference signal 3146, such as described with respect to FIG. 29 or FIG. 31. The set of adjustment gain parameters 3568 may include an energy ratio (or an energy difference), as described with reference to FIG. 9. For example, the set of adjustment gain parameters 3568 may include a predicted ratio 3520 or a high-band energy ratio 3522. The predicted ratio 3520 may correspond to a low-band energy ratio. For example, the predicted ratio 3520 may correspond to a ratio of a left LB energy of the left LB signal 171 relative to a right LB energy of the right LB signal 173. The high-band energy ratio 3522 may correspond to a ratio of a left HB energy of the left HB signal 172 relative to a right HB energy of the right HB signal 174.

Figure 36:
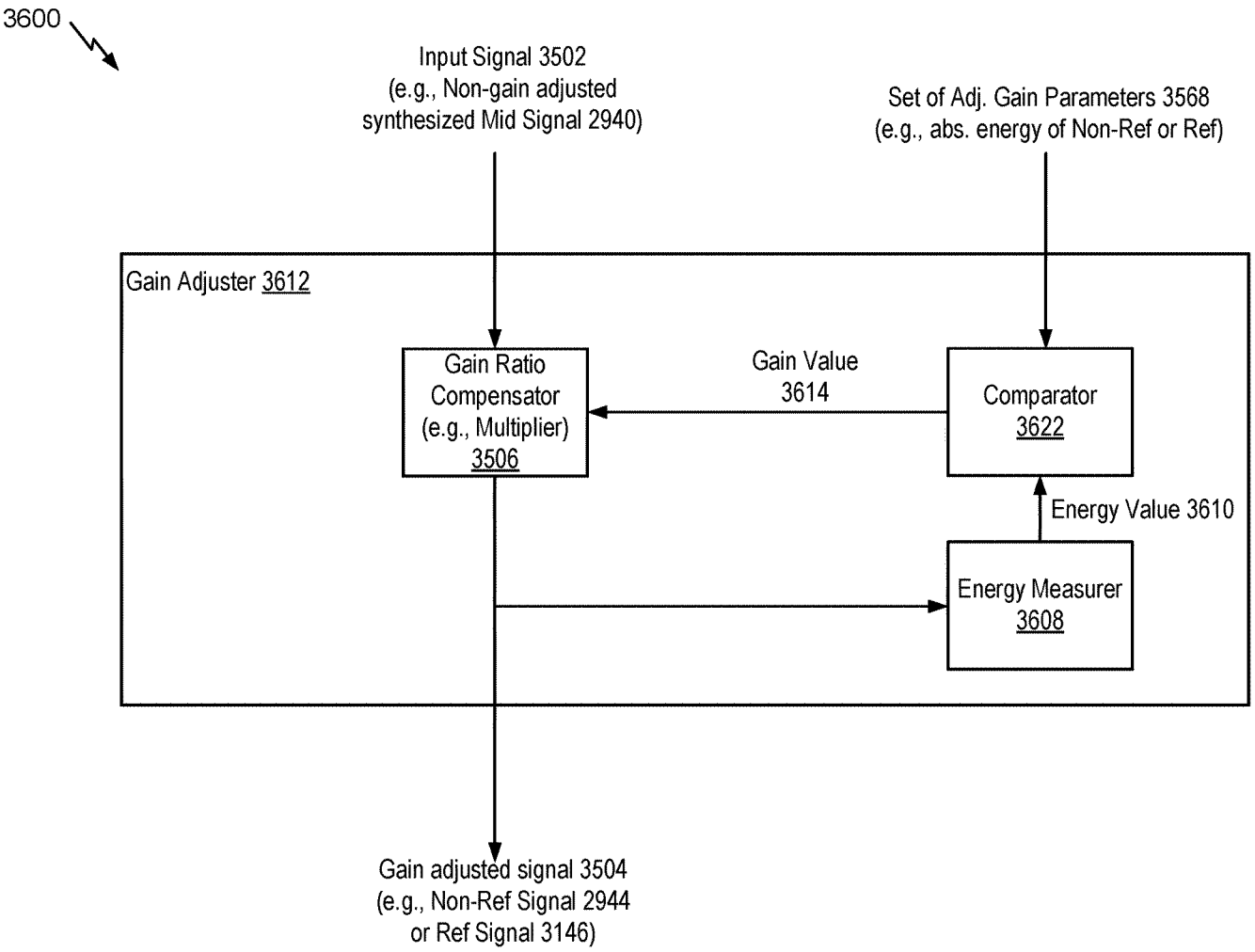
FIG. 36 is a diagram illustrating another example of a device of FIG. 1.

Referring to FIG. 36, an illustrative example of a device is shown and generally designated 3600. One or more components of the device 3600 may be included in the decoder 118, the second device 106, the system 100, or a combination thereof.

The device 3600 includes a gain adjuster 3612. The gain adjuster 3612 may correspond to the gain adjuster 2912, such as depicted in one or more of FIGS. 29-32. The gain adjuster 3612 may include a comparator 3622 coupled to the gain ratio compensator 3506. The gain ratio compensator 3506 may be coupled to an energy measurer 3608. The energy measurer 3608 may be coupled to the comparator 3622.

During operation, the comparator 3622 may provide a gain value 3614 to the gain ratio compensator 3506. The gain value 3614 may have an initial value (e.g., 1). The gain ratio compensator 3506 may generate the gain adjusted signal 3504 based on the input signal 3502 and the gain value 3614, as described with reference to FIG. 35. The gain ratio compensator 3506 may provide the gain adjusted signal 3504 to the energy measurer 3608. The energy measurer 3608 may generate an energy value 3610 corresponding to an energy of the gain adjusted signal 3504. The comparator 3622 may update the gain value 3614 based on a comparison of the set of adjustment gain parameters 3568 and the energy value 3610. For example, the comparator 3622 may, in response to determining that the set of adjustment gain parameters 3568 is greater than the energy value 3610, increase the gain value 3614 by an increment amount. As another example, the comparator 3622 may, in response to determining that the set of adjustment gain parameters 3568 is less than the energy value 3610, decrease the gain value 3614 by a decrement amount.

The gain ratio compensator 3506 may update the gain adjusted signal 3504 based on the input signal 3502 and the updated gain value 3614. The gain value 3614 may converge to a value that results in the energy value 3610 being approximately equal to the set of adjustment gain parameters 3568.

The input signal 3502 may correspond to the non-gain adjusted synthesized mid signal 2940. The gain adjusted signal 3504 may correspond to the non-reference signal 2944 or the reference signal 3146. The set of adjustment gain parameters 3568 may correspond to an absolute energy of a non-reference signal, as described with reference to FIG. 10. In a particular aspect, the set of adjustment gain parameters 3568 may correspond to an absolute energy of the reference signal 3146.

Figure 37:
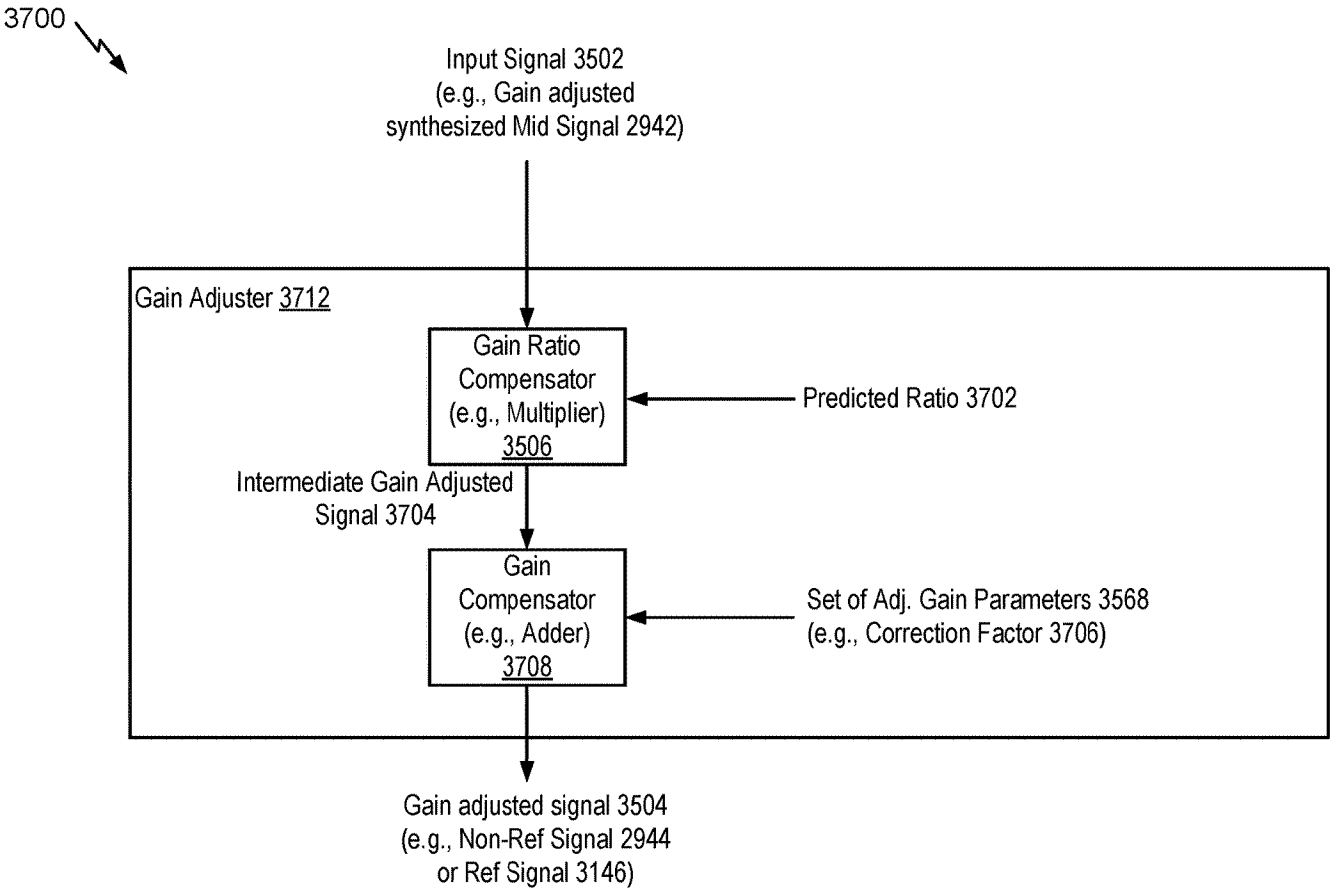
FIG. 37 is a diagram illustrating another example of a device of FIG. 1.

Referring to FIG. 37, an illustrative example of a device is shown and generally designated 3700. One or more components of the device 3700 may be included in the decoder 118, the second device 106, the system 100, or a combination thereof.

The device 3700 includes a gain adjuster 3712. The gain adjuster 3712 may correspond to the gain adjuster 2912 of FIG. 29. The gain adjuster 3712 may include the gain ratio compensator 3506 coupled to a gain compensator 3708 (e.g., an adder or a multiplier). The gain ratio compensator 3506 may be configured to generate an intermediate gain adjusted signal 3704 based on the input signal 3502 and the predicted ratio 3702, as described with reference to FIG. 35. For example, the gain ratio compensator 3506 may generate the intermediate gain adjusted signal 3704 by applying (e.g., multiplying) the predicted ratio 3702 to the input signal 3502. The gain ratio compensator 3506 may provide the intermediate gain adjusted signal 3704 to the gain compensator 3708.

The gain compensator 3708 may generate the gain adjusted signal 3504 based on the intermediate gain adjusted signal 3704 and the set of adjustment gain parameters 3568. For example, the gain compensator 3708 may generate the gain adjusted signal 3504 by applying (e.g., multiplying or adding) the set of adjustment gain parameters 3568 to the intermediate gain adjusted signal 3704.

The input signal 3502 may correspond to the gain adjusted synthesized mid signal 2942. The set of adjustment gain parameters 3568 may correspond to a correction factor 3706. For example, the correction factor 3706 may correspond to the factor 1104 of FIG. 11 or the correction factor 1204 of FIG. 12. The predicted ratio 3702 may correspond to a low-band energy ratio. For example, the predicted ratio 3702 may correspond to a ratio of a left LB energy of the left LB output signal 117 relative to a right LB energy of the right LB output signal 137.

Figure 38:
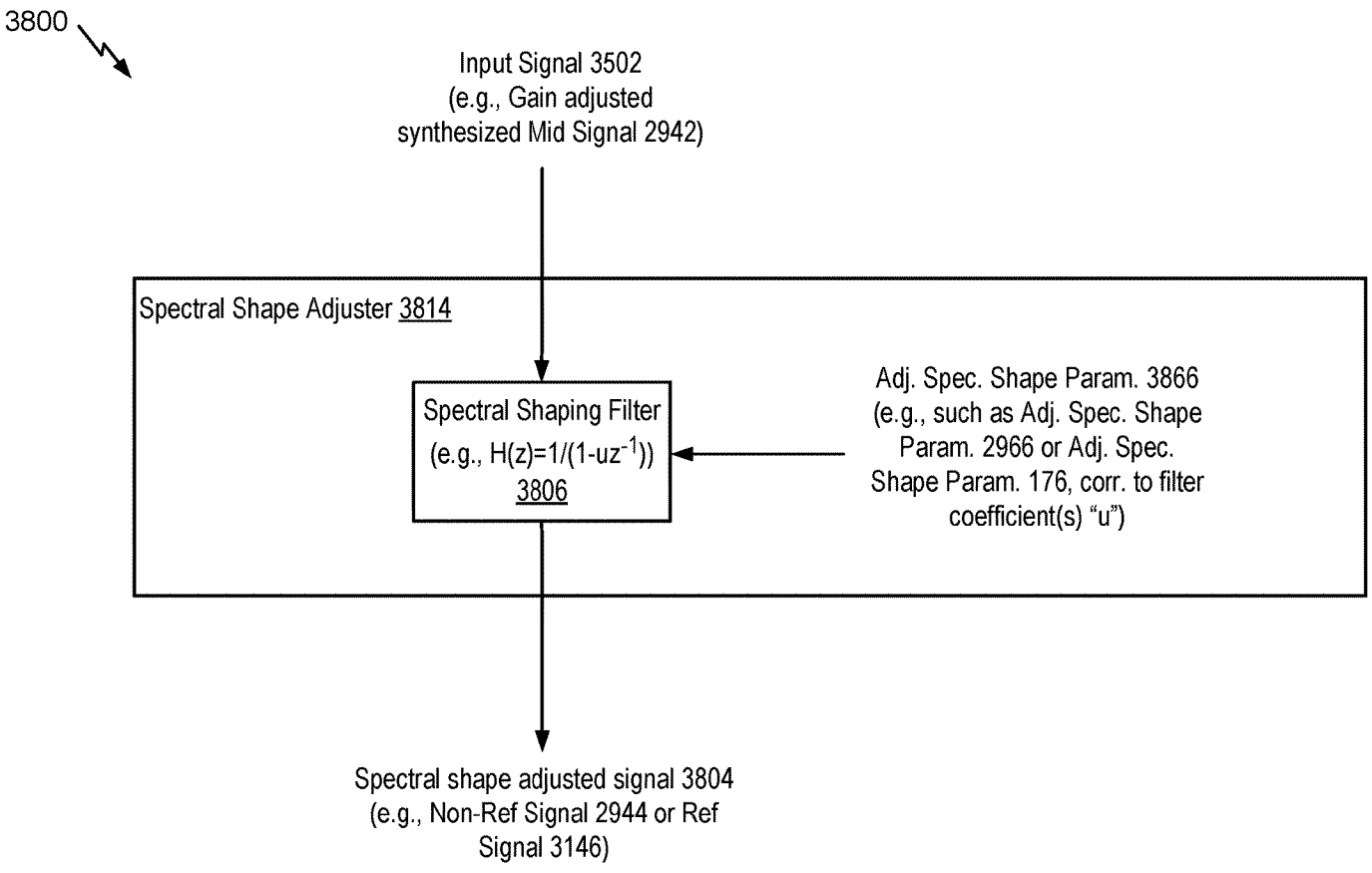
FIG. 38 is a diagram illustrating another example of a device of FIG. 1.

Referring to FIG. 38, an illustrative example of a device is shown and generally designated 3800. One or more components of the device 3800 may be included in the decoder 118, the second device 106, the system 100, or a combination thereof.

The device 3800 includes a spectral shape adjuster 3814. The spectral shape adjuster 3814 may correspond to the spectral shape adjuster 2914 of FIG. 29. The spectral shape adjuster 3814 may include a spectral shaping filter 3806 (e.g., $H(z)=1/(1-uz^{-1})$). The spectral shaping filter 3806 may be configured to generate a spectral shape adjusted signal 3804 based on an input signal 3802 and an adjustment spectral shape parameter 3866. For example, the adjustment spectral shape parameter 3866 may correspond to a parameter or coefficient (e.g., "u") of the spectral shaping filter 3806, as described with reference to FIG. 18. The adjustment spectral shape parameter 3866 may include the adjustment spectral shape parameter 2966 or the second adjustment spectral shape parameter 176. The input signal 3802 may include the gain adjusted synthesized mid signal 2942. The spectral shape adjusted signal 3804 may include the non-reference signal 2944 or the reference signal 3146.

Figure 39:
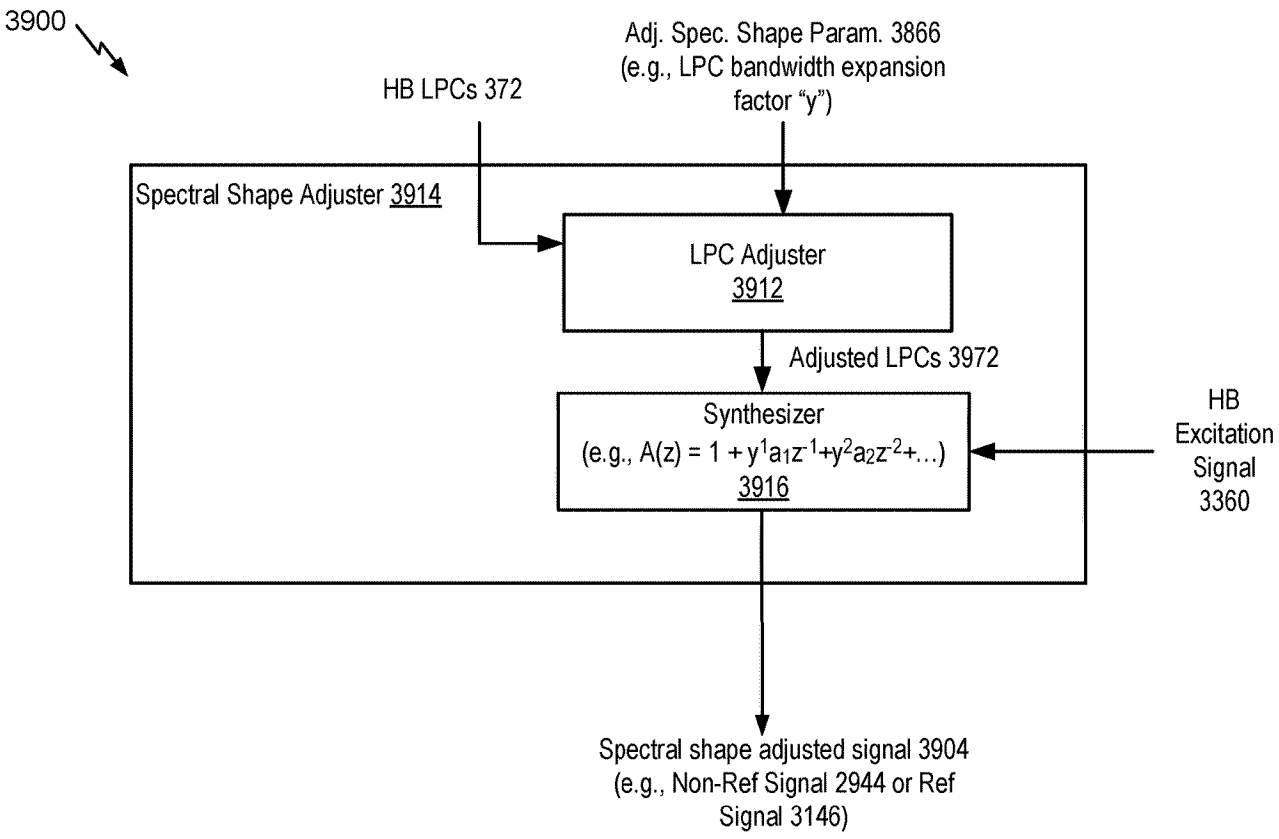
FIG. 39 is a diagram illustrating another example of a device of FIG. 1.

Referring to FIG. 39, an illustrative example of a device is shown and generally designated 3900. One or more components of the device 3900 may be included in the decoder 118, the second device 106, the system 100, or a combination thereof.

The device 3900 includes a spectral shape adjuster 3914. The spectral shape adjuster 3914 may correspond to the spectral shape adjuster 2914 of FIG. 29. The spectral shape adjuster 3914 may include an LPC adjuster 3912 coupled to a synthesizer 3916. The LPC adjuster 3912 may be configured to generate adjusted LPCs 3972 based on the HB LPCs 372 and the adjustment spectral shape parameter 3866. For example, the LPC adjuster 3912 may generate the adjusted LPCs 3972 by adjusting the HB LPCs 372 based on the adjustment spectral shape parameter 3866. The adjustment spectral shape parameter 3866 may correspond to a LPC bandwidth expansion factor ($\gamma$), as described with reference to FIG. 18. The LPC adjuster 3912 may provide the adjusted LPCs 3972 to the synthesizer 3916. The synthesizer 3916 may be configured to generate a spectral shape adjusted signal 3904 based on the adjusted LPCs 3972 and the HB excitation signal 3360. For example, the synthesizer 3916 may be configured based on the adjusted LPCs 3972. The synthesizer 3916 may receive the HB excitation signal 3360 as an input and may generate the spectral shape adjusted signal 3904. The synthesizer 3916 may correspond to a synthesis filter having a transfer function A(z) based on the bandwidth expansion factor and the LPC coefficient (a1, a2, . . . ), such as $A(z)=(1+\gamma^1 a_{1Z}^{-1}+\gamma^2 a_{2Z}^{-2}+\ldots)$. The spectral shape adjusted signal 3904 may correspond to the non-reference signal 2944 or the reference signal 3146.

Figure 40:
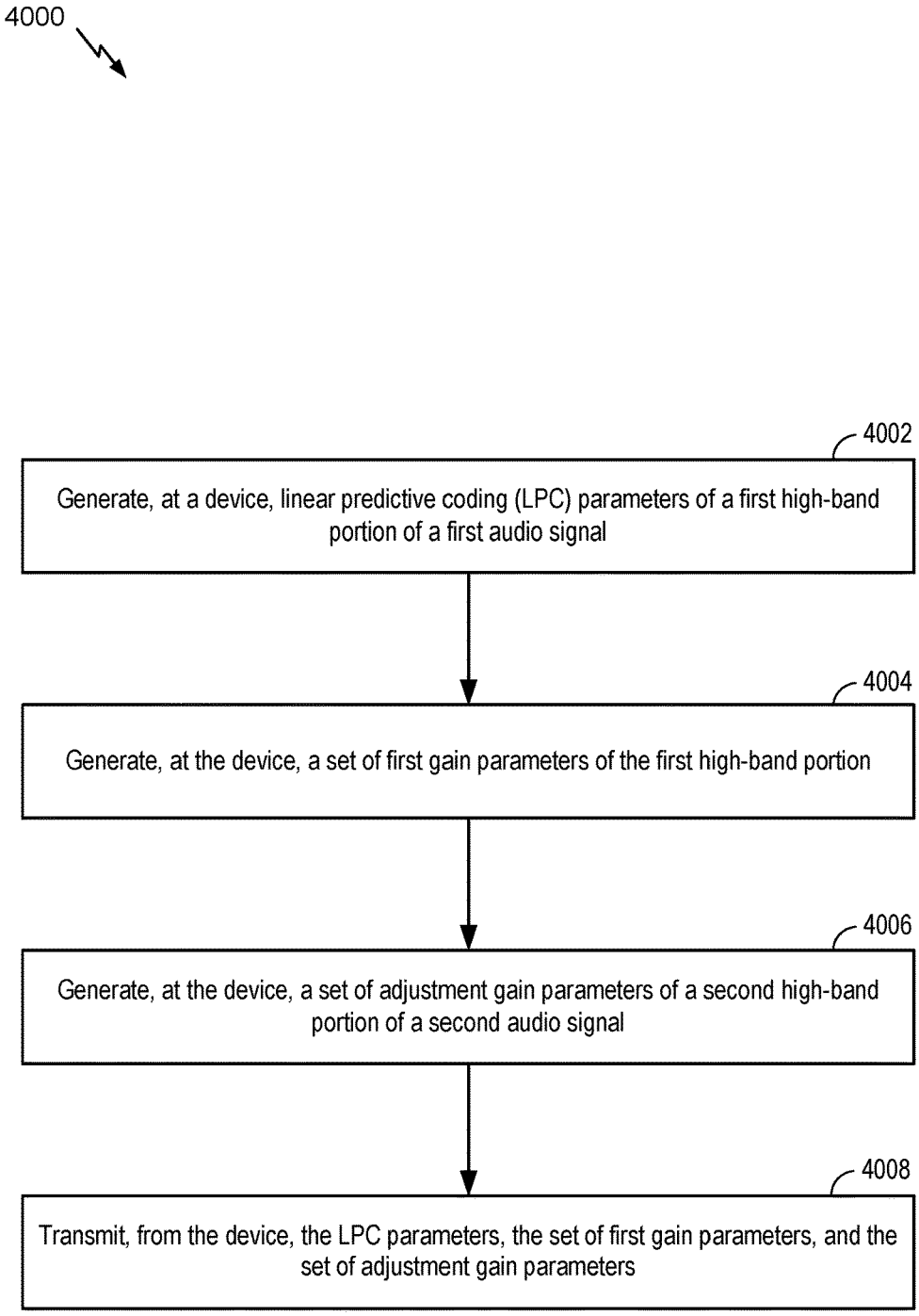
FIG. 40 is a flow chart illustrating a particular method of encoding multiple high-band audio signals.

FIG. 40 includes a flow chart of an illustrative method of operation generally designated 4000. The method 4000 may be performed by the encoder 114, the first device 104, the system 100, or a combination thereof.

The method 4000 includes generating, at a device, linear predictive coefficient (LPC) parameters of a first high-band portion of a first audio signal, at 4002. For example, the LPC parameter generator 320 of the first device 104 of FIG. 1 may generate the LPC parameters 102, as described with reference to FIG. 3. The gain adjusted synthesized mid signal 2942 of FIG. 29 may be based on the LPC parameters 102, as described with reference to FIG. 29.

The method 4000 also includes generating, at the device, a set of first gain parameters of the first high-band portion, at 4004. For example, the gain parameter generator 322 of the first device 104 of FIG. 1 may generate the set of first gain parameters 162, as described with reference to FIG. 3. The gain adjusted synthesized mid signal 2942 of FIG. 29 may be based on the set of first gain parameters 162, as described with reference to FIG. 29.

The method 4000 further includes generating, at the device, a set of adjustment gain parameters of a second high-band portion of a second audio signal, at 4006. For example, the gain analyzer 182 of the first device 104 may generate the first set of adjustment gain parameters 168, as described with reference to FIG. 6. The synthesized non-reference signal 2944 of FIG. 29 may be based on the first set of adjustment gain parameters 168, as described with reference to FIG. 29.

The method 4000 also includes transmitting, from the device, the LPC parameters, the set of first gain parameters, and the set of adjustment gain parameters, at 4008. For example, the transmitter 110 of FIG. 1 may transmit, from the first device 104, the LPC parameters 102, the set of first gain parameters 162, and the first set of adjustment gain parameters 168.

Figure 41:
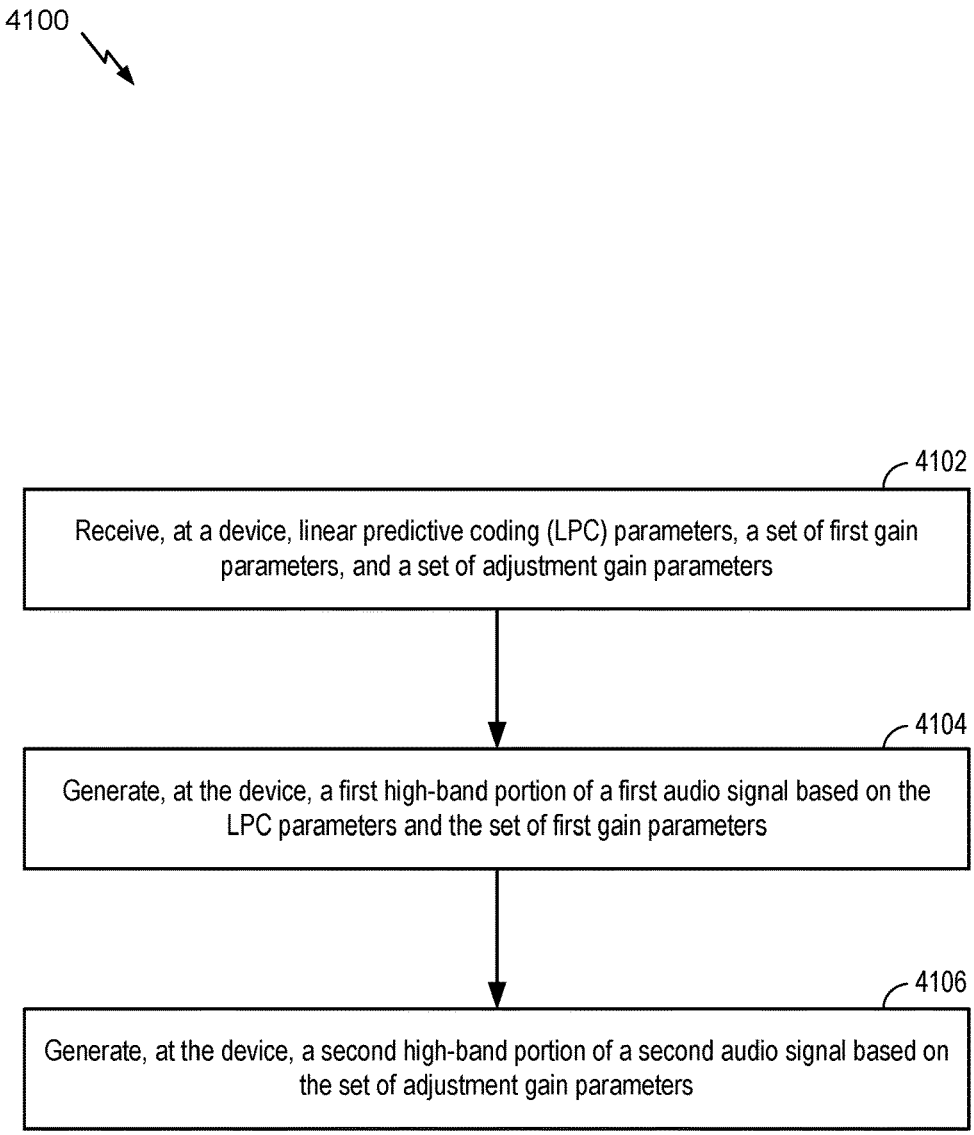
FIG. 41 is a flow chart illustrating a particular method of decoding multiple high-band audio signals.

FIG. 41 includes a flow chart of an illustrative method of operation generally designated 4100. The method 4100 may be performed by the decoder 118, the second device 106, the system 100, or a combination thereof.

The method 4100 includes receiving, at a device, linear predictive coefficient (LPC) parameters, a set of first gain parameters, and a set of adjustment gain parameters, at 4102. For example, the receiver 111 of the second device 106 may receive the LPC parameters 102, the set of first gain parameters 162, and the first set of adjustment gain parameters 168.

The method 4100 also includes generating, at the device, a first high-band portion of a first audio signal based on the LPC parameters and the set of first gain parameters, at 4104. For example, the signal adjuster 2904 of the second device 106 may generate the gain adjusted synthesized mid signal 2942 based on the LPC parameters 102 and the set of first gain parameters 162, as described with reference to FIG. 29.

The method 4100 further includes generating, at the device, a second high-band portion of a second audio signal based on the set of adjustment gain parameters, at 4106. For example, the signal adjuster 2906 of the second device 106 may generate the synthesized non-reference signal 2944 based on the LPC parameters 102 (used by the synthesizer 2902 to generate the non-gain adjusted synthesized mid signal 2940) and based on the first set of adjustment gain parameters 168, as described with reference to FIG. 29. As another example, the signal adjuster 2906 may generate the synthesized non-reference signal 2944 by applying the first set of adjustment gain parameters 168 to the gain adjusted synthesized mid signal 2942, as described with reference to FIG. 29.

Figure 42:
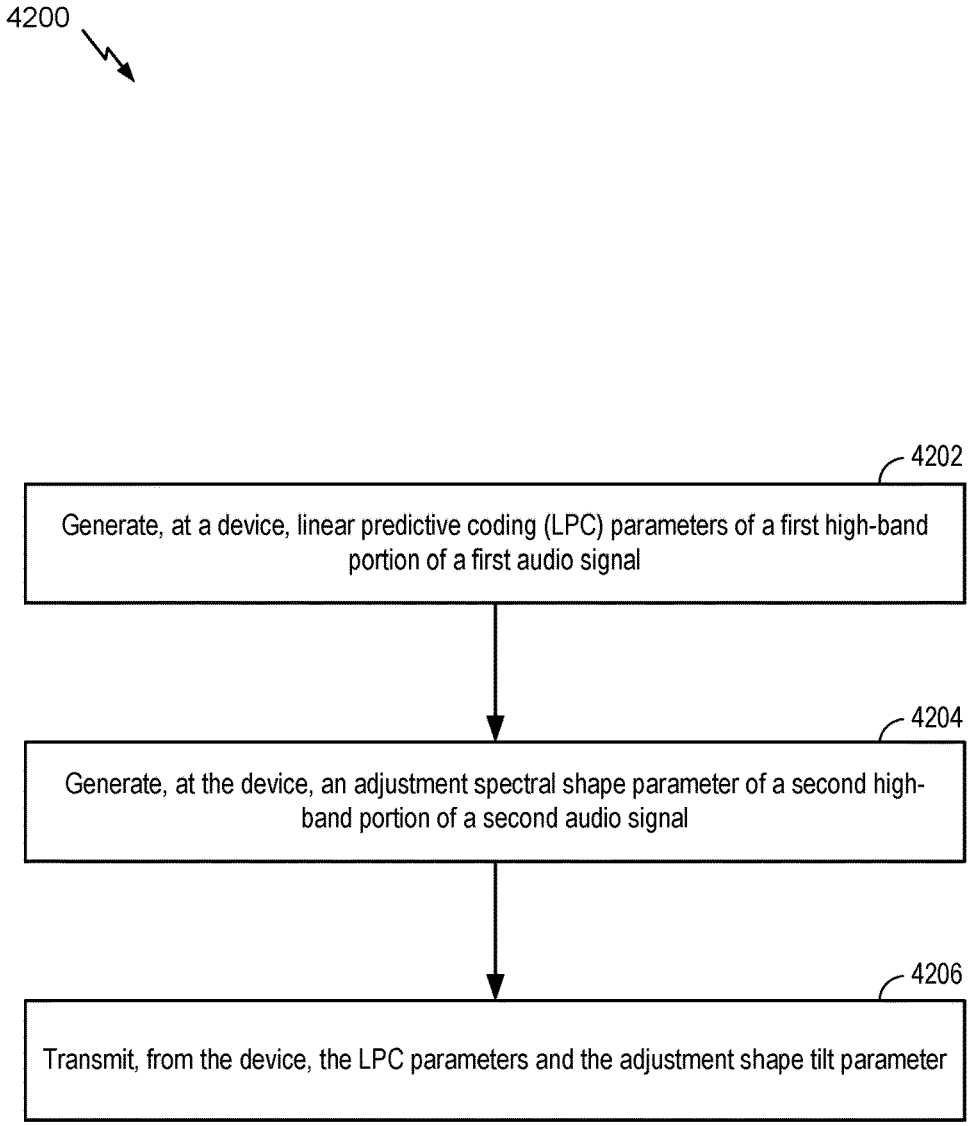
FIG. 42 is a flow chart illustrating another particular method of encoding multiple high-band audio signals.

FIG. 42 includes a flow chart of an illustrative method of operation generally designated 4200. The method 4200 may be performed by the encoder 114, the first device 104, the system 100, or a combination thereof.

The method 4200 includes generating, at a device, linear predictive coefficient (LPC) parameters of a first high-band portion of a first audio signal, at 4202. For example, the LPC parameter generator 320 of the first device 104 of FIG. 1 may generate the LPC parameters 102, as described with reference to FIG. 1. The gain adjusted synthesized mid signal 2942 of FIG. 29 may be based on the LPC parameters 102, as described with reference to FIG. 29.

The method 4200 also includes generating, at the device, an adjustment spectral shape parameter of a second high-band portion of a second audio signal, at 4204. For example, the spectral shape analyzer 184 of the first device 104 may generate the adjustment spectral shape parameter 166, as described with reference to FIG. 6. The synthesized non-reference signal 2944 may be based on the adjustment spectral shape parameter 166, as described with reference to FIG. 29.

The method 4200 further includes transmitting, from the device, the LPC parameters and the adjustment spectral shape parameter, at 4206. For example, the transmitter 110 of FIG. 1 may transmit, from the first device 104, the LPC parameters 102 and the adjustment spectral shape parameter 166.

Figure 43:
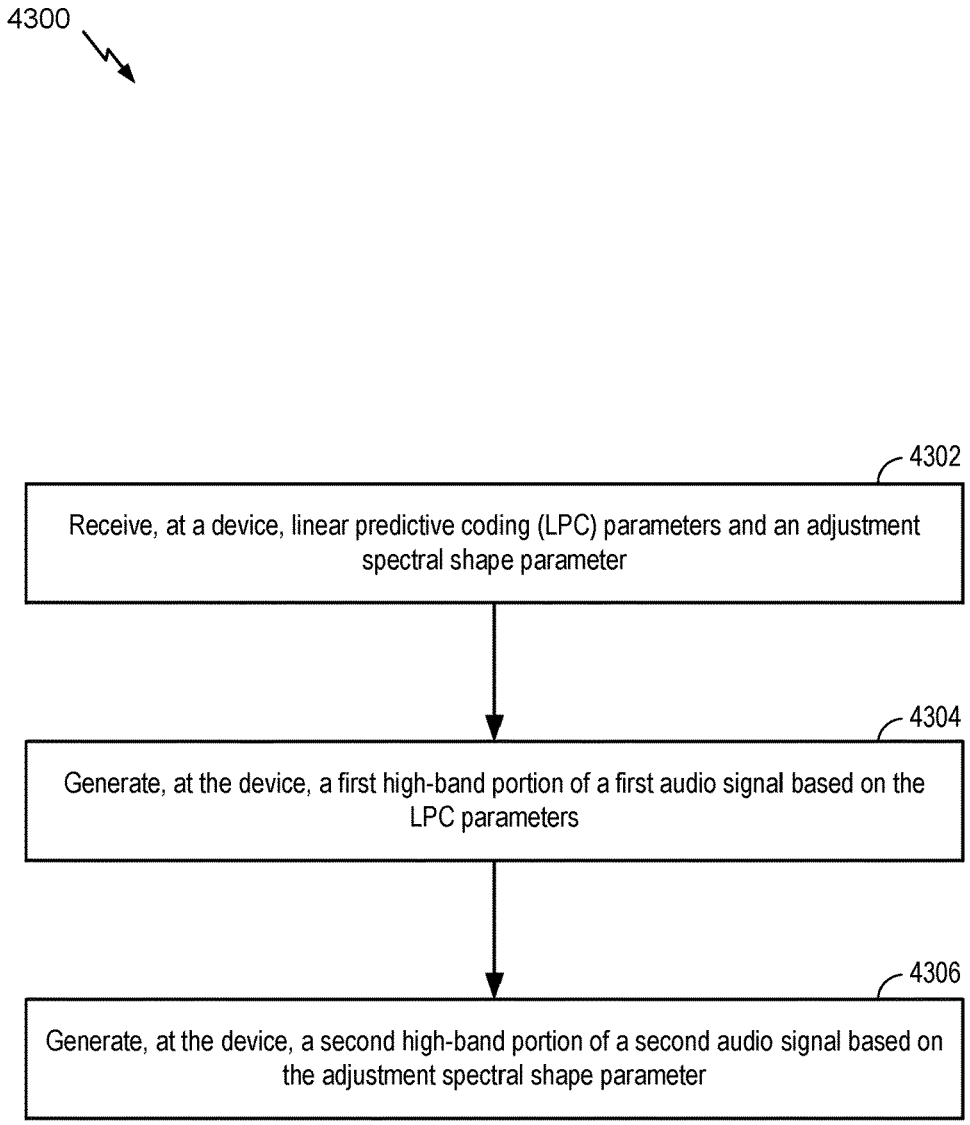
FIG. 43 is a flow chart illustrating another particular method of decoding multiple high-band audio signals.

FIG. 43 includes a flow chart of an illustrative method of operation generally designated 4300. The method 4300 may be performed by the decoder 118, the second device 106, the system 100, or a combination thereof.

The method 4300 includes receiving, at a device, linear predictive coefficient (LPC) parameters and an adjustment spectral shape parameter, at 4302. For example, the receiver 111 of the second device 106 may receive the LPC parameters 102 and the adjustment spectral shape parameter 166.

The method 4300 also includes generating, at the device, a first high-band portion of a first audio signal based on the LPC parameters, at 4304. For example, the signal adjuster 2904 of the second device 106 may generate the gain adjusted synthesized mid signal 2942 based on the LPC parameters 102, as described with reference to FIG. 29.

The method 4300 further includes generating, at the device, a second high-band portion of a second audio signal based on the adjustment spectral shape parameter, at 4306. For example, the signal adjuster 2906 of the second device 106 may generate the synthesized non-reference signal 2944 based on the LPC parameters 102 (used by the synthesizer 2902 to generate the non-gain adjusted synthesized mid signal 2940) and based on the adjustment spectral shape parameter 166, as described with reference to FIG. 29. As another example, the signal adjuster 2906 may generate the synthesized non-reference signal 2944 by applying the adjustment spectral shape parameter 166 to the gain adjusted synthesized mid signal 2942, as described with reference to FIG. 29.

Figure 44:
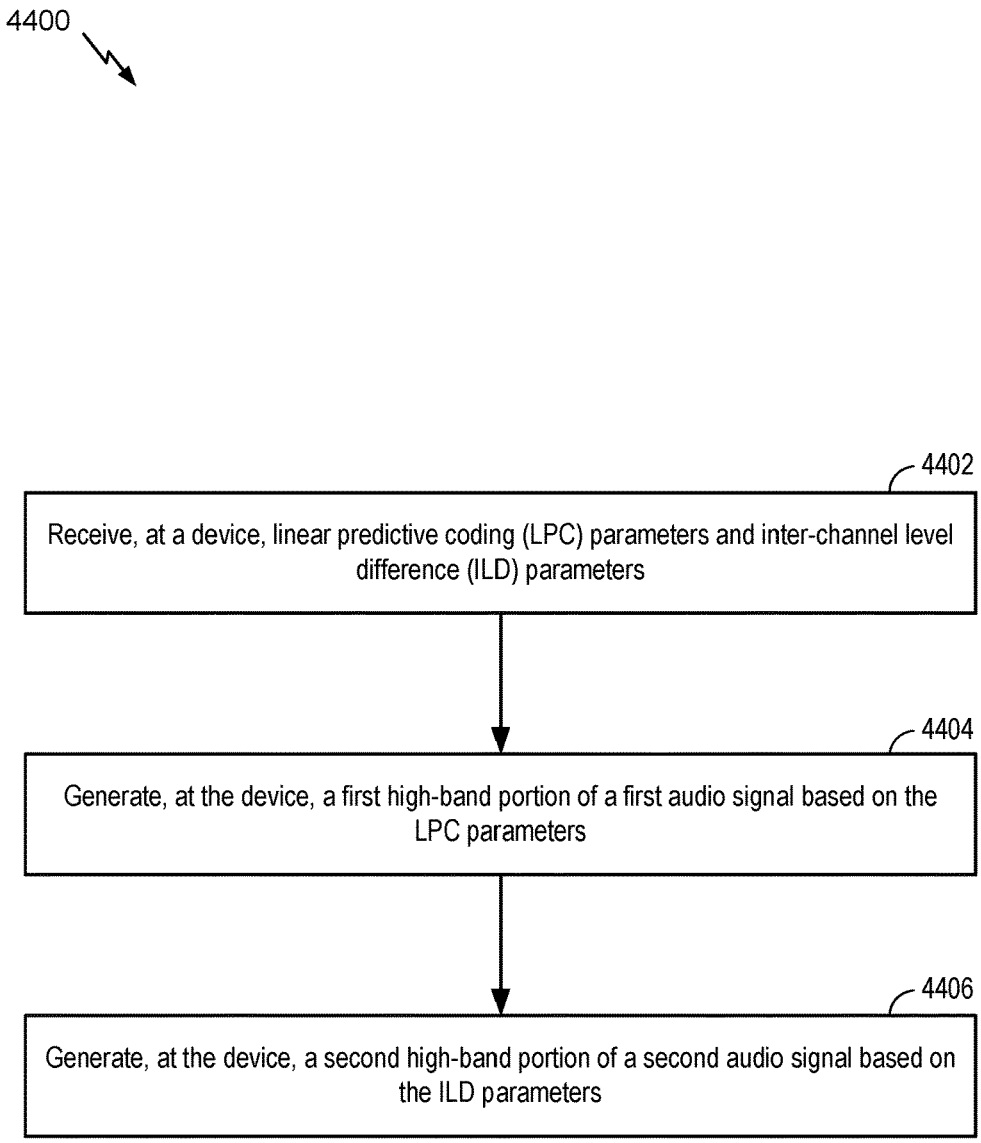
FIG. 44 is a flow chart illustrating another particular method of decoding multiple high-band audio signals.

FIG. 44 includes a flow chart of an illustrative method of operation generally designated 4400. The method 4400 may be performed by the decoder 118, the second device 106, the system 100, or a combination thereof.

The method 4400 includes receiving, at a device, linear predictive coefficient (LPC) parameters and inter-channel level difference (ILD) parameters, at 4402. For example, the receiver 111 of the second device 106 may receive the LPC parameters 102 and the stereo cues 175. The stereo cues 175 may include ILD parameters, as described with reference to FIG. 1.

The method 4400 also includes generating, at the device, a first high-band portion of a first audio signal based on the LPC parameters, at 4404. For example, the signal adjuster 2904 of the second device 106 may generate the gain adjusted synthesized mid signal 2942 based on the LPC parameters 102, as described with reference to FIG. 29.

The method 4400 further includes generating, at the device, a second high-band portion of a second audio signal based on the ILD parameters, at 4406. For example, the gain adjuster 3612 may generate the gain adjusted signal 3504 based on the input signal 3502 and the stereo cues 175, as described with reference to FIG. 36. The stereo cues 175 may include ILD parameters. The signal adjuster 2906 of the second device 106 may generate the input signal 3502 (e.g., the gain adjusted synthesized mid signal 2942) based on the LPC parameters 102 (used by the synthesizer 2902 to generate the non-gain adjusted synthesized mid signal 2940), as described with reference to FIG. 29. As another example, the spectral shape adjuster may generate the spectral shape adjusted signal 3804 (e.g., the non-reference signal 2944 or the reference signal 2496) by applying the adjustment spectral shape parameter 3866 to the input signal 3502, as described with reference to FIG. 38. The adjustment spectral shape parameter 3866 may include the predicted adjusted spectral shape parameter 2466. The tilt parameter predictor 2424 may generate the predicted adjustment spectral shape parameter 2466 based on the stereo cues 175, as described with reference to FIG. 28.

Figure 45:
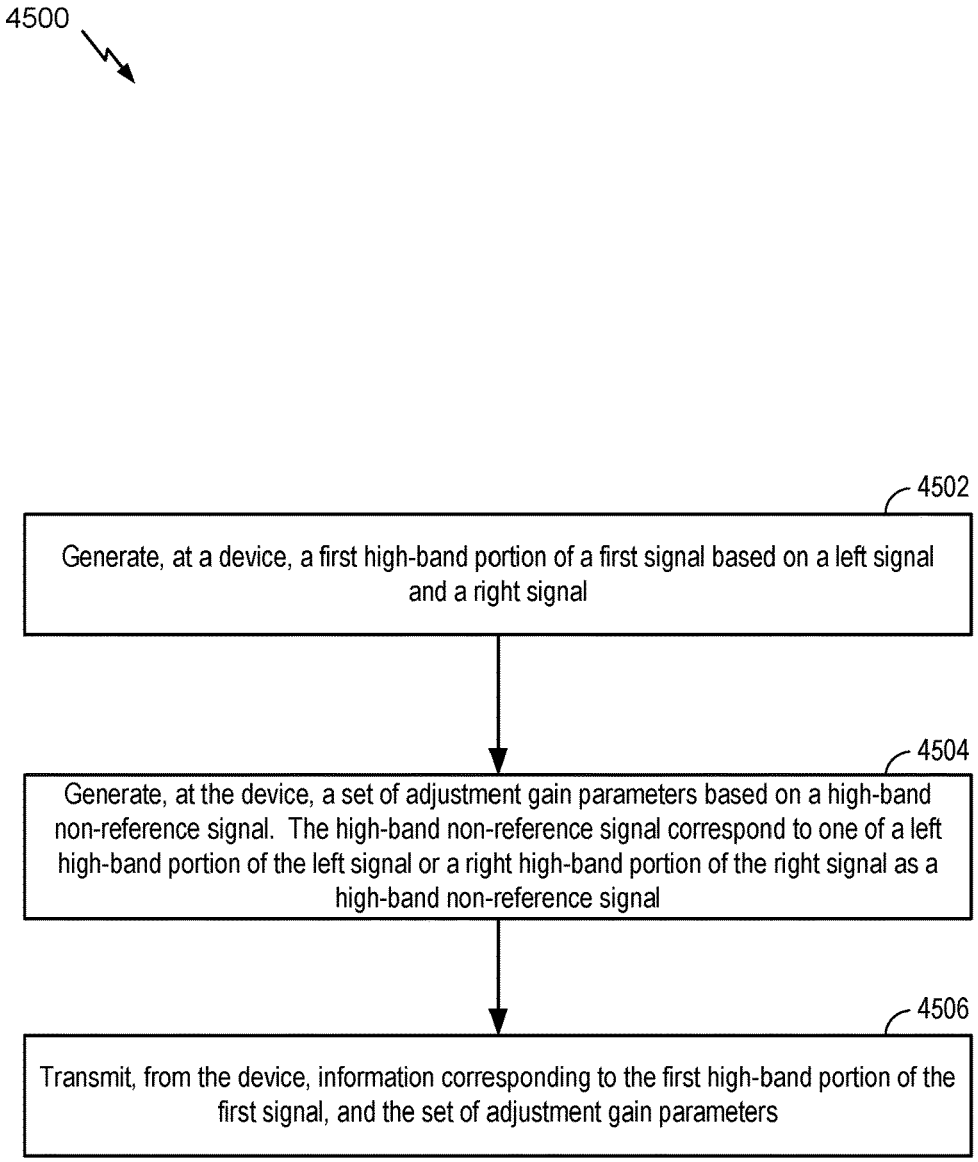
FIG. 45 is a flow chart illustrating a particular method of encoding multiple high-band audio signals.

FIG. 45 includes a flow chart of an illustrative method of operation generally designated 4500. The method 4500 may be performed by the encoder 114, the first device 104, the system 100, or a combination thereof.

The method 4500 includes generating, at a device, a first high-band portion of a first signal based on a left signal and a right signal, at 4502. For example, as described with reference to FIG. 2, the midside generator 210 may generate the mid signal 270 based on the first audio signal 130 (e.g., a left signal) and the second audio signal 132 (e.g., a right signal). The mid signal 270 may include a high-band portion.

The method 4500 also includes generating a set of adjustment gain parameters based on a high-band non-reference signal, at 4504. For example, as described with reference to FIG. 2, the BWE spatial balancer 212 of FIG. 2 may generate the set of first gain parameters 162 based on the mid signal 270. As another example, as described with reference to FIG. 6, the BWE spatial balancer 212 may generate the first set of adjustment gain parameters 168 based on a high-band non-reference signal (e.g., the left HB signal 172 or the right HB signal 174).

The method 4500 further includes transmitting, from the device, information corresponding to the first high-band portion of the first signal, and the set of adjustment gain parameters, at 4506. For example, the transmitter 110 of FIG. 1 may transmit the LPC parameters 102 and the set of first gain parameters 162 corresponding to the mid signal 270 of FIG. 2, as described with reference to FIGS. 1-2. The transmitter 110 may also transmit the first set of adjustment gain parameters 168 corresponding to the high-band non-reference signal (e.g., the left HB signal 172 or the right HB signal 174), as described with reference to FIGS. 1, 10, and 12.

Figure 46:
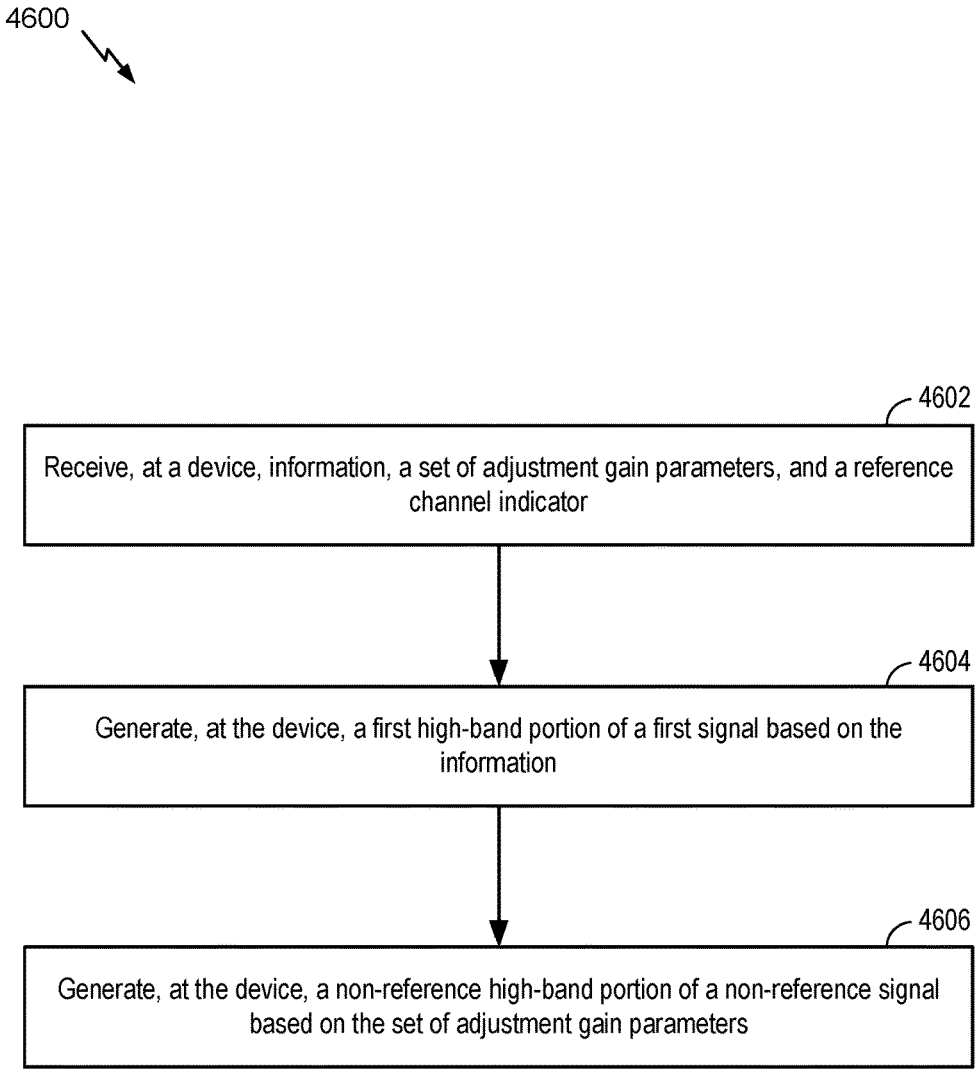
FIG. 46 is a flow chart illustrating a particular method of decoding multiple high-band audio signals.

FIG. 46 includes a flow chart of an illustrative method of operation generally designated 4600. The method 4600 may be performed by the decoder 118, the second device 106, the system 100, or a combination thereof.

The method 4600 includes receiving, at a device, information, a set of adjustment gain parameters, and a reference channel indicator, at 4602. For example, as described with reference to FIG. 1, the receiver 111 may receive the LPC parameters 102, the set of first gain parameters 162, the first set of adjustment gain parameters 168, and the HB reference signal indicator 164.

The method 4600 also includes generating, at the device, a first high-band portion of a first signal based on the information, at 4604. For example, as described with reference to FIG. 29, the synthesizer 2902 may generate the non-gain adjusted synthesized mid signal 2940 based on the LPC parameters 102. The non-gain adjusted synthesized mid signal 2940 may include a high-band portion. The signal adjuster 2904 may generate the gain adjusted synthesized mid signal 2942 based on the non-gain adjusted synthesized mid signal 2940 and the set of first gain parameters 162. The gain adjusted synthesized mid signal 2942 may include a high-band portion.

The method 4600 further includes generating, at the device, a non-reference high-band portion of a non-reference signal based on the set of adjustment gain parameters, at 4606. For example, as described with reference to FIG. 29, the signal adjuster 2906 may generate the synthesized non-reference signal 2944 based on the gain adjusted synthesized mid signal 2942 and the first set of adjustment gain parameters 2668. The first set of adjustment gain parameters 2668 may be based on the first set of adjustment gain parameters 168, as described with reference to FIG. 27.

Figure 47:
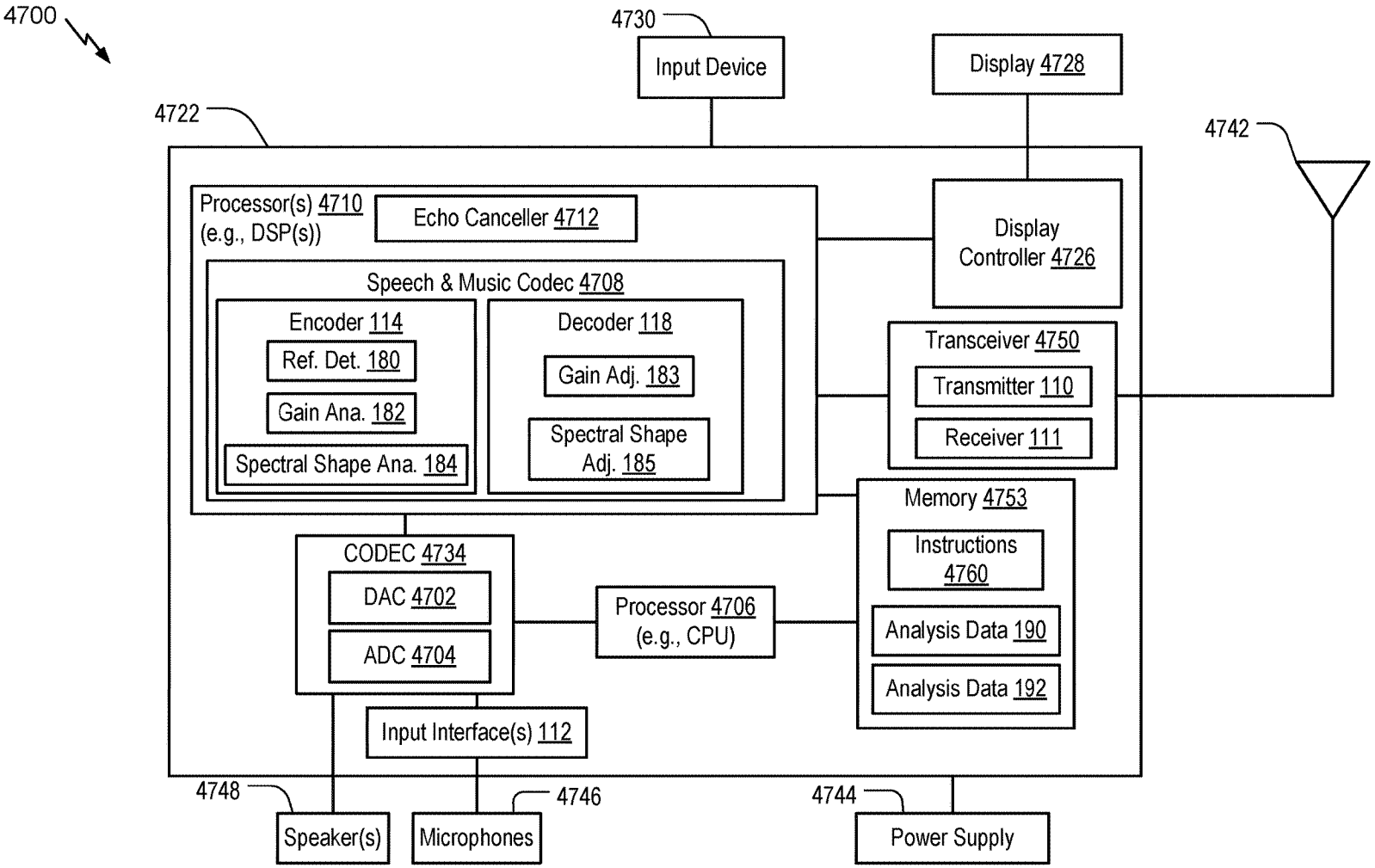
FIG. 47 is a block diagram of a particular illustrative example of a device that is operable to encode and decode multiple high-band audio signals.

Referring to FIG. 47, a block diagram of a particular illustrative example of a device (e.g., a wireless communication device) is depicted and generally designated 4700. In various embodiments, the device 4700 may have fewer or more components than illustrated in FIG. 47. In an illustrative embodiment, the device 4700 may correspond to the first device 104 or the second device 106 of FIG. 1. In an illustrative embodiment, the device 4700 may perform one or more operations described with reference to systems and methods of FIGS. 1-46.

In a particular embodiment, the device 4700 includes a processor 4706 (e.g., a central processing unit (CPU)). The device 4700 may include one or more additional processors 4710 (e.g., one or more digital signal processors (DSPs)). The processors 4710 may include a media (e.g., speech and music) coder-decoder (CODEC) 4708, and an echo canceller 4712. The media CODEC 4708 may include the decoder 118, the encoder 114, or both, of FIG. 1. The encoder 114 may include the reference detector 180, the gain analyzer 182, the spectral shape analyzer 184, or a combination thereof. The decoder 118 may include the gain adjuster 183, the spectral shape adjuster 185, or both.

The device 4700 may include a memory 4753 and a CODEC 4734. Although the media CODEC 4708 is illustrated as a component of the processors 4710 (e.g., dedicated circuitry and/or executable programming code), in other embodiments one or more components of the media CODEC 4708, such as the decoder 118, the encoder 114, or both, may be included in the processor 4706, the CODEC 4734, another processing component, or a combination thereof.

The device 4700 may include a transceiver 4750 coupled to an antenna 4742. The transceiver 4750 may include the transmitter 110, the receiver 111, or both. The device 4700 may include a display 4728 coupled to a display controller 4726. One or more speakers 4748 may be coupled to the CODEC 4734. One or more microphones 4746 may be coupled, via the input interface(s) 112, to the CODEC 4734. In a particular aspect, the speakers 4748 may include the first loudspeaker 142, the second loudspeaker 144 of FIG. 1, or both. In a particular aspect, the microphones 4746 may include the first microphone 146, the second microphone 148 of FIG. 1, or both. The CODEC 4734 may include a digital-to-analog converter (DAC) 4702 and an analog-to-digital converter (ADC) 4704.

The memory 4753 may include instructions 4760 executable by the processor 4706, the processors 4710, the CODEC 4734, another processing unit of the device 4700, or a combination thereof, to perform one or more operations described with reference to FIGS. 1-46. The memory 4753 may correspond to the memory 153, the memory 135, or both, of FIG. 1. The memory 4753 may store the analysis data 190, the analysis data 192, or both.

One or more components of the device 4700 may be implemented via dedicated hardware (e.g., circuitry), by a processor executing instructions to perform one or more tasks, or a combination thereof. As an example, the memory 4753 or one or more components of the processor 4706, the processors 4710, and/or the CODEC 4734 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 4760) that, when executed by a computer (e.g., a processor in the CODEC 4734, the processor 4706, and/or the processors 4710), may cause the computer to perform one or more operations described with reference to FIGS. 1-46. As an example, the memory 4753 or the one or more components of the processor 4706, the processors 4710, and/or the CODEC 4734 may be a non-transitory computer-readable medium that includes instructions (e.g., the instructions 4760) that, when executed by a computer (e.g., a processor in the CODEC 4734, the processor 4706, and/or the processors 4710), cause the computer perform one or more operations described with reference to FIGS. 1-46.

In a particular embodiment, the device 4700 may be included in a system-in-package or system-on-chip device (e.g., a mobile station modem (MSM)) 4722. In a particular embodiment, the processor 4706, the processors 4710, the display controller 4726, the memory 4753, the CODEC 4734, and the transceiver 4750 are included in a system-in-package or the system-on-chip device 4722. In a particular embodiment, an input device 4730, such as a touchscreen and/or keypad, and a power supply 4744 are coupled to the system-on-chip device 4722. Moreover, in a particular embodiment, as illustrated in FIG. 47, the display 4728, the input device 4730, the speakers 4748, the microphones 4746, the antenna 4742, and the power supply 4744 are external to the system-on-chip device 4722. However, each of the display 4728, the input device 4730, the speakers 4748, the microphones 4746, the antenna 4742, and the power supply 4744 can be coupled to a component of the system-on-chip device 4722, such as an interface or a controller.

The device 4700 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular aspect, one or more components of the systems and devices described with reference to FIGS. 1-47 may be integrated into a decoding system or apparatus (e.g., an electronic device, a CODEC, or a processor therein), into an encoding system or apparatus, or both. In other aspects, one or more components of the systems and devices described with reference to FIGS. 1-47 may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, a mobile phone, a computer, a music player, a video player, a decoder, or another type of device.

It should be noted that various functions performed by the one or more components of the systems and devices described with reference to FIGS. 1-47 are described as being performed by certain components or modules. This division of components and modules is for illustration only. In an alternate aspect, a function performed by a particular component or module may be divided amongst multiple components or modules. Moreover, in an alternate aspect, two or more components or modules described with reference to FIGS. 1-47 may be integrated into a single component or module. Each component or module described with reference to FIGS. 1-47 may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described aspects, an apparatus includes means for generating a first high-band portion of a first signal based on a left signal and a right signal. For example, the means for generating may include the encoder 114, the first device 104 of FIG. 1, the midside generator 210, the device 200 of FIG. 2, the media CODEC 4708, the processors 4710, the processor 4706, the device 4700, one or more devices configured to generate a first high-band portion (e.g., a processor executing instructions that are stored at a computer-readable storage device), or a combination thereof.

The apparatus also includes means for generating a set of adjustment gain parameters based on a high-band non-reference signal. For example, the means for designating may include the encoder 114, the reference detector 180, the first device 104 of FIG. 1, the BWE spatial balancer 212, the device 200 of FIG. 2, the reference detector 780, the reference detector 782, the signal comparator 704, the signal comparator 706 of FIG. 7, the reference detector 880, the reference predictor 804 of FIG. 8, the media CODEC 4708, the processors 4710, the processor 4706, the device 4700, one or more devices configured to designate the high-band non-reference signal (e.g., a processor executing instructions that are stored at a computer-readable storage device), or a combination thereof.

The apparatus further includes means for transmitting information corresponding to the first high-band portion of the first signal, and a set of adjustment gain parameters corresponding to the high-band non-reference signal. For example, the means for transmitting may include the transmitter 110, one or more devices configured to transmit the information and the set of adjustment gain parameters.

Further in conjunction with the described aspects, an apparatus includes means for receiving information, a set of adjustment gain parameters, and a reference channel indicator. For example, the means for receiving may include the receiver 111, the second device 106 of FIG. 1, one or more devices configured to receive the information and the set of adjustment gain parameters.

The apparatus also includes means for generating a first high-band portion of a first signal based on the information. For example, the means for generating the first high-band portion may include the gain adjuster 183, the decoder 118, the second device 106 of FIG. 1, the HB decoder 2412 of FIG. 24, the synthesizer 2902, the signal adjuster 2904, the gain adjuster 2910, the HB decoder 2911 of FIG. 29, the HB decoder 3011 of FIG. 30, the HB decoder 3112 of FIG. 31, the HB decoder 3212 of FIG. 32, the LPC synthesizer 3314 of FIG. 33, the gain shapes compensator 3404, the gain frame compensator 3408 of FIG. 34, the media CODEC 4708, the processors 4710, the processor 4706, the device 4700, one or more devices configured to generate the first high-band portion (e.g., a processor executing instructions that are stored at a computer-readable storage device), or a combination thereof.

The apparatus further includes means for generating a non-reference high-band portion of a non-reference signal based on the set of adjustment gain parameters. For example, the means for generating the non-reference high-band portion may include the gain adjuster 183, the decoder 118, the second device 106 of FIG. 1, the HB decoder 2412 of FIG. 24, the signal adjuster 2906, the gain adjuster 2912, the spectral shape adjuster 2914, the HB decoder 2911 of FIG. 29, the HB decoder 3011 of FIG. 30, the HB decoder 3112 of FIG. 31, the HB decoder 3212 of FIG. 32, the gain adjuster 3512, the gain ratio compensator 3506 of FIG. 35, the gain adjuster 3612, the gain ratio compensator 3506 of FIG. 35, the gain adjuster 3712, the gain compensator 3708 of FIG. 37, the spectral shape adjuster 3814, the spectral shaping filter 3806 of FIG. 38, the spectral shape adjuster 3914, the synthesizer 3916 of FIG. 39, the media CODEC 4708, the processors 4710, the processor 4706, the device 4700, one or more devices configured to generate the non-reference high-band portion (e.g., a processor executing instructions that are stored at a computer-readable storage device), or a combination thereof.

Also in conjunction with the described aspects, an apparatus includes means for generating linear predictive coefficient (LPC) parameters of a first high-band portion of a first audio signal, a set of first gain parameters of the first high-band portion, and a set of adjustment gain parameters of a second high-band portion of a second audio signal. For example, the means for generating may include the gain analyzer 182, the encoder 114, the first device 104 of FIG. 1, the mid BWE coder 214, the BWE spatial balancer 212 of FIG. 2, the media CODEC 4708, the processors 4710, the device 4700, one or more devices configured to generate the LPC parameters, the set of first gain parameters, and the set of adjustment gain parameters (e.g., a processor executing instructions that are stored at a computer-readable storage device), or a combination thereof.

The apparatus also includes means for transmitting the LPC parameters, the set of first gain parameters, and the set of adjustment gain parameters. For example, the means for transmitting may include the transmitter 110, one or more devices configured to transmit the LPC parameters, the set of first gain parameters, and the set of adjustment gain parameters, or a combination thereof.

Further in conjunction with the described aspects, an apparatus includes means for receiving LPC parameters, a set of first gain parameters, and a set of adjustment gain parameters. For example, the means for receiving may include the receiver 111, one or more devices configured to receive the LPC parameters, the set of first gain parameters, and the set of adjustment gain parameters, or a combination thereof.

The apparatus also includes means for generating a first high-band portion of a first audio signal based on the LPC parameters and the set of first gain parameters and generating a second high-band portion of a second audio signal based on the set of adjustment gain parameters. For example, the means for generating may include the gain adjuster 183, the decoder 118, the second device 106 of FIG. 1, the HB decoder 2412 of FIG. 24, the HB decoder 2911 of FIG. 29, the HB decoder 3112 of FIG. 31, the HB decoder 3212 of FIG. 32, the media CODEC 4708, the processors 4710, the device 4700, one or more devices configured to generate the first high-band portion and generate the second high-band portion (e.g., a processor executing instructions that are stored at a computer-readable storage device), or a combination thereof.

Also in conjunction with the described aspects, an apparatus includes means for generating linear predictive coefficient (LPC) parameters of a first high-band portion of a first audio signal and generating an adjustment spectral shape parameter of a second high-band portion of a second audio signal. For example, the means for generating may include the spectral shape analyzer 184, the encoder 114, the first device 104 of FIG. 1, the mid BWE coder 214, the BWE spatial balancer 212 of FIG. 2, the media CODEC 4708, the processors 4710, the device 4700, one or more devices configured to generate the LPC parameters and the adjustment spectral shape parameter (e.g., a processor executing instructions that are stored at a computer-readable storage device), or a combination thereof.

The apparatus also includes means for transmitting the LPC parameters and the adjustment spectral shape parameter. For example, the means for transmitting may include the transmitter 110, one or more devices configured to transmit the LPC parameters and the adjustment spectral shape parameter, or a combination thereof.

Further in conjunction with the described aspects, an apparatus includes means for receiving LPC parameters and an adjustment spectral shape parameter. For example, the means for receiving may include the receiver 111, one or more devices configured to receive the LPC parameters and the adjustment spectral shape parameter, or a combination thereof.

The apparatus also includes means for generating a first high-band portion of a first audio signal based on the LPC parameters and generating a second high-band portion of a second audio signal based on the adjustment spectral shape parameter. For example, the means for generating may include the spectral shape adjuster 185, the decoder 118, the second device 106 of FIG. 1, the HB decoder 2412 of FIG. 24, the HB decoder 2911 of FIG. 29, the HB decoder 3112 of FIG. 31, the HB decoder 3212 of FIG. 32, the media CODEC 4708, the processors 4710, the device 4700, one or more devices configured to generate the first high-band portion and generate the second high-band portion (e.g., a processor executing instructions that are stored at a computer-readable storage device), or a combination thereof.

Also in conjunction with the described aspects, an apparatus includes means for receiving LPC parameters and inter-channel level difference (ILD) parameters. For example, the means for receiving may include the receiver 111, one or more devices configured to receive the LPC parameters and the ILD parameters, or a combination thereof.

The apparatus also includes means for generating a first high-band portion of a first audio signal based on the LPC parameters and generating a second high-band portion of a second audio signal based on the ILD parameters. For example, the means for generating may include the spectral shape adjuster 185, the gain adjuster 183, the decoder 118, the second device 106 of FIG. 1, the tilt parameter predictor 2424, the HB decoder 2412 of FIG. 24, the media CODEC 4708, the processors 4710, the device 4700, one or more devices configured to generate the first high-band portion and generate the second high-band portion (e.g., a processor executing instructions that are stored at a computer-readable storage device), or a combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A device comprising:

an encoder configured to:

generate a first high-band portion of a mid signal based on a left signal and a right signal;

generate a first synthesized signal based at least in part on a first gain and linear predictive coefficient (LPC) parameters;

generate a second synthesized signal based at least in part on a second gain and the LPC parameters;

generate a set of first gain parameters based on a comparison of the first synthesized signal and the first high-band portion of the mid signal; and generate a set of adjustment gain parameters based at least in part on the second synthesized signal and a high-band non-reference signal, the high-band non-reference signal corresponding to one of a left high-band portion of the left signal or a right high-band portion of the right signal; and a transmitter configured to:

transmit information corresponding to the first high-band portion of the mid signal, wherein the information includes the LPC parameters, the set of first gain parameters, or a combination thereof; and transmit the set of adjustment gain parameters.

2. The device of claim 1, wherein the left signal corresponds to a left channel of a received stereo signal and the right signal corresponds to a right channel of the received stereo signal, and wherein the encoder is further configured to generate the mid signal based on a downmix of the left signal and the right signal.

3. The device of claim 1, wherein the encoder is further configured to:

designate, based on a comparison of a first energy of the left signal and a second energy of the right signal, one of the left signal or the right signal as a reference signal and the other of the left signal or the right signal as a non-reference signal, wherein the high-band non-reference signal corresponds to a high-band portion of the non-reference signal.

4. The device of claim 1, wherein the encoder is further configured to:

designate the high-band non-reference signal based on a temporal mismatch value indicative of an amount of temporal mismatch between the left signal and the right signal; and selectively update the designation of the high-band non-reference signal based at least in part on a first energy of the left signal, a second energy of the right signal, a third energy of the left high-band portion, or a fourth energy of the right high-band portion.

5. The device of claim 1, wherein the encoder is further configured to:

determine a temporal gain parameter based on a ratio of a first energy of one or more left low-band portions of the left signal relative to a second energy of one or more right low-band portions of the right signal;

determine whether the temporal gain parameter satisfies a threshold; and designate, based on the determination of the temporal gain parameter satisfying the threshold, one of the left signal or the right signal as a reference signal and the other of the left signal or the right signal as a non-reference signal, wherein the high-band non-reference signal corresponds to a high-band portion of the non-reference signal.

6. The device of claim 1, wherein the encoder is further configured to:

generate an adjustment spectral shape parameter based on the high-band non-reference signal and a synthesized high-band non-reference signal; and apply, based on the adjustment spectral shape parameter, a spectral shape adjustment on the synthesized high-band non-reference signal to generate a modified synthesized high-band non-reference signal, and wherein the transmitter is further configured to transmit the adjustment spectral shape parameter.

7. The device of claim 6, wherein the set of adjustment gain parameters is based on the modified synthesized high-band non-reference signal.

8. The device of claim 1, wherein the encoder is further configured to:

designate the other of the left high-band portion of the left signal or the right high-band portion of the right signal as a high-band reference signal;

generate an adjustment spectral shape parameter based on the high-band non-reference signal and a high-band reference signal; and apply, based on the adjustment spectral shape parameter, a spectral shape adjustment on a synthesized high-band non-reference signal to generate a modified synthesized high-band non-reference signal, and wherein the transmitter is further configured to transmit the adjustment spectral shape parameter.

9. The device of claim 8, where the set of adjustment gain parameters is based on the modified synthesized high-band non-reference signal.

10. A device comprising:

a receiver configured to receive information, a set of adjustment gain parameters, a second set of adjustment gain parameters, and a reference channel indicator; and a decoder configured to:

generate a first high-band portion of a first signal based on the information;

generate a non-reference high-band portion of a non-reference signal based on the set of adjustment gain parameters; and generate a reference high-band portion of a reference signal based on the first high-band portion and the second set of adjustment gain parameters.

11. The device of claim 10, wherein the non-reference high-band portion is generated further based on the first high-band portion.

12. The device of claim 10, wherein the information includes high-band linear predictive coefficient (LPC) parameters, a set of first high-band gain parameters, or a combination thereof, and wherein the first signal corresponds to a mid signal.

13. The device of claim 10, wherein the non-reference high-band portion corresponds to a left high-band portion of a left signal corresponding to a left channel of a synthesized output stereo signal, and wherein the reference high-band portion corresponds to a right high-band portion of a right signal corresponding to a right channel of the synthesized output stereo signal.

14. The device of claim 10, wherein the decoder is further configured to:

generate the non-reference high-band portion by applying the set of adjustment gain parameters to the first high-band portion; and generate the reference high-band portion by applying the second set of adjustment gain parameters to the first high-band portion.

15. The device of claim 10, wherein the decoder is further configured to determine that one of a left signal of a synthesized stereo output signal or a right signal of the synthesized stereo output signal corresponds to the non-reference signal.

16. The device of claim 10, wherein the receiver is further configured to receive a reference channel indicator, and wherein the decoder is further configured to:

based on the reference channel indicator, determine that one of a left signal of a synthesized stereo output signal or a right signal of the synthesized stereo output signal corresponds to a reference signal and the other of the left signal or the right signal corresponds to the non-reference signal; and determine that the non-reference high-band portion corresponds to a high-band portion of the one of the left signal or the right signal that corresponds to the non-reference signal.

17. The device of claim 10, wherein the reference high-band portion corresponds to a first weighting of a noise component to a harmonic component, and wherein the non-reference high-band portion corresponds to a second weighting of the noise component to the harmonic component.

18. The device of claim 10, wherein the information includes linear predictive coefficient (LPC) parameters, wherein the receiver is further configured to receive an adjustment spectral shape parameter, and wherein the decoder is further configured to generate a particular high-band signal based on the LPC parameters and the adjustment spectral shape parameter, wherein the non-reference high-band portion is generated further based on the particular high-band signal.

19. A method of communication comprising:

generating, at a device, a first high-band portion of a first signal based on a left signal and a right signal;

generating, at the device, a set of adjustment gain parameters based on a high-band non-reference signal, the high-band non-reference signal corresponding to one of a left high-band portion of the left signal or a right high-band portion of the right signal;

generating, at the device, an adjustment spectral shape parameter based on the high-band non-reference signal and a synthesized high-band non-reference signal; and transmitting, from the device, the set of adjustment gain parameters, the adjustment spectral shape parameter, and information corresponding to the first high-band portion of the first signal.

20. The method of claim 19, further comprising applying, based on the adjustment spectral shape parameter, a spectral shape adjustment to the synthesized high-band non-reference signal to generate a modified synthesized high-band non-reference signal, wherein the set of adjustment gain parameters is based on the modified synthesized high-band non-reference signal.

21. The method of claim 19, wherein the information includes high-band linear predictive coefficient (LPC) parameters, a set of first high-band gain parameters, or a combination thereof.

22. The method of claim 19, wherein the left signal corresponds to a left channel of a received stereo signal and the right signal corresponds to a right channel of the received stereo signal, wherein the first signal is based on a downmix of the left signal and the right signal, wherein the first signal corresponds to a mid signal, and wherein the first high-band portion of the first signal corresponds to a high-band portion of the mid signal.

23. The method of claim 19, further comprising:

generating, at the device, a first synthesized high-band signal based on high-band linear predictive coefficient (LPC) parameters and a non-linear harmonic high-band excitation of a mid signal, wherein the synthesized high-band non-reference signal is based on at least the first synthesized high-band signal or a modified non-linear harmonic high-band excitation of the mid signal, and wherein the first signal includes the mid signal;

generating, at the device, a set of first high-band gain parameters based on a comparison of the first synthesized high-band signal and a high-band portion of the mid signal; and determining, at the device, the set of adjustment gain parameters based on the synthesized high-band non-reference signal, the first synthesized high-band signal, a correction factor, or a combination thereof, wherein the information includes the high-band LPC parameters, the set of first high-band gain parameters, or a combination thereof.

24. The method of claim 23, wherein the correction factor is 1.

25. The method of claim 23, wherein the correction factor is based on the high-band non-reference signal and a high-band reference signal, the high-band reference signal corresponding to the other of the left high-band portion of the left signal or the right high-band portion of the right signal.

26. The method of claim 25, wherein the correction factor is based at least in part on a ratio of a non-reference high-band energy of the high-band non-reference signal and a reference high-band energy of the high-band reference signal.

27. A method of communication comprising:

receiving, at a device, information, a set of adjustment gain parameters, and a reference channel indicator;

generating, at the device, a first high-band portion of a first signal based on the information;

generating, at the device, a reference high-band portion of a reference signal based at least in part on the first high-band portion, wherein the reference high-band portion corresponds to a first weighting of a noise component of a first synthesized mid signal relative to a harmonic component of the first synthesized mid signal; and generating, at the device, a non-reference high-band portion of a non-reference signal based on the set of adjustment gain parameters, wherein the non-reference high-band portion corresponds to a second weighting of a noise component of a second synthesized mid signal relative to a harmonic component of the second synthesized mid signal.

28. The method of claim 27, wherein the information includes high-band linear predictive coefficient (LPC) parameters, a set of first high-band gain parameters, or a combination thereof, and wherein the first signal corresponds to a mid signal.

29. The method of claim 27, further comprising generating, at the device, a predicted second set of adjustment gain parameters based at least in part on the set of adjustment gain parameters, a ratio of low-band energies, or a combination thereof, wherein the reference high-band portion of the reference signal is based at least in part on the predicted second set of adjustment gain parameters.

30. The method of claim 29, wherein the non-reference high-band portion is generated by applying the set of adjustment gain parameters to the first high-band portion, and wherein the reference high-band portion is generated by applying the predicted second set of adjustment gain parameters to the first high-band portion.

* * * * *